US008919594B2

(12) United States Patent
Teys

(10) Patent No.: US 8,919,594 B2
(45) Date of Patent: Dec. 30, 2014

(54) DISPENSING CONTAINER

(75) Inventor: Bradley Donald Teys, Caloundra (AU)

(73) Assignee: Sands Innovations Pty Ltd, Brisbane QLD (AU)

( * ) Notice: Subject to any disclaimer, the term of this patent is extended or adjusted under 35 U.S.C. 154(b) by 799 days.

(21) Appl. No.: 12/525,260

(22) PCT Filed: Jan. 31, 2008

(86) PCT No.: PCT/AU2008/000104

§ 371 (c)(1),
(2), (4) Date: Jul. 30, 2009

(87) PCT Pub. No.: WO2008/092200

PCT Pub. Date: Aug. 7, 2008

(65) Prior Publication Data

US 2010/0116772 A1 May 13, 2010

(30) Foreign Application Priority Data

Jan. 31, 2007 (AU) ..... 2007900446

(51) Int. Cl.

| | |
|---|---|
| ***B65D 17/42*** | (2006.01) |
| ***A61J 7/00*** | (2006.01) |
| ***A45D 34/04*** | (2006.01) |
| ***A46B 11/00*** | (2006.01) |
| ***A46B 15/00*** | (2006.01) |
| ***A47G 21/00*** | (2006.01) |
| ***B65D 75/58*** | (2006.01) |
| *A45C 11/00* | (2006.01) |

(52) U.S. Cl.

CPC ..... *A61J 7/0053* (2013.01); *A45D 34/04* (2013.01); *A46B 11/001* (2013.01); *A46B 11/0065* (2013.01); *A46B 11/0068* (2013.01); *A46B 15/0061* (2013.01); *A47G 21/004* (2013.01); *A61J 7/0023* (2013.01); *B65D 75/585* (2013.01); *A45C 2011/007* (2013.01)

USPC ..... 220/277; 220/266; 220/268; 206/469

(58) Field of Classification Search

USPC ..... 220/277, 810, 265, 266, 268, 269, 270, 220/281, 282, 283; 206/484, 469

See application file for complete search history.

(56) References Cited

U.S. PATENT DOCUMENTS

| | | | |
|---|---|---|---|
| 1,000,178 | A | 8/1911 | Kahl |
| 1,372,325 | A | 3/1921 | Willemin |

(Continued)

FOREIGN PATENT DOCUMENTS

| | | | |
|---|---|---|---|
| AU | 6378798 | A | 11/1998 |
| AU | 1999 47456 | | 2/2000 |

(Continued)

OTHER PUBLICATIONS

Supplementary European Search Report dated May 31, 2011 from the European Patent Office in related European Patent Application No. 08700400.8 (7 pages).

(Continued)

*Primary Examiner* — Fenn Mathew
*Assistant Examiner* — Christopher McKinley
(74) *Attorney, Agent, or Firm* — Fitch, Even, Tabin & Flannery LLP

(57) ABSTRACT

A dispensing utensil (102) including a body (104) having: a carcass (104); and a pliable top wall (112) and a bottom wall (106), the walls (112, 106) supported by the carcass (104), wherein the pliable top wall (112) and bottom wall (106) define a cavity (124) for storing dispensable cavity contents; the utensil (102) further including: a lid (108) connected to the pliable top wall (112) and openable about a hinge (114) formed by the pliable top wall (112); a seal (110) sealing the lid (108) to the body (104') to seal the cavity (124); a tool portion (150); and a handle portion (152); wherein the seal (110) may be broken and the lid (108) opened about the hinge (114) formed by the pliable top wall (112), thereby allowing the cavity contents to be dispensed.

19 Claims, 34 Drawing Sheets

(56) References Cited

U.S. PATENT DOCUMENTS

| | | | | | |
|---|---|---|---|---|---|
| 1,754,973 | A | | 4/1930 | Walch | |
| 2,654,252 | A | | 10/1953 | Davis | |
| 2,837,822 | A | | 6/1958 | Wille | |
| 3,036,700 | A | | 5/1962 | Krug | |
| 3,075,639 | A | * | 1/1963 | Lingley | 206/366 |
| 3,116,152 | A | | 12/1963 | Smith | |
| 3,133,679 | A | | 5/1964 | Brown | |
| 3,154,418 | A | | 10/1964 | Lovell | |
| 3,303,930 | A | * | 2/1967 | Hyland | 206/462 |
| D209,953 | S | | 1/1968 | Stehl | |
| 3,410,457 | A | | 11/1968 | Brown | |
| 3,421,654 | A | | 1/1969 | Hexel | |
| 3,428,460 | A | * | 2/1969 | Ely | 426/86 |
| D216,306 | S | | 12/1969 | Dutch | |
| 3,521,805 | A | * | 7/1970 | Ward | 206/539 |
| 3,581,885 | A | | 6/1971 | Wald | |
| 3,618,751 | A | * | 11/1971 | Rich | 206/219 |
| 3,620,676 | A | * | 11/1971 | Davis | 422/405 |
| 3,635,376 | A | * | 1/1972 | Hellstrom | 222/107 |
| 3,648,369 | A | | 3/1972 | Frodsham | |
| 3,741,384 | A | * | 6/1973 | Cloud | 206/461 |
| 3,756,386 | A | * | 9/1973 | Marckardt | 206/219 |
| 3,776,375 | A | | 12/1973 | Rohdin | |
| 3,835,995 | A | * | 9/1974 | Haines | 206/536 |
| 3,872,970 | A | * | 3/1975 | Edison | 206/532 |
| 3,891,331 | A | * | 6/1975 | Avery | 401/132 |
| 3,911,578 | A | | 10/1975 | Ushkow et al. | |
| 3,913,734 | A | * | 10/1975 | Siegel | 206/470 |
| 3,921,805 | A | * | 11/1975 | Compere | 206/532 |
| 3,946,652 | A | | 3/1976 | Gorin | |
| 3,948,394 | A | * | 4/1976 | Hellstrom | 206/531 |
| 3,986,640 | A | * | 10/1976 | Redmond | 222/92 |
| 4,005,776 | A | | 2/1977 | Seeley | |
| 4,011,949 | A | * | 3/1977 | Braber et al. | 206/532 |
| 4,106,621 | A | * | 8/1978 | Sorenson | 206/365 |
| 4,155,454 | A | * | 5/1979 | Ryden | 206/532 |
| 4,218,155 | A | * | 8/1980 | Weidner | 401/132 |
| 4,231,496 | A | | 11/1980 | Gilson | |
| 4,236,652 | A | * | 12/1980 | Beguhn | 222/92 |
| 4,266,667 | A | | 5/1981 | Ishigaki | |
| D259,533 | S | | 6/1981 | Frodsham | |
| 4,275,646 | A | | 6/1981 | Barna | |
| 4,277,194 | A | | 7/1981 | Smith | |
| D263,074 | S | | 2/1982 | Mason | |
| 4,317,284 | A | | 3/1982 | Prindle | |
| 4,331,255 | A | | 5/1982 | Fournier | |
| 4,338,338 | A | | 7/1982 | Popkes | |
| 4,341,302 | A | * | 7/1982 | Baker et al. | 206/219 |
| 4,387,809 | A | | 6/1983 | Botzler | |
| D275,517 | S | | 9/1984 | Hamilton et al. | |
| 4,482,053 | A | * | 11/1984 | Alpern et al. | 206/439 |
| 4,493,574 | A | * | 1/1985 | Redmond et al. | 401/132 |
| 4,499,353 | A | | 2/1985 | Shields et al. | |
| D281,719 | S | * | 12/1985 | Holewinski et al. | D24/221 |
| D281,813 | S | * | 12/1985 | Holewinski et al. | D24/221 |
| 4,580,587 | A | | 4/1986 | Rittich et al. | |
| 4,602,719 | A | | 7/1986 | Borst | |
| 4,611,715 | A | | 9/1986 | Redmond | |
| 4,615,120 | A | | 10/1986 | Newman | |
| 4,655,627 | A | | 4/1987 | Bradley | |
| 4,687,129 | A | | 8/1987 | Cugley | |
| 4,724,982 | A | * | 2/1988 | Redmond | 222/94 |
| 4,784,268 | A | | 11/1988 | Perchak | |
| 4,790,429 | A | * | 12/1988 | Fukushima | 206/219 |
| 4,830,222 | A | | 5/1989 | Read | |
| 4,841,637 | A | | 6/1989 | Scholzen | |
| 4,871,091 | A | * | 10/1989 | Preziosi | 222/92 |
| 4,888,188 | A | | 12/1989 | Castner, Sr. et al. | |
| 4,891,232 | A | | 1/1990 | Dahl | |
| 4,921,137 | A | * | 5/1990 | Heijenga | 222/107 |
| 4,922,611 | A | | 5/1990 | Levy | |
| 4,938,462 | A | | 7/1990 | Gould | |
| 5,009,894 | A | * | 4/1991 | Hsiao | 424/451 |
| 5,027,947 | A | | 7/1991 | Reighart | |
| 5,048,715 | A | | 9/1991 | Wolff | |
| 5,067,822 | A | | 11/1991 | Wirth et al. | |
| 5,105,603 | A | | 4/1992 | Natterer | |
| D327,013 | S | | 6/1992 | Reighart | |
| 5,119,560 | A | | 6/1992 | Noble | |
| 5,125,528 | A | | 6/1992 | Heyn et al. | |
| 5,125,534 | A | | 6/1992 | Rose et al. | |
| RE34,087 | E | * | 10/1992 | Redmond | 222/94 |
| D330,481 | S | | 10/1992 | Green | |
| 5,154,293 | A | | 10/1992 | Gould | |
| 5,154,318 | A | | 10/1992 | Lampard | |
| 5,158,192 | A | | 10/1992 | Lataix | |
| D334,058 | S | | 3/1993 | Noble | |
| 5,203,459 | A | * | 4/1993 | Wade | 206/572 |
| 5,209,354 | A | | 5/1993 | Thornhill et al. | |
| 5,215,221 | A | | 6/1993 | Dirksing | |
| 5,238,157 | A | | 8/1993 | Gentile | |
| 5,238,179 | A | | 8/1993 | Hart | |
| 5,240,415 | A | | 8/1993 | Haynie | |
| D340,408 | S | | 10/1993 | Hirsch | |
| 5,251,758 | A | | 10/1993 | Kolacek | |
| 5,277,103 | A | | 1/1994 | Cox | |
| D344,058 | S | | 2/1994 | Jones | |
| 5,305,928 | A | | 4/1994 | Verdaguer | |
| D347,277 | S | | 5/1994 | Snedden | |
| 5,308,008 | A | | 5/1994 | Ruegg | |
| 5,348,191 | A | | 9/1994 | Dekeyser | |
| 5,377,879 | A | | 1/1995 | Isaacs | |
| 5,392,945 | A | | 2/1995 | Syrek | |
| 5,395,031 | A | * | 3/1995 | Redmond | 222/541.6 |
| 5,398,908 | A | | 3/1995 | Kienle | |
| 5,408,804 | A | | 4/1995 | Schroder | |
| 5,409,125 | A | | 4/1995 | Kimber et al. | |
| D358,466 | S | | 5/1995 | Harris et al. | |
| 5,411,178 | A | | 5/1995 | Roders et al. | |
| 5,426,919 | A | | 6/1995 | Natterer et al. | |
| 5,431,357 | A | | 7/1995 | Ruegg | |
| 5,437,881 | A | | 8/1995 | Jeannin | |
| 5,440,976 | A | | 8/1995 | Giuliano et al. | |
| D362,304 | S | | 9/1995 | Wilson et al. | |
| 5,464,595 | A | | 11/1995 | Finnah | |
| 5,477,660 | A | | 12/1995 | Smith | |
| 5,491,895 | A | | 2/1996 | Lee | |
| 5,494,192 | A | * | 2/1996 | Redmond | 222/107 |
| 5,494,252 | A | | 2/1996 | Amit et al. | |
| 5,529,224 | A | * | 6/1996 | Chan et al. | 222/212 |
| D371,491 | S | | 7/1996 | Stein | |
| 5,553,805 | A | | 9/1996 | Ruegg | |
| D375,055 | S | | 10/1996 | Reed | |
| 5,564,569 | A | | 10/1996 | Kiefer | |
| D375,352 | S | | 11/1996 | Bologna | |
| D375,353 | S | | 11/1996 | Wolff | |
| 5,577,627 | A | | 11/1996 | Richie-Dubler | |
| 5,579,957 | A | | 12/1996 | Gentile et al. | |
| 5,582,330 | A | | 12/1996 | Iba | |
| RE35,437 | E | | 2/1997 | Ascone | |
| 5,676,244 | A | | 10/1997 | Green et al. | |
| 5,676,280 | A | | 10/1997 | Robinson | |
| 5,676,990 | A | * | 10/1997 | Wawrzynski | 426/305 |
| 5,695,084 | A | | 12/1997 | Chmela et al. | |
| 5,705,212 | A | | 1/1998 | Atkinson | |
| 5,706,980 | A | | 1/1998 | Dickerson | |
| 5,792,496 | A | | 8/1998 | Fekete et al. | |
| D398,843 | S | | 9/1998 | Wiegner | |
| 5,826,737 | A | * | 10/1998 | Zakensberg | 215/47 |
| 5,827,535 | A | | 10/1998 | Stone | |
| 5,839,609 | A | * | 11/1998 | Zakensberg | 222/107 |
| D402,546 | S | | 12/1998 | Massing | |
| D403,512 | S | | 1/1999 | Hennings | |
| 5,873,167 | A | | 2/1999 | Mason | |
| 5,873,483 | A | | 2/1999 | Gortz et al. | |
| 5,875,914 | A | | 3/1999 | Nguyen et al. | |
| D407,640 | S | | 4/1999 | Nelson et al. | |
| D408,217 | S | | 4/1999 | LoGiudice | |
| D408,278 | S | | 4/1999 | Konop | |
| 5,944,516 | A | | 8/1999 | Deshaies | |
| 5,975,305 | A | * | 11/1999 | Barger | 206/572 |
| 5,979,657 | A | | 11/1999 | Bumbera | |
| 6,003,673 | A | | 12/1999 | Vieu | |
| 6,003,710 | A | | 12/1999 | Huang | |

(56) References Cited

U.S. PATENT DOCUMENTS 6,006,505 A 12/1999 Natterer
6,007,246 A 12/1999 Kinigakis et al.
D419,063 S 1/2000 Baker et al.
6,024,219 A 2/2000 Froehlich et al.
6,041,930 A 3/2000 Cockburn
D422,851 S 4/2000 Joergensen
D425,617 S 5/2000 Snedden
6,062,413 A 5/2000 Redmond
D426,708 S 6/2000 Francis
6,070,723 A 6/2000 Lewis
6,085,497 A 7/2000 Natterer
6,085,942 A * 7/2000 Redmond ..... 222/107
6,105,259 A 8/2000 Meyers et al.
6,112,898 A * 9/2000 Siragusa et al. ..... 206/524.1
6,116,450 A 9/2000 Huang
6,153,232 A 11/2000 Holten et al.
D435,665 S 12/2000 Ogle
6,159,513 A 12/2000 Judlowe et al.
D438,125 S * 2/2001 Kaposi et al. ..... D10/46.2
D440,810 S 4/2001 Olson
6,209,748 B1 4/2001 Dunbar
6,213,662 B1 4/2001 Aljanedi
6,241,124 B1 * 6/2001 Hoyt ..... 222/143
6,245,367 B1 6/2001 Galomb
6,254,907 B1 7/2001 Galomb
6,279,233 B1 8/2001 Cameron
D447,560 S 9/2001 Hellberg et al.
6,282,866 B1 9/2001 Natterer et al.
6,286,731 B1 9/2001 Lillelund et al.
6,287,612 B1 9/2001 Mandava et al.
6,295,735 B1 10/2001 Barger
6,299,012 B1 10/2001 Redmond
6,311,837 B1 11/2001 Blaustein et al.
6,328,928 B1 12/2001 Schroeder et al.
6,336,310 B1 1/2002 Redmond
6,341,472 B1 1/2002 Schroeder
6,347,727 B1 2/2002 Diaz
6,348,246 B1 * 2/2002 Finestone et al. ..... 428/34.3
6,349,866 B1 2/2002 Stewart et al.
6,357,626 B1 3/2002 Zhang et al.
D456,507 S 4/2002 LeMarr et al.
6,364,113 B1 * 4/2002 Faasse et al. ..... 206/469
6,364,203 B2 4/2002 Toussant et al.
6,364,519 B1 * 4/2002 Hughes et al. ..... 366/130
6,372,176 B1 4/2002 Ekendahl et al.
6,386,443 B1 * 5/2002 Szczerbinski ..... 229/400
6,390,358 B1 5/2002 Stewart et al.
6,395,317 B1 5/2002 Singh et al.
D458,809 S 6/2002 Richardson et al.
6,412,653 B1 * 7/2002 Waterhouse ..... 220/556
6,415,939 B1 7/2002 Redmond
D463,275 S * 9/2002 Garcia ..... D9/696
6,457,612 B1 10/2002 Zhang et al.
6,460,781 B1 * 10/2002 Garcia et al. ..... 239/327
6,471,122 B1 10/2002 Stewart et al.
6,472,007 B2 10/2002 Bezek et al.
D467,336 S 12/2002 Gilbard et al.
D467,499 S 12/2002 Garza et al.
6,516,939 B1 2/2003 Schmidt et al.
D471,628 S 3/2003 Louviere
6,536,974 B2 3/2003 Redmond
6,550,224 B2 4/2003 Kleinschmidt
6,558,150 B1 5/2003 Karbach
6,589,041 B2 7/2003 Feil
6,589,042 B2 7/2003 Stammler et al.
6,596,328 B1 7/2003 Bezek et al.
D477,965 S 8/2003 Kortleven et al.
D479,674 S 9/2003 Freed
D480,318 S 10/2003 Settele
D482,578 S 11/2003 Kortleven et al.
6,649,114 B2 11/2003 Lochner et al.
6,651,848 B1 11/2003 Redmond
D482,939 S 12/2003 Lillelund et al.
D483,257 S 12/2003 Lim
D484,425 S 12/2003 Settele
6,655,903 B2 12/2003 Kohler
6,662,454 B2 12/2003 Harrold
6,663,019 B2 * 12/2003 Garcia et al. ..... 239/327
6,673,301 B2 1/2004 Cargile et al.
6,675,482 B1 1/2004 Gilbert, Jr. et al.
6,685,058 B2 2/2004 Redmond
6,688,469 B1 2/2004 Barnes
6,691,901 B2 2/2004 Parve et al.
6,692,212 B2 2/2004 Trautwein et al.
D487,397 S 3/2004 Peghini
6,698,165 B1 3/2004 Natterer
6,699,006 B2 3/2004 Schlimgen et al.
6,701,692 B1 3/2004 Niehr
6,706,297 B1 3/2004 Toth et al.
6,712,599 B2 3/2004 Schlimgen et al.
D488,079 S 4/2004 Mastroianni
D488,394 S 4/2004 Overthun et al.
6,726,054 B2 * 4/2004 Fagen et al. ..... 221/45
D489,820 S 5/2004 Masuda et al.
6,736,379 B1 5/2004 Wegner et al.
D492,407 S 6/2004 Masuda et al.
D494,676 S 8/2004 Dubniczki et al.
D494,877 S 8/2004 Kempe et al.
6,769,558 B1 8/2004 Bucholtz
6,769,684 B2 8/2004 Gandelheidt
6,783,030 B2 8/2004 Redmond
6,802,423 B2 10/2004 O'Brien
D500,850 S 1/2005 Clark et al.
6,845,597 B2 1/2005 Redmond
6,848,339 B2 2/2005 Hakim
6,851,920 B2 2/2005 Trautwein et al.
6,860,405 B1 3/2005 Poynter
6,874,665 B2 4/2005 Doherty et al.
6,905,323 B2 6/2005 Keller
6,910,623 B2 6/2005 Stewart et al.
6,928,870 B1 8/2005 Lieborwitz
6,942,097 B1 9/2005 Stremple et al.
6,953,420 B2 10/2005 Karbach
6,957,909 B1 * 10/2005 Dingeldein et al. ..... 366/130
D511,645 S 11/2005 Fort et al.
D514,935 S 2/2006 Sturk
7,004,322 B1 * 2/2006 Bartoli ..... 206/484
7,005,109 B2 * 2/2006 Husar ..... 422/500
D517,207 S 3/2006 Poynter
7,013,568 B2 3/2006 Schmidt
D524,610 S 7/2006 Kushner
7,069,705 B2 7/2006 Redmond
7,104,419 B2 * 9/2006 Fagen et al. ..... 221/45
7,121,409 B1 * 10/2006 Hamilton et al. ..... 206/484.2
D531,918 S 11/2006 Heiligenstein et al.
7,140,863 B2 11/2006 Koppenhofer
7,143,910 B2 12/2006 Redmond
D534,648 S 1/2007 Zahn et al.
7,175,215 B2 2/2007 Harris
D539,420 S 3/2007 Zahn et al.
7,198,161 B2 4/2007 Bucholtz
7,210,600 B1 5/2007 Delio, Jr.
7,219,816 B1 5/2007 Xia et al.
7,226,230 B2 6/2007 Liberatore
D545,636 S 7/2007 Risden
D545,640 S 7/2007 Risden
D547,134 S 7/2007 Everett et al.
D547,860 S 7/2007 Zahn et al.
7,240,797 B1 7/2007 Grossman
D548,834 S 8/2007 Hansen
7,258,255 B2 8/2007 Vogel et al.
D551,760 S 9/2007 Zahn et al.
7,270,239 B1 9/2007 Ross
D556,321 S 11/2007 Starnes
7,290,380 B2 11/2007 Natterer
7,293,683 B2 11/2007 Natterer
7,299,947 B2 11/2007 Lingenhoff
D560,442 S 1/2008 Teys et al.
D560,443 S 1/2008 Teys et al.
7,314,196 B2 1/2008 Gandelheidt et al.
7,314,328 B2 1/2008 Liberatore
7,320,398 B2 1/2008 Bertl et al.
7,325,370 B2 2/2008 Redmond
7,325,703 B2 2/2008 Gherdan et al.

(56) References Cited

U.S. PATENT DOCUMENTS

| | | | | |
|---|---|---|---|---|
| 7,325,994 | B2 | 2/2008 | Liberatore | |
| D565,193 | S * | 3/2008 | Price | D24/224 |
| 7,347,680 | B2 | 3/2008 | Hessenbruch | |
| D567,004 | S | 4/2008 | Bottega | |
| 7,361,008 | B2 | 4/2008 | Crepaz | |
| 7,370,564 | B2 | 5/2008 | Hennes | |
| 7,374,046 | B1 | 5/2008 | O'Brien | |
| D570,164 | S | 6/2008 | Teys et al. | |
| D571,002 | S | 6/2008 | Starnes | |
| D572,089 | S | 7/2008 | Teys et al. | |
| D572,976 | S | 7/2008 | Mansfield | |
| 7,413,080 | B2 | 8/2008 | Van House | |
| 7,413,083 | B2 | 8/2008 | Belfance et al. | |
| 7,431,529 | B1 | 10/2008 | Rushe et al. | |
| D580,715 | S | 11/2008 | Finell | |
| 7,478,960 | B2 | 1/2009 | Glover | |
| 7,487,625 | B2 | 2/2009 | Natterer et al. | |
| 7,487,894 | B2 | 2/2009 | Zahn et al. | |
| 7,490,974 | B2 | 2/2009 | Hennes | |
| 7,503,604 | B2 | 3/2009 | Raeder et al. | |
| 7,506,762 | B2 | 3/2009 | Nelson et al. | |
| 7,513,397 | B2 | 4/2009 | Zahn et al. | |
| D592,826 | S | 5/2009 | Lingenhoff | |
| 7,540,291 | B2 | 6/2009 | Gandelheidt | |
| 7,556,147 | B2 * | 7/2009 | Leiner et al. | 206/219 |
| 7,562,796 | B2 | 7/2009 | Zahn et al. | |
| 7,568,590 | B1 | 8/2009 | Gross et al. | |
| 7,571,813 | B2 | 8/2009 | Weisskopf | |
| 7,600,358 | B2 | 10/2009 | Natterer | |
| D604,635 | S * | 11/2009 | Xu | D9/707 |
| 7,628,125 | B2 | 12/2009 | Kaita et al. | |
| 7,631,776 | B2 | 12/2009 | Vovan et al. | |
| 7,648,328 | B2 | 1/2010 | Binder et al. | |
| D609,362 | S | 2/2010 | Rannikko et al. | |
| 7,669,597 | B2 | 3/2010 | Sullivan et al. | |
| 7,669,714 | B1 | 3/2010 | Grossman | |
| 7,690,883 | B2 | 4/2010 | Huber et al. | |
| 7,703,619 | B2 * | 4/2010 | Van Puijenbroek | 220/4.21 |
| D636,890 | S | 4/2011 | Teys et al. | |
| 7,922,021 | B2 | 4/2011 | Golden | |
| 7,993,692 | B2 * | 8/2011 | Finley et al. | 426/112 |
| 8,028,837 | B2 * | 10/2011 | Gerstle et al. | 206/494 |
| 8,091,242 | B2 * | 1/2012 | Teys et al. | 30/324 |
| 8,091,704 | B2 * | 1/2012 | Trigg | 206/469 |
| 8,151,984 | B2 * | 4/2012 | Braeder et al. | 206/219 |
| 8,177,066 | B2 * | 5/2012 | Tilton | 206/462 |
| 8,403,936 | B2 * | 3/2013 | Hess et al. | 606/92 |
| 2001/0001470 | A1 | 5/2001 | Toussant et al. | |
| 2002/0104856 | A1 * | 8/2002 | Clark et al. | 222/633 |
| 2002/0113074 | A1 | 8/2002 | Baker | |
| 2002/0180114 | A1 | 12/2002 | Cargile et al. | |
| 2003/0015605 | A1 * | 1/2003 | Garcia et al. | 239/327 |
| 2003/0029868 | A1 | 2/2003 | Davidov et al. | |
| 2003/0066870 | A1 | 4/2003 | Stewart | |
| 2003/0183641 | A1 | 10/2003 | Asbury | |
| 2003/0222099 | A1 | 12/2003 | Keller | |
| 2004/0006874 | A1 | 1/2004 | Kamm et al. | |
| 2004/0074802 | A1 * | 4/2004 | Piliero et al. | 206/524.1 |
| 2004/0094548 | A1 | 5/2004 | Laveault | |
| 2004/0105715 | A1 | 6/2004 | Spelman et al. | |
| 2004/0187662 | A1 | 9/2004 | Ulmer et al. | |
| 2005/0042019 | A1 | 2/2005 | Gaynes et al. | |
| 2005/0116482 | A1 | 6/2005 | Harris | |
| 2005/0218106 | A1 | 10/2005 | Yui | |
| 2005/0236442 | A1 | 10/2005 | Kratzer | |
| 2005/0249031 | A1 | 11/2005 | Morgese et al. | |
| 2005/0252351 | A1 | 11/2005 | Natterer | |
| 2006/0124654 | A1 | 6/2006 | Cai | |
| 2006/0191805 | A1 | 8/2006 | Vogel et al. | |
| 2006/0283727 | A1 * | 12/2006 | Nelson et al. | 206/219 |
| 2007/0012710 | A1 | 1/2007 | Vovan | |
| 2007/0045317 | A1 | 3/2007 | Rosender et al. | |
| 2007/0084064 | A1 | 4/2007 | Fite et al. | |
| 2007/0102308 | A1 | 5/2007 | Tremblay et al. | |
| 2007/0125667 | A1 * | 6/2007 | Lee et al. | 206/219 |
| 2007/0187277 | A1 | 8/2007 | Furlong | |
| 2007/0235104 | A1 | 10/2007 | Lingenhoff | |
| 2007/0267183 | A1 | 11/2007 | Hennes | |
| 2008/0002921 | A1 | 1/2008 | Redmond | |
| 2008/0034710 | A1 | 2/2008 | Ehrmann | |
| 2008/0040862 | A1 | 2/2008 | Bravo | |
| 2008/0072432 | A1 | 3/2008 | Teys et al. | |
| 2008/0072433 | A1 | 3/2008 | Ohring et al. | |
| 2008/0149523 | A1 | 6/2008 | O'Brien | |
| 2008/0152767 | A1 | 6/2008 | Maisel | |
| 2008/0191381 | A1 | 8/2008 | Hennes | |
| 2008/0210716 | A1 | 9/2008 | Weyts | |
| 2008/0278340 | A1 | 11/2008 | Jokele et al. | |
| 2009/0000255 | A1 | 1/2009 | Dandl et al. | |
| 2009/0025340 | A1 | 1/2009 | Natterer et al. | |
| 2009/0050649 | A1 | 2/2009 | Rushe et al. | |
| 2009/0057386 | A1 | 3/2009 | Redmond | |
| 2009/0071099 | A1 | 3/2009 | Ehrmann et al. | |
| 2009/0071100 | A1 | 3/2009 | Ehrmann et al. | |
| 2009/0071107 | A1 | 3/2009 | Ehrmann | |
| 2009/0097949 | A1 | 4/2009 | Binder et al. | |
| 2009/0152261 | A1 | 6/2009 | Capriotti | |
| 2009/0173039 | A1 | 7/2009 | Slomski et al. | |
| 2009/0173041 | A1 | 7/2009 | Moessnang | |
| 2009/0173049 | A1 | 7/2009 | Ruzic et al. | |
| 2009/0217532 | A1 | 9/2009 | Cantu | |
| 2009/0217625 | A1 | 9/2009 | Moessnang | |
| 2009/0218374 | A1 | 9/2009 | Liberatore | |
| 2009/0241469 | A1 | 10/2009 | Moessnang et al. | |
| 2009/0255218 | A1 | 10/2009 | Moessnang | |
| 2009/0260319 | A1 | 10/2009 | Botzenhardt et al. | |
| 2009/0260320 | A1 | 10/2009 | Miller et al. | |
| 2009/0260325 | A1 | 10/2009 | Haering | |
| 2009/0260326 | A1 | 10/2009 | Grimm et al. | |
| 2009/0261230 | A1 | 10/2009 | Imhof | |
| 2009/0266028 | A1 | 10/2009 | Zeller et al. | |
| 2009/0288365 | A1 | 11/2009 | Negele | |
| 2009/0294454 | A1 | 12/2009 | Harding | |
| 2009/0314415 | A1 | 12/2009 | Gross et al. | |
| 2009/0314777 | A1 | 12/2009 | Gross et al. | |
| 2010/0024360 | A1 | 2/2010 | Ehrmann et al. | |
| 2010/0024668 | A1 | 2/2010 | Huber et al. | |
| 2010/0065567 | A1 | 3/2010 | Vovan | |
| 2010/0065582 | A1 | 3/2010 | Nelson et al. | |
| 2010/0095640 | A1 | 4/2010 | Grimm | |
| 2010/0107572 | A1 | 5/2010 | Slomp et al. | |
| 2010/0108680 | A1 | 5/2010 | Vovan et al. | |
| 2010/0116772 | A1 | 5/2010 | Teys | |
| 2011/0024462 | A1 | 2/2011 | Teys | |
| 2011/0100859 | A1 | 5/2011 | Burattini | |
| 2011/0290800 | A1 | 12/2011 | Teys | |

FOREIGN PATENT DOCUMENTS

| | | | |
|---|---|---|---|
| AU | 750188 | | 5/2001 |
| AU | 764881 | | 9/2003 |
| AU | 2004 100000 | | 2/2004 |
| AU | 200415919 | | 6/2005 |
| AU | 200415920 | | 6/2005 |
| BE | 1008054 | | 1/1996 |
| CA | 2376147 | | 4/2001 |
| CN | 2081671 | | 7/1991 |
| DE | 2124931 | A1 | 11/1972 |
| DE | 2232861 | | 1/1974 |
| DE | 7523870 | | 11/1976 |
| DE | 19627243 | | 1/1998 |
| DE | 19904649 | | 10/2000 |
| DE | 7237741 | | 10/2002 |
| DE | 202004006760 | | 9/2005 |
| DE | 102004055796 | | 5/2006 |
| DE | 102005028618 | | 12/2006 |
| DE | 102007009457 | | 8/2008 |
| EP | 0496587 | | 7/1992 |
| EP | 0778018 | | 6/1997 |
| EP | 0778018 | | 11/1997 |
| EP | 0937655 | | 8/1998 |
| EP | 1068850 | | 10/2000 |
| EP | 1121922 | | 8/2001 |
| EP | 1194108 | | 4/2002 |

(56) References Cited

FOREIGN PATENT DOCUMENTS

| | | | |
|---|---|---|---|
| EP | 1334045 | | 8/2003 |
| FR | 1418834 | | 11/1965 |
| FR | 2063745 | | 9/1971 |
| FR | 2169652 | | 9/1973 |
| FR | 2622424 | | 5/1989 |
| FR | 2680456 | | 2/1993 |
| FR | 2697331 | | 4/1994 |
| GB | 890770 | | 3/1962 |
| GB | 1017425 | | 1/1966 |
| GB | 2343440 | | 5/2000 |
| GB | 2351272 | | 12/2000 |
| GB | 2373710 | | 10/2002 |
| GB | 2375040 | | 11/2002 |
| GB | 2382020 | | 5/2003 |
| GB | 2383989 | | 7/2003 |
| GB | 2401025 | | 11/2004 |
| GB | 2418193 | | 3/2006 |
| GB | 2454230 | | 5/2009 |
| JP | 62-78655 | | 5/1987 |
| JP | 01-084846 | A | 3/1989 |
| JP | 64084846 | | 3/1989 |
| JP | 1-058464 | | 4/1989 |
| JP | 1-104271 | | 7/1989 |
| JP | 04082701 | | 3/1992 |
| JP | 4122213 | | 4/1992 |
| JP | 7255581 | | 10/1995 |
| JP | 9252911 | | 9/1997 |
| JP | 2000005024 | | 1/2000 |
| JP | 2000333811 | | 12/2000 |
| JP | 2001299552 | | 10/2001 |
| JP | 2005152558 | | 6/2005 |
| KR | 100740376 | B1 | 7/2007 |
| NL | 1036045 | | 10/2009 |
| NZ | 516257 | | 7/2003 |
| SI | 9400348 | | 4/1996 |
| SI | 19600327 | | 6/1998 |
| WO | 9630272 | | 10/1996 |
| WO | 9703634 | | 2/1997 |
| WO | 9706073 | | 2/1997 |
| WO | 9713428 | | 4/1997 |
| WO | 9734816 | | 9/1997 |
| WO | WO9808751 | | 3/1998 |
| WO | 9819583 | | 5/1998 |
| WO | 9851259 | | 11/1998 |
| WO | 9903441 | | 1/1999 |
| WO | 9909871 | | 3/1999 |
| WO | 99/44482 | | 9/1999 |
| WO | WO 9961337 | A2 | 12/1999 |
| WO | 0100134 | | 1/2001 |
| WO | 0136293 | | 5/2001 |
| WO | 0170080 | | 9/2001 |
| WO | 0232782 | | 4/2002 |
| WO | 03055435 | | 7/2003 |
| WO | 03086900 | | 10/2003 |
| WO | WO 2004063048 | | 7/2004 |
| WO | 2005065498 | | 7/2005 |
| WO | WO 2005/065498 | A1 | 7/2005 |
| WO | 2005116590 | | 12/2005 |
| WO | 2006000376 | | 1/2006 |
| WO | 2006051305 | | 5/2006 |
| WO | 2006137674 | | 12/2006 |
| WO | 2007082034 | | 7/2007 |
| WO | 2007087357 | | 8/2007 |
| WO | 2008092200 | | 7/2008 |
| WO | 2009006690 | | 1/2009 |
| WO | 2009047821 | | 4/2009 |
| WO | 2010065980 | | 6/2010 |

OTHER PUBLICATIONS

International Search Report dated May 1, 2008.

European Search Report dated Aug. 13, 2009 issued in corresponding EP Application No. 0480211.0.

U.S. Appl. No. 12/795,220, filed Jun. 7, 2010, entitled Reclosable Container, 45 pages.

U.S. Appl. No. 13/133,641, filed Jun. 8, 2011, entitled Dispensing Container , 65 pages.

U.S. Appl. No. 13/041,131, filed Mar. 4, 2011, entitled Fracturable Container, 42 pages.

Written Opinion of the International Searching Authority, dated May 1, 2008, from related PCT Application No. PCT/AU/2008/000104, 5 pages.

Note of Reasons for Rejection dated Sep. 18, 2012, from corresponding Japanese Patent App. No. 2009-547490, 3 pages.

Office Action from corresponding Chinese App. No. 200820003654.2, mailed after May 10, 2011, 12 pages.

Patent Examination Report No. 1 from corresponding Australian Patent App. No. 2008210167, dates Sep. 4, 2012, 4 pages.

Japanese Patent Office, Notice of Reason of Rejection for App. No. 2007-548642, mailed Mar. 9, 2012, which contains a concise statement of relevance of Japanese References 62-78655 and 1-104271, 2 pages.

* cited by examiner

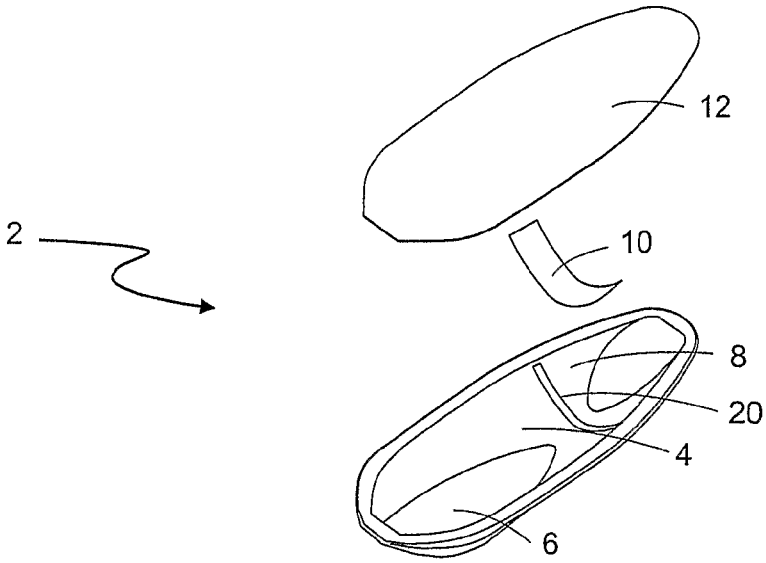
Fig 1a
Fig 1b
Fig 1c
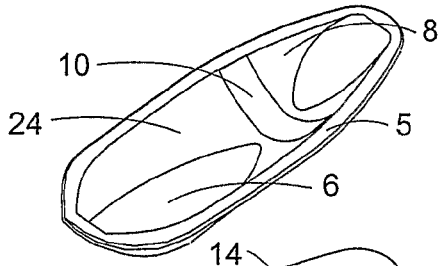
Fig 2
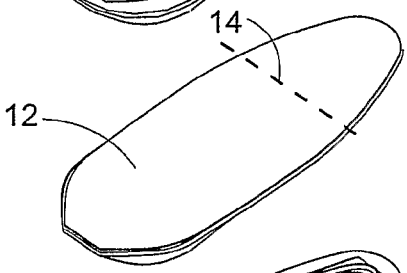
Fig 3
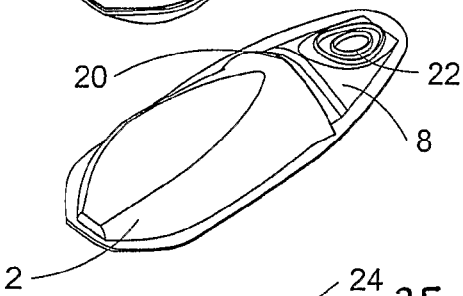
Fig 4
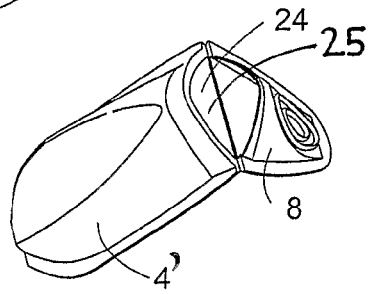
Fig 5

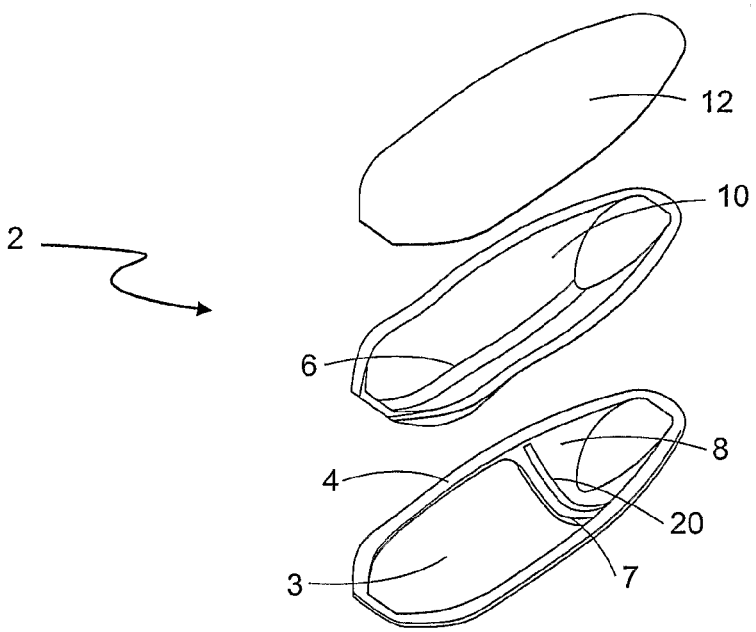
Fig 6a
Fig 6b
Fig 6c
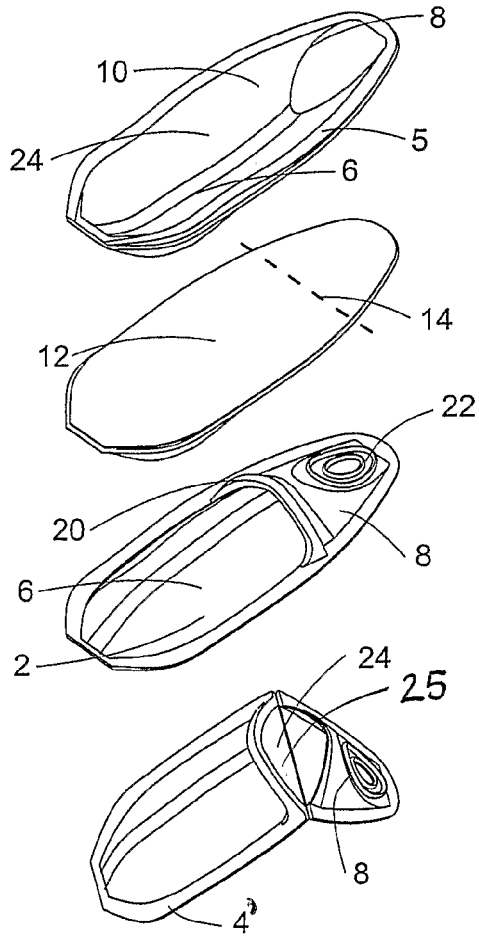
Fig 7
Fig 8
Fig 9
Fig 10

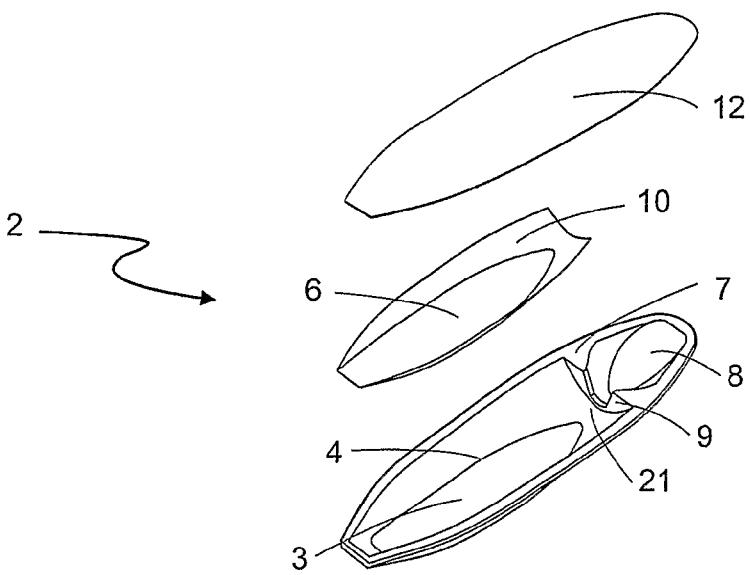
Fig 16a
Fig 16b
Fig 16c
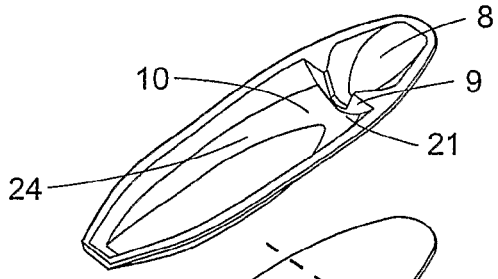
Fig 17
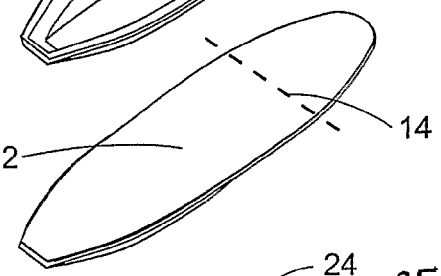
Fig 18
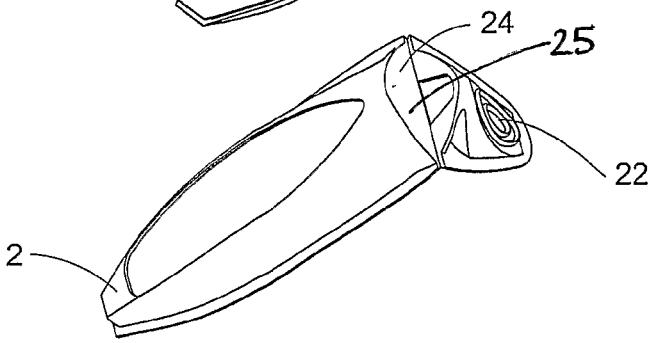
Fig 19

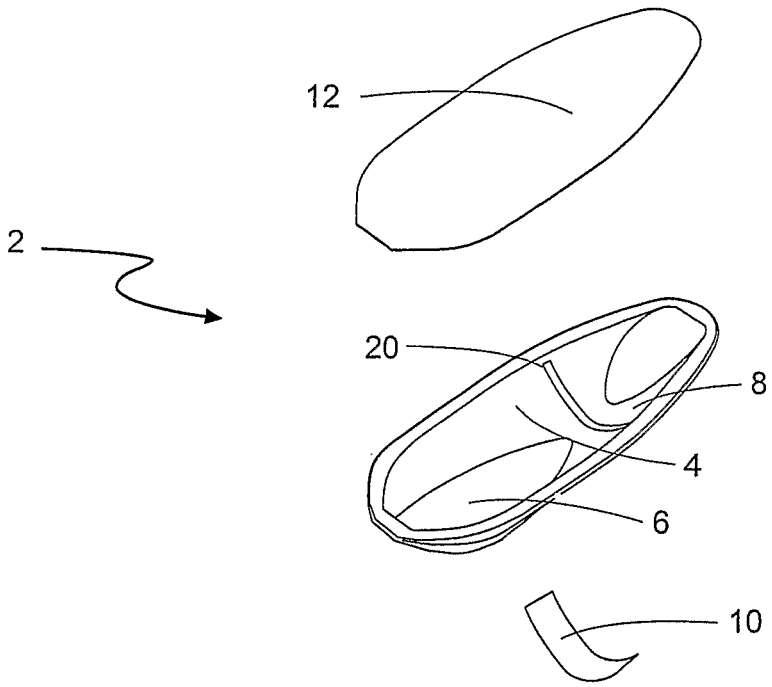
Fig 27a
Fig 27c
Fig 27b
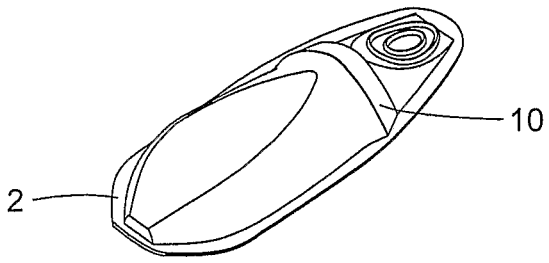
Fig 28

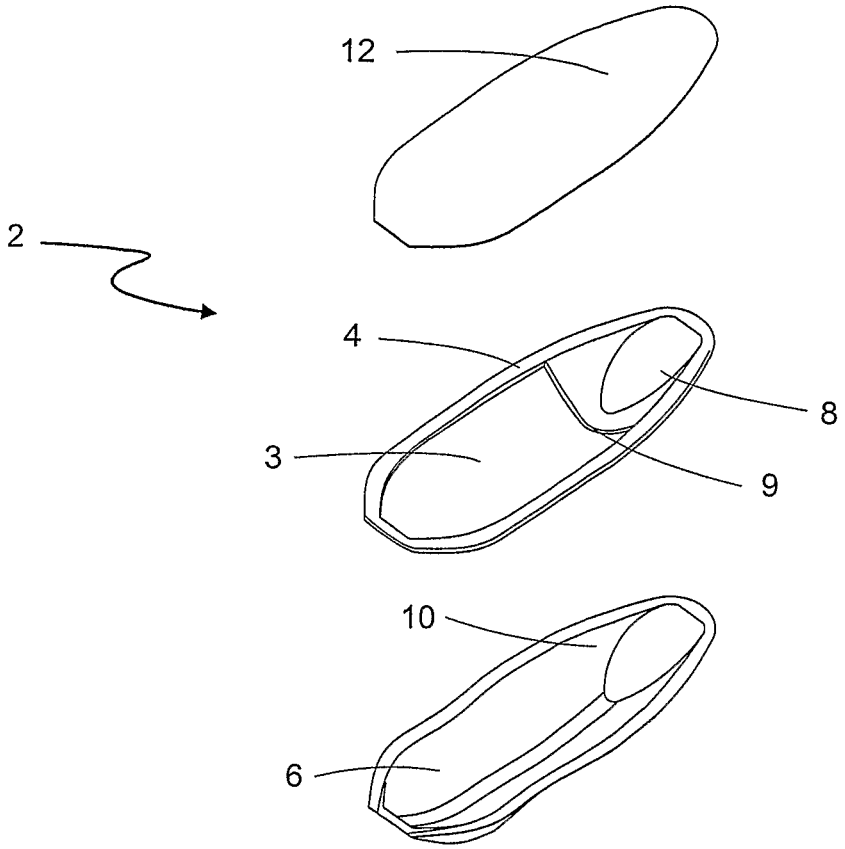
Fig 31a
Fig 31c
Fig 31b
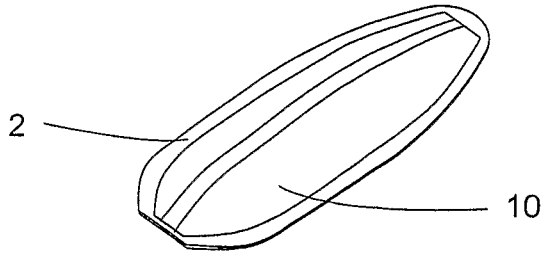
Fig 32

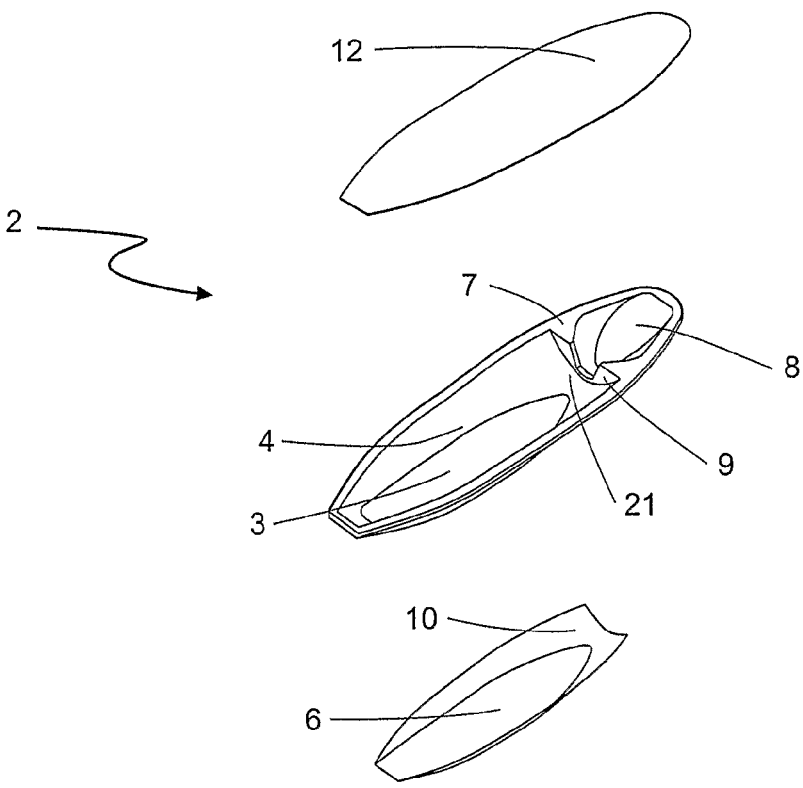
Fig 33a
Fig 33c
Fig 33b
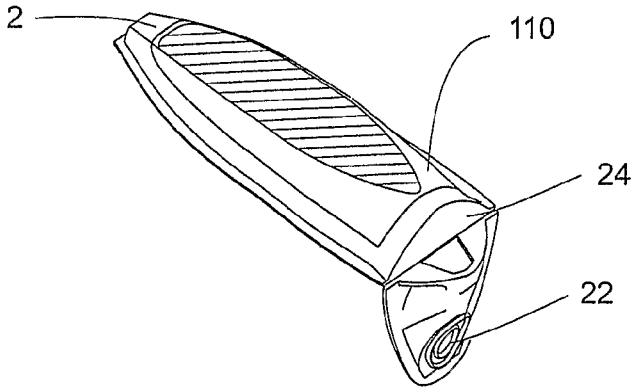
Fig 34

112

102
110
106
108

104
120
103
107
152
108
150

110
105
106
124

154
114
112
122

120
108
106
124

125
102
108
104

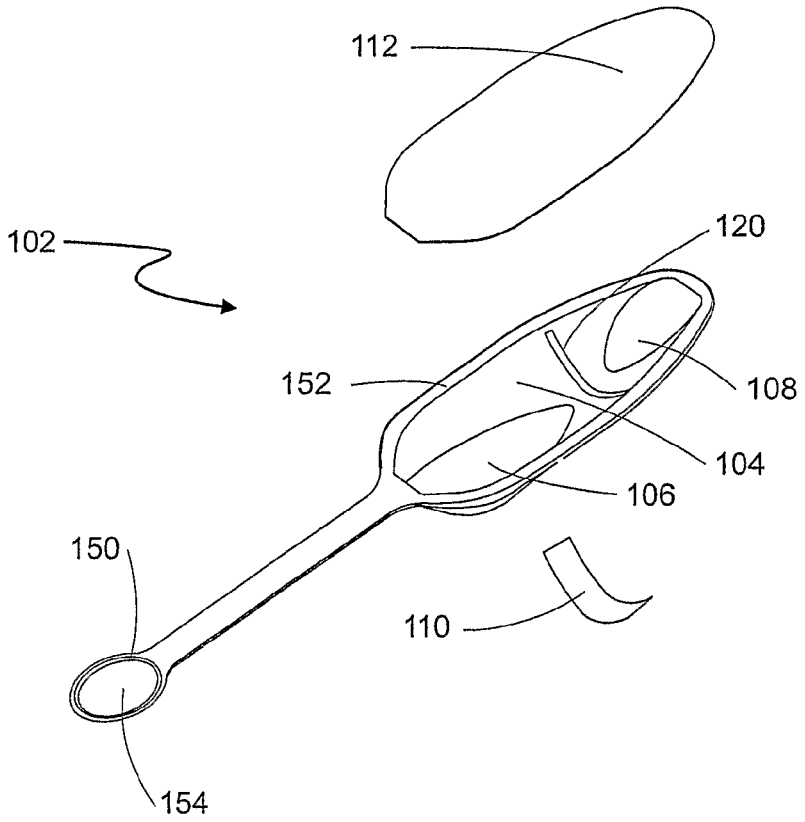
Fig 66a
Fig 66c
Fig 66b
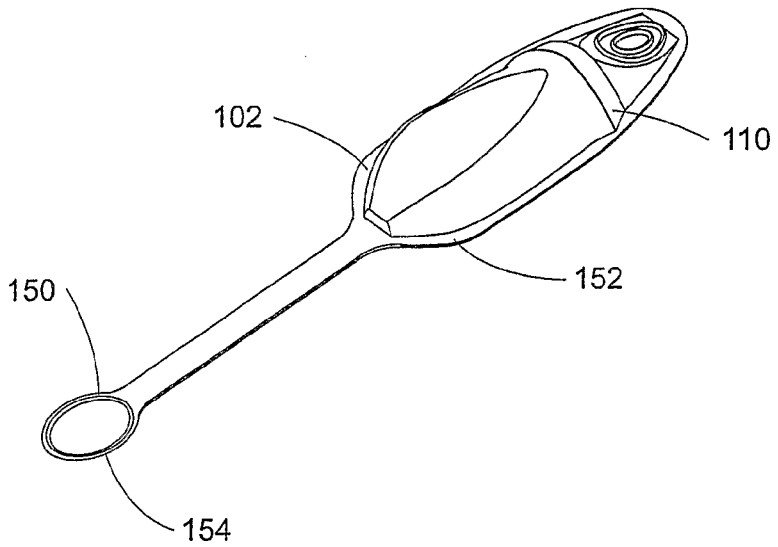
Fig 67

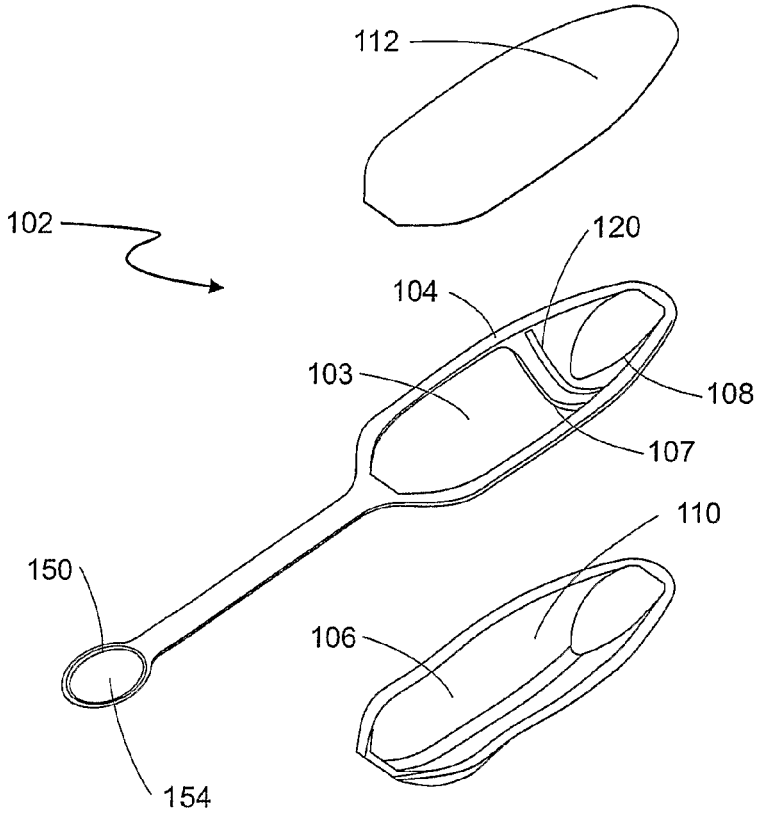
Fig 68a
Fig 68c
Fig 68b
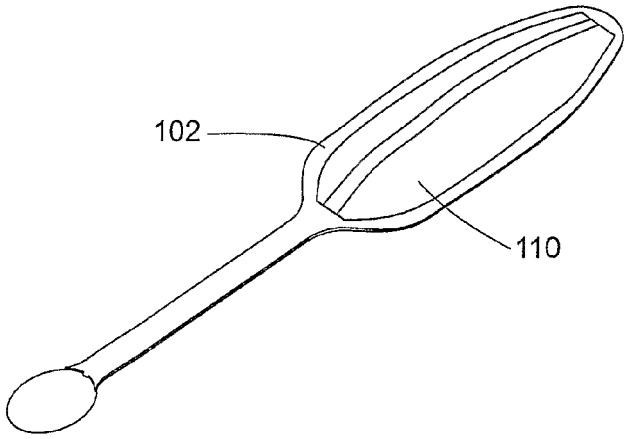
Fig 69

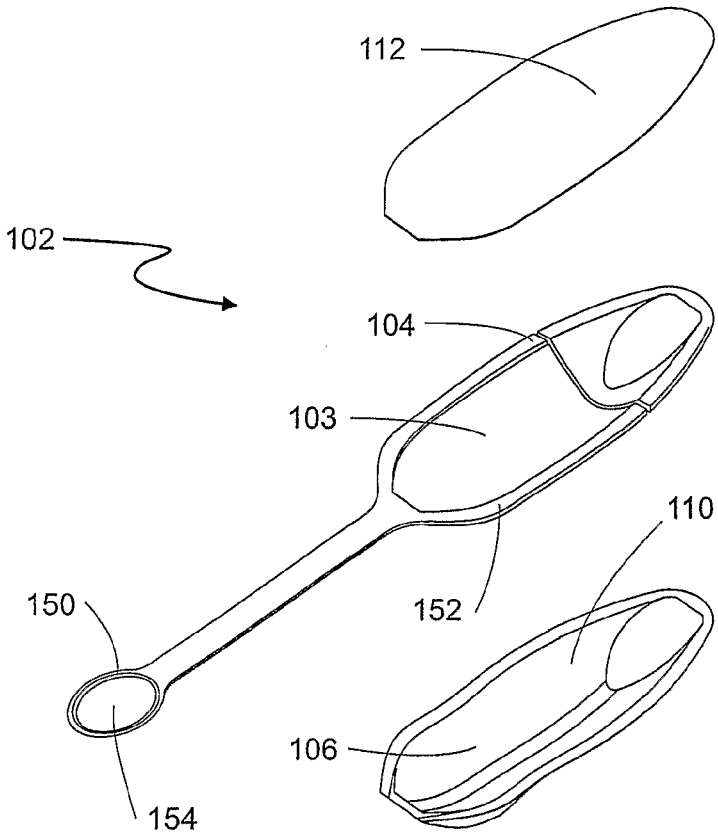
Fig 70a
Fig 70c
Fig 70b
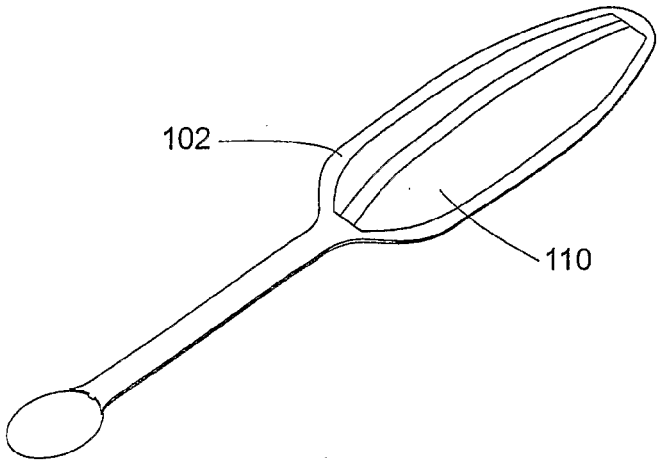
Fig 71

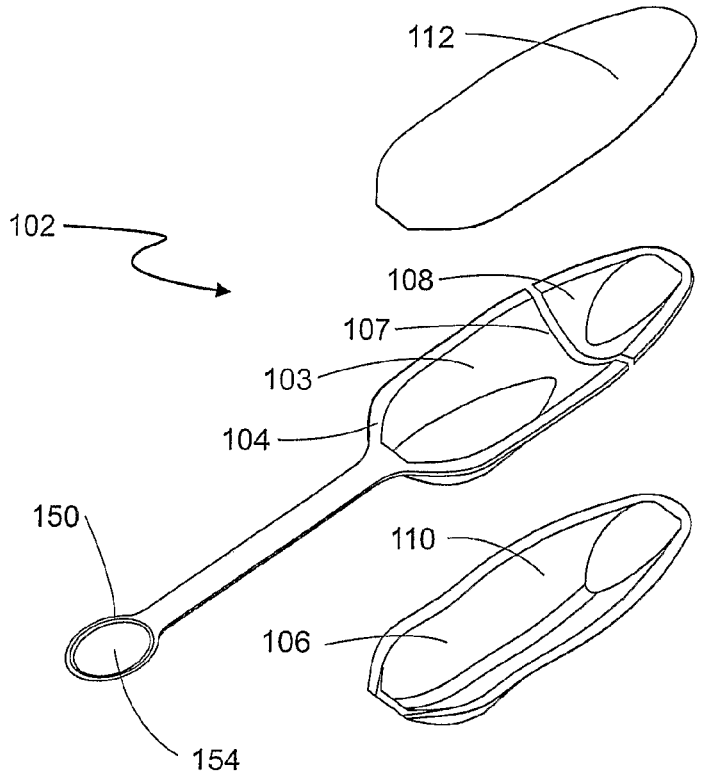
Fig 75a
Fig 75c
Fig 75b
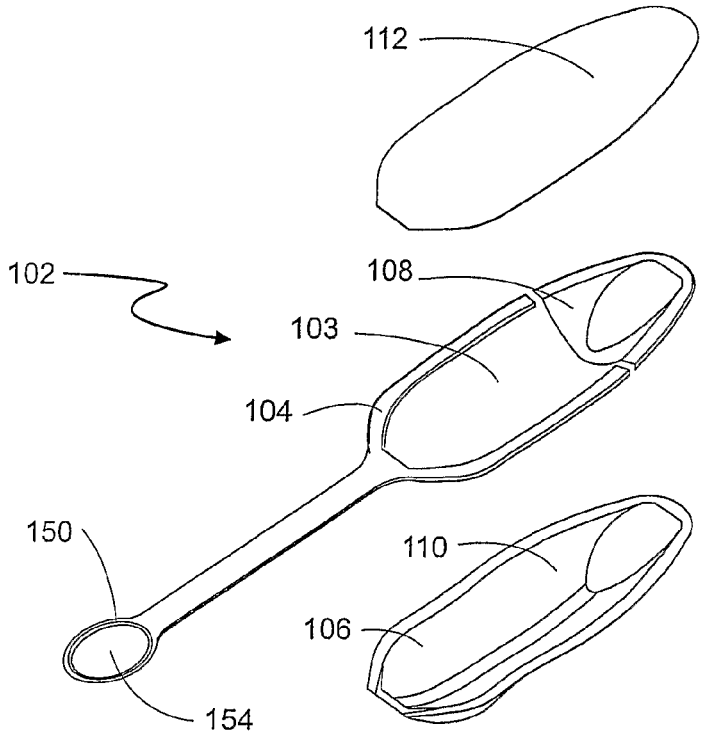
Fig 76a
Fig 76c
Fig 76b

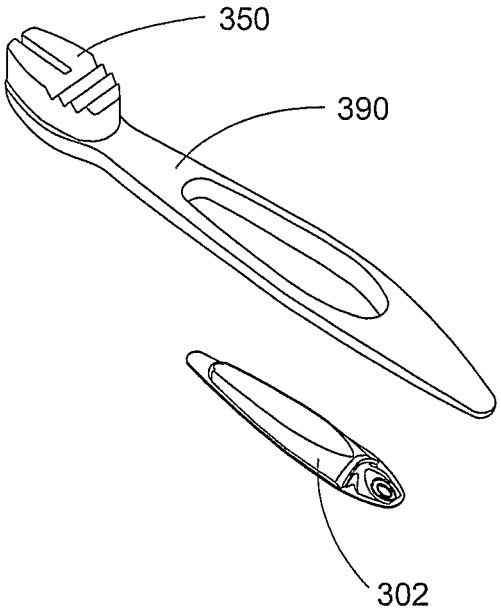
Fig 98a
Fig 98b
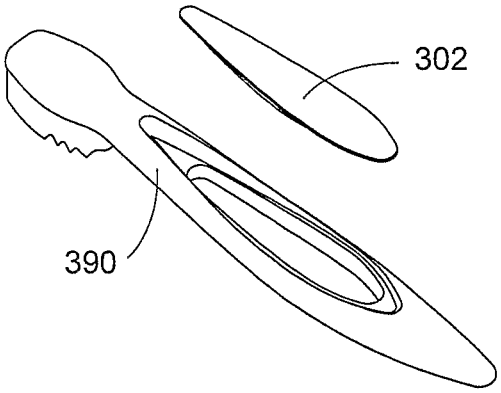
Fig 99a
Fig 99b
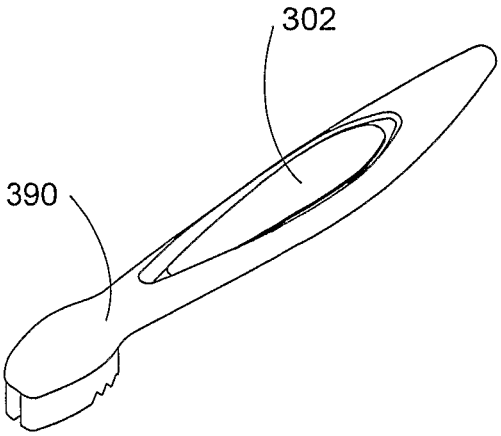
Fig 100

Fig 101
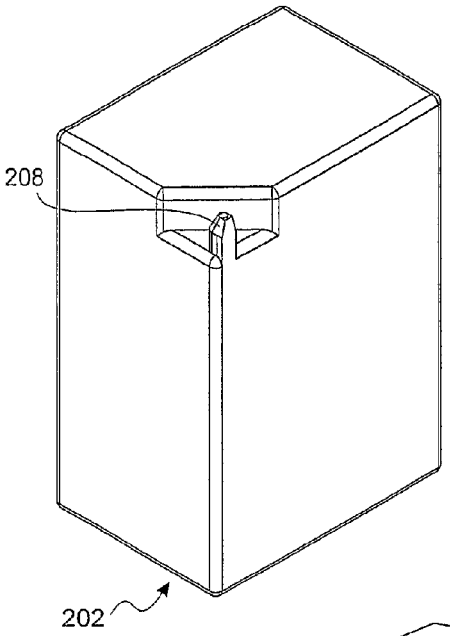
Fig 102
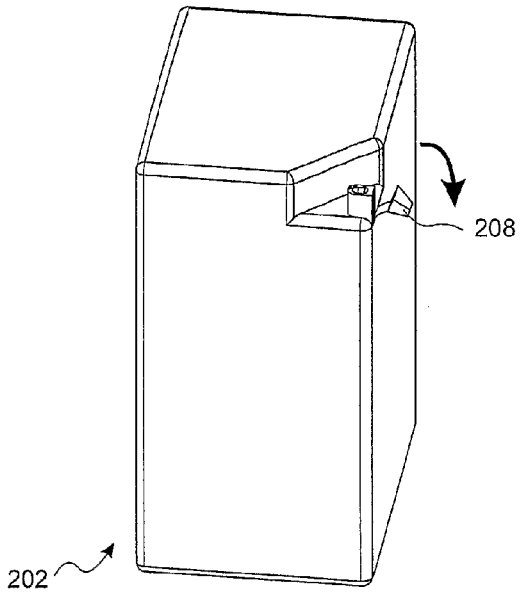
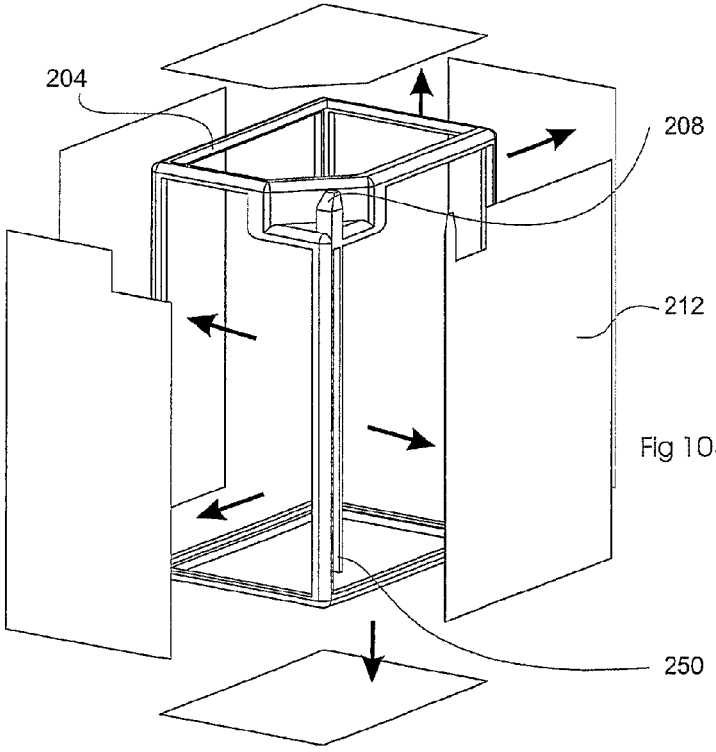
Fig 103

DISPENSING CONTAINER

CROSS-REFERENCE TO RELATED APPLICATIONS

This is a U.S. National Phase of International Application PCT/AU2008/000104, filed Jan. 31, 2008, and claims the benefit of priority under 35 U.S.C. §119 based on Australian Application No. 2007900446, filed Jan. 31, 2007, the entire disclosures of which applications are hereby incorporated herein by reference.

FIELD OF THE INVENTION

The present invention relates generally to containers that can store and dispense contents, and is particularly useful in relation to disposable dispensing utensils for dispensing of a single serve, or a limited number of serves, of contents. It will be convenient to hereinafter describe the invention in relation to that application. It should be appreciated, however, that the present invention is not limited to that application, only.

BACKGROUND OF THE INVENTION

Containers and packaging for storing and dispensing contents of various types are available in a wide range of shapes and sizes, and have a number of different functionalities.

Where it is desirable to provide a single serve, or a limited number of serves, of a product (for example sugar for use by customers being served tea or coffee), or to provide a measured or metered amount of a product (for example a medicament) disposable packaging containers are frequently used. Provision of such limited serve sizes reduces the incidence of spoilage and the incidence of wastage, as each customer takes what is required and it does not become necessary to discard excess unused or spoiled quantities.

In addition to reducing spoilage and waste, provision of single serve (or a limited number of serves) containers also reduces spillage and mess. Sugar dispensed into a coffee from a single serve container is less likely to be spilled and create a mess than sugar served from a bowl. This is very useful where self-serve facilities are provided, for example in workplaces and cafeterias. Such containers are also very useful in take-away situations, where the sugar etc is intended to be used upon arrival at the destination.

It is also desirable to provide a container for dispensing contents which incorporates additional features for enhanced functionality, and such a container, being in the form of a dispensing utensil, is disclosed in WO 2005/065498 (Teys et al), the entire contents of which are incorporated herein by this reference thereto.

The dispensing utensil of Teys et al advantageously dispenses products such as sugar from a spoon shaped container, such that it is not necessary to provide a separate spoon in order to stir tea or coffee. Hence, mess is further reduced, in that separate sugar sachets and stirrers are not required.

The dispensing utensil of Teys et al enables sugar, coffee and a wide range of other contents to be dispensed as required, and ideally the utensil is synergistically paired with its contents such that the sugar is provided in a spoon, or salt/pepper provided in a knife/fork such that both the consumer and the provider (café, hotel, airline etc) obtain maximum convenience and advantage.

Advantageously, it is possible to operate the dispensing utensil of Teys et al with one hand, making it very useful in situations where the cup of tea or coffee must be held with the other hand, for example where coffee has been purchased in a paper cup and consumed while walking or travelling, at functions where limited space is provided to put down a cup and the like. The dispensing utensil's lid may easily be "snapped" open along a score line or failure zone, some or all of the contents dispensed and the lid closed to prevent further dispensing, the dispensing utensil then used to stir the drink, using one hand only.

However, certain sensitive contents such as coffee have been found to deteriorate, having an unacceptably short shelf life, when packaged in a container as disclosed in Teys et al. This is hereafter referred to as the barrier problem. Providing an impermeable material forming an effective barrier to prevent transmission of water vapour, oxygen and other gases is one aspect of the problem. Another aspect of the problem is obtaining a material having appropriate barrier characteristics that also has appropriate fracture or "snapping" properties (fracture characteristics), such that the lid can be "snapped" open and preferably be re-closed. A further aspect of the problem is obtaining a material that allows an appropriate seal (sealing characteristics) with the pliable top wall of Teys et al over the storage cavity. For example, it was discovered that polypropylene with 60% talcum powder provides a utensil with good fracture or "snapping" properties, but must be relatively thick to provide an effective barrier and does not allow for creation of a good seal with the pliable top wall over the storage cavity.

It is therefore desirable to provide an improved dispensing utensil which extends the shelf life of sensitive products by having good barrier properties, has good "snapping" and preferably re-sealing properties and to which the pliable top wall is easily sealed, or any one or combination of these features. It is also desirable to provide an improved dispensing utensil which is economical and efficient to manufacture, and which reduces the overall amount of plastic used in the utensil.

Any discussion of documents, devices, acts or knowledge in this specification is included to explain the context of the invention. It should not be taken as an admission that any of the material formed part of the prior art base or the common general knowledge in the relevant art on or before the priority date of the claims herein.

SUMMARY OF THE INVENTION

A first aspect of the present invention provides a dispensing utensil including a body having:

- a carcass; and
- a pliable top wall and a bottom wall, the walls supported by the carcass, wherein the pliable top wall and bottom wall define a cavity for storing dispensable cavity contents;

the utensil further including:

- a lid connected to the pliable top wall and openable about a hinge formed by the pliable top wall;
- a seal sealing the lid to the body to seal the cavity;
- a tool portion; and
- a handle portion;
- wherein the seal may be broken and the lid opened about the hinge formed by the pliable top wall, thereby allowing the cavity contents to be dispensed.

Preferably:

- a substantial portion of the body is rigid;
- the pliable top wall is flat;
- the carcass and bottom wall define a shell and the flat pliable top wall, carcass and bottom wall define the cavity;
- a substantial portion of the lid is rigid; and
- the seal seals the lid to the shell.

It has also been recognised by the inventor that certain of the features described herein in relation to a dispensing utensil may have application outside the field of dispensing utensils.

While a dispensing utensil is, by its nature, usually elongate and asymmetrical due to having a handle portion and a tool portion, and is usually provided with a lid at one end, some features, particularly of preferred elements of the geometrical arrangement, may also be suited for use in rigid dispensing containers more generally.

Accordingly, a second aspect of the present invention provides a dispensing container including a body, a substantial portion of the body being rigid, the body having:

a carcass; and a flat pliable top wall and a bottom wall, the walls supported by the carcass, wherein the carcass and bottom wall define a shell having an inner surface and wherein the flat pliable top wall, carcass and bottom wall define a cavity for storing dispensable cavity contents;

the container further including:

a lid, a substantial portion of the lid being rigid, the lid connected to the pliable top wall and openable about a hinge formed by the flat pliable top wall; and a seal sealing the lid to the shell to seal the cavity;

wherein the seal may be broken and the lid opened about the hinge formed by the flat pliable top wall, thereby allowing the cavity contents to be dispensed.

In a preferred embodiment of the invention according to the above aspects the hinge is formed by and in the plane of the flat, pliable top wall and the seal sealing the lid to the shell is out of the plane of the top wall.

Preferably, the shell is concave in cross section, having a concave inner surface and a convex outer surface. Preferably, the axis of the hinge is transverse the dispensing utensil or container. Preferably the dispensing utensil or container is elongate, having a longitudinal axis perpendicular to the axis of the hinge.

In one embodiment, the seal is broken by the action of opening lid about the hinge. In an alternative embodiment, the seal may be broken by removing it from the lid or body and the cavity contents subsequently dispensed by opening the lid about the hinge. In alternative embodiments of the invention the bottom wall may be formed separately from the carcass or may be formed integrally with the carcass. In other embodiments, the bottom wall may be formed separately from or integrally with the seal.

In a preferred embodiment, the seal is one of a polymer, foil, film, paper or membrane.

In a preferred embodiment, the lid and bottom wall are positioned adjacently to form a slot therebetween, the seal extending over said slot.

Preferably, the carcass further includes a reinforcing rib adjacent the lid. In one embodiment, the lid and rib are positioned adjacently to form a failure zone (being a slot) therebetween, the seal extending over said slot. In another embodiment, the rib and lid are integrally formed with a failure zone therebetween, the seal extending over said failure zone.

In alternative embodiments of the invention, the lid may be formed separately from or may be formed integrally with the carcass.

In yet other embodiments of the invention, the lid and bottom wall may be integrally formed with a failure zone therebetween, the seal extending over said failure zone.

In one preferred embodiment, the failure zone has one or more pin holes covered by a liquid phase polymer which, when dried, seals the lid to the shell to seal the cavity.

Preferably, the dispensing utensil or container further includes teeth or other protrusions that assist in breaking the seal when the lid is opened about the inge formed by the pliable top wall.

Preferably, the seal breaking or failure mode is selected from one or more of: tearing, piercing, cutting, yielding, peeling, sliding, shearing, de-anchoring. In failure, the seal may slide relative to the lid or the carcass.

In a preferred embodiment, the lid is re-closable after opening, to prevent egress of contents.

In alternative embodiments of the invention, the seal may be affixed to an inner surface of the shell, which may be a concave surface, or may be affixed to an outer surface of the shell, which may be a convex surface. Hence, the seal may be inside the cavity or be external.

In a further alternative embodiment of the invention, the carcass, bottom wall and lid may be molded plastic and the top wall may be a polymer, paper, film, foil, membrane or a laminate of these materials.

In another embodiment, the top wall and the bottom wall may be foil and may be sealed to the carcass by plasma inducted heat sealing.

Preferably, the cavity is watertight or air-impermeable.

In one embodiment, the bottom wall is pliable, thereby enabling a user to squeeze the dispensing container in order to dispense some or all of the cavity contents. In yet a further embodiment, the top wall or bottom wall is transparent.

Preferably, the lid includes a rigid thumb-rest.

In a preferred embodiment, the utensil or container includes a second cavity and a second lid for sealing the second cavity. In alternative embodiments, a third or subsequent cavity and lid may be included.

In one preferred embodiment, the utensil or container further includes a delivery channel for delivery of dispensed contents to a position remote from the lid or the failure zone.

In a preferred embodiment of a container, the container may be a cartridge for insertion into a tool. Preferably the cartridge is rotatable within the tool, having a stowed position and a dispensing position.

A third aspect of the present invention provides a method of manufacturing a dispensing utensil or container including the steps of:

forming a carcass assembly, including a carcass, a bottom wall, a lid and a seal;

filling the carcass assembly with contents to be dispensed; and sealing the carcass assembly with a flat pliable top wall.

Preferably, the step of forming a carcass assembly includes the step of applying the bottom wall to the carcass, and applying the seal to the lid, in a single pass operation. Preferably the carcass assembly is concave in cross section, having a concave inner surface and a convex outer surface.

A fourth aspect of the present invention provides a dispensing container including a body having:

a carcass; and a pliable top wall and a bottom wall, the walls supported by the carcass, wherein the pliable top wall and bottom wall define a cavity for storing dispensable cavity contents;

the container further including:

a lid connected to the pliable top wall and openable about a hinge formed by the pliable top wall; and a seal sealing the lid to the body to seal the cavity;

wherein the seal may be broken by opening the lid about the hinge formed by the pliable top wall, thereby allowing the cavity contents to be dispensed.

The present invention stems from the realisation that plastics of suitable properties for disposable packaging, when used at an economical thickness to form a container such as the dispensing utensil of WO 2005/065498 (Teys et al), are lacking at least one of:

Suitable fracture characteristics

Suitable barrier characteristics

Suitable sealing characteristics

Barrier Characteristics at the Failure Zone

The failure zone of a utensil according to Teys et al provides a point of relative weakness at which the lid may be 'snapped open'. It has been recognised by the inventor of the present application that the barrier problem is particularly acute at the failure zone. The failure zone has less thickness than the adjacent bottom wall and carcass, creating a stress concentration zone, in order that the container will 'snap' open at that point. However, the reduced thickness also reduces the ability of the failure zone to act as a barrier (eg to water vapour, air, oxygen or other substances). Thickening of the failure zone plastic so that the failure zone becomes impermeable to the relevant substance (eg water, vapour, air etc) results in a loss of 'snapability' if the rest of the bottom wall is not also thickened, and the force required to open the lid may then exceed a reasonable level (and consumer acceptance of such a product will be low). Such thickening is also impracticable due to considerations of increased plastic cost and increased weight.

Advantageously the problems of fracture characteristics ('snapability'), sealing characterisics and barrier characteristics are addressed by the present invention, such that a material having suitable sealing characteristics may be used to form the carcass and/or bottom wall of a dispensing utensil, yet provide a good shelf life even for sensitive products and have good 'snapping' characteristics, in that the lid opens cleanly, dispenses cleanly and preferably is re-closable, even when a material having poor fracture characteristics is used. By providing a seal which extends over the failure zone, ie between the lid and the shell of the body, the barrier problem is alleviated in this region.

The present invention is directed to an improved structure, rather than to an improved material. The utensil is easy to use and to manufacture, and has excellent fracture, barrier and sealing characteristics.

In a dispensing utensil such as that disclosed in Teys et al, the utensil (or at least its handle) needs structural rigidity or stiffness in order to function, although one or more walls or surfaces may be flexible or pliable. For example, to stir coffee, an elongate rigid body, being a rigid handle supporting a stirrer (or spoon bowl) is required. This structural rigidity is provided in part by the carcass and bottom wall which define a shell and form part of the concave carcass assembly. The rigidity is re-inforced by provision of the pliable top wall. A manufacturing advantage is obtained through the ability to top-fill the concave carcass assembly.

By providing a stiff or rigid concave carcass assembly dispensing of contents is made easier. Once the lid is opened, the structurally stiff or rigid body may enable the failure zone portion or throat of the body to act as a pouring mouth or nozzle. This allows much neater and more controllable dispensing of contents than can be achieved when compared, for example, to squeezing contents through a torn area in a sachet. To make use of this advantage, the lid must open in a manner that failure occurs in the failure zone (located circumference of the rigid carcass assembly), rather than in the flat pliable top wall. Hence, a thin area or failure zone may be provided in the carcass assembly, and the lid opens around a hinge formed by the pliable top wall, rather than the reverse. Stress is concentrated in the failure zone as leverage is applied to the rigid lever arms, being the utensil body and lid, around the hinge formed by the pliable top wall. The more elongate the dispensing utensil, the more leverage can be applied, due to the increased length of the lever arms. A substantial portion of the utensil body and of the lid is rigid in order to allow the body and the lid to function as lever arms.

If instead, leverage is applied in the opposite direction, attempting to use the carcass assembly or bottom wall as a hinge would require rupture or failure of the pliable top wall and would not enable dispensing in a neat manner. To open the lid in such a manner would also require excessive force and the user would have poor control—spillage of contents would be likely.

Improving Barrier Characteristics

The barrier characteristics of a utensil according to a preferred embodiment of the invention are improved by use of a seal over the failure zone between the lid and container body. Where a particular barrier characteristic is required (for example, water vapour impermeable) a suitable seal may be placed over the failure zone. Where barrier characteristics are an issue not only in the failure zone, but also for the cavity wall generally, the seal may be extended to cover some or all of the cavity wall, improving the overall barrier characteristics. In a particularly preferred embodiment, the bottom wall of the utensil is partially or fully replaced by the seal—hence reducing the amount of plastic used.

In a preferred embodiment the carcass assembly, including the carcass, bottom wall and lid are integrally formed from plastic as a concave shell. Plastic is strong under tension loading, and the snapping of the lid from the body (about the hinge formed by the pliable top wall) causes tensile forces on the outer plastic shell. As the user exerts further force, the plastic yields, snapping open. By concentrating stress in the desired failure zone, through use of thinner material or the like, the user may more easily open the lid as less force will be required. Stress may also be concentrated by use of a 'pin hole', as well as or instead of an area of thinner material or a score line. A pin hole may extend partially or fully through the thickness of the shell.

Stress concentration is particularly important for larger cavities, where heavier or thicker plastic may be required. It is also important when contents are dispensed that a user is able to easily exert sufficient force that the lid opens fully and cleanly, without excessive ragged edges, as such edges can result in poor dispensing characteristics. The ability to concentrate stress in the failure zone is increased by the elongate and stiff or rigid structure of the dispensing utensil. The body and the lid assist in ensuring failure occurs in the failure zone. The body and lid need to act as lever arms. The elongate nature of the utensil also assists the user in bringing sufficient leverage to bear on the failure zone, around the hinge.

To manufacture the above embodiment in which the carcass, bottom wall and lid are integrally formed as a concave plastic shell, having a failure zone (eg a pin hole, which may, or not, extend through the entire thickness of the shell), a seal is applied to the failure zone (either internally or externally of the shell) and the shell top filled with contents. The shell is relatively stiff or rigid—for example it can support its own weight and also that of its contents once filled. The bottom wall is supported or re-inforced by the carcass, but in turn is capable of supporting the carcass. This is due not only to the materials used but also to the geometrical structure of the shell which is elongate and stiff, rather than flexible or pliable. By then applying the flat pliable top wall over the shell, the cavity is sealed and the structural rigidity of the body and lid of the utensil is further increased.

The pliable top wall is a flat sheet which seals to the top edges or lip of the shell and further braces the structure. The flat pliable top wall prevents the concave plastic shell from deforming into a wider but shallower shell. Instead, the shell does not deform, as its top edges or lip are held in fixed relation, and force therefore is concentrated and acts through the failure zone. This effect may also be noted in embodiments of the invention in which elements of the carcass assembly are not integrally formed.

An embodiment of the present invention also usefully provides a failure zone that is a slot or gap rather than a score line or area of thinner material. This allows both for increased ease of manufacture as well as for improved 'snapability' and re-closeability. The clean sides of the slot ensure that ragged edges are not created when the lid is opened, as the seal fails rather than the plastic of the container. The slot acts as a stress concentrator, ensuring that as the lid is opened about its hinge, failure of the seal will occur at the slot.

The seal can be a foil, film, paper or membrane, or a composite of these or other suitable materials such as polymers. In one preferred embodiment, the failure zone or slot is coated with a liquid (preferably a polymer liquid) which dries into a sealing film. In another embodiment, adhesive is used to secure the seal to the lid and, depending on the structure of the utensil, to the bottom wall, a re-inforcing rib or carcass.

A further embodiment provides for a seal to extend over the failure zone or slot, the seal adhered to the lid and bottom wall, re-inforcing rib or carcass by the adhesive, but the adhesive and hence seal failing when the lid is opened, allowing the seal to slide over the lid. Alternatively, a composite seal having a foil or film layer and a membrane serving a similar function to the adhesive is provided.

The seal may be used simply to prevent egress of contents, where it is used over a slot. However, it may also be used to improve barrier characteristics, even where product egress would not have occurred, for example where it is used over a failure zone such as a score line or area of thinner material.

The seal is 'broken' when it loses its function of sealing the cavity, whether that sealing relates to prevention of egress of contents, or to barrier sealing—for example, preventing transmission of water vapour. In other words, use of the words 'sealing the cavity' herein is not limited to mere prevention of egress of contents, but may extend to barrier sealing.

The seal may be pierced, torn or otherwise damaged, or alternatively, the seal may cease to be attached to the lid, peeling off or sliding relative to the lid (or may cease to be attached to the carcass, bottom wall or reinforcing rib, peeling off or sliding relative thereto). A membrane or coating may assist in the sliding action, being placed between the seal and lid, or between the seal and rib, bottom wall or carcass.

The seal may also be used to indicate any product tampering—if a seal has been visibly damaged, a consumer may take note of the tamper evident feature created by the seal. In some embodiments, the seal is removed or peeled off by the consumer, prior to rotating the lid about the hinge. This can be useful with both a weakened failure zone or a slot failure zone version of the invention. The 'snapping open' of the lid also provides a further tamper evident feature, as the failure zone being in a failed state indicates to consumers that the lid has previously been opened.

Improved Geometry and Ease of Manufacture

In a preferred embodiment of the invention, the structure of the utensil is further improved by appropriate geometry. For example, the provision of a reinforcing rib adjacent one or both edges of the failure zone provides further structural rigidity to the dispensing utensil, allowing a user to even more easily exert force on the failure zone. By stiffening areas adjacent the failure zone, the stress concentration factor of the failure zone is increased and hence it is easier for the user to open the lid.

Such reinforcing ribs may also be used to narrow or restrict the throat through which contents are dispensed from the cavity, such that dispensing occurs from a smaller cross-sectional area. This is useful in situations where controlled dispensing of only a portion of the contents is required. Conversely, a wide open throat allows for ease of content flow from the cavity if faster dispensing is desirable for particular contents. A rib may also be used to change the height of the throat, rather than the width of the throat, in order to adjust cross-sectional area.

Preferred embodiments of the invention allow the use of less plastic, and the ability to 'squeeze' the cavity in order to dispense contents, while retaining overall structural rigidity. For example, through use of a 'stiff' carcass with a flexible bottom wall. Other embodiments of the invention enable dispensed contents to be delivered to an appropriate location. For example, toothpaste may be dispensed and delivered onto an integral toothbrush ie the dispensing utensil is a toothbrush with paste.

When manufacturing the utensil, the lid is sealed to the body with a seal, in order to ensure integrity, preferably prior to the cavity being filled with appropriate contents. Advantageously, the cavity to be filled can also be created as a carcass onto which a bottom wall is applied, the bottom wall also acting as the seal. This reduces the amount of plastic required, while requiring little additional time in the manufacturing process. Seal and bottom wall are applied as a single operation, the cavity then top-filled and the cavity sealed with a pliable top wall. As less plastic is required in the walls, the carcass can be manufactured from thicker plastic at an economical cost if desired.

Advantageously, a dispensing utensil according to the present invention enables an extended shelf life for sensitive products such as coffee and medicaments. The present invention therefore provides alternative means for packaging sensitive products in an easy and economical manufacturing process.

The present invention also has numerous manufacture and environmental advantages, both in terms of the manufacturing process and the reduction of plastic used. Hence, even where good barrier characteristics are not required, a dispensing utensil according to the present invention is highly advantageous.

Use of the term 'carcass' herein is to indicate that element of the container which provides a chassis, skeleton or structure upon which other elements of the container are attached or assembled to form the container. Various elements of the container may be formed integral with the carcass, or may be separately manufactured and subsequently attached to the carcass.

Use of the terms 'top' and 'bottom' herein is for the purpose of orienting various elements of the invention relative to each other, and should not be considered to limit the scope of the invention claimed herein. For example, it is envisaged that there will be embodiments of the invention for which in use the 'top pliable wall' forms a bottom or side wall, or indeed an interior wall, while the 'bottom wall' becomes a top wall etc.

BRIEF DESCRIPTION OF THE DRAWINGS

Other features and advantages of one or more preferred embodiments of the present invention will be readily apparent to one of ordinary skill in the art from the following written description with reference to and, used in conjunction with, the accompanying drawings, in which:

FIGS. 1*a* to 1*c* show an exploded top perspective view of a dispensing container according to an embodiment of the present invention, in which FIG. 1*a* shows a pliable top wall, FIG. 1*b* shows a seal and FIG. 1*c* shows a carcass having integral bottom wall and lid;

FIG. 2 shows a top perspective view of the embodiment of FIGS. 1*a* to 1*c*, in which the seal has been assembled with the carcass having integral bottom wall and lid;

FIG. 3 shows a top perspective view of the embodiment of FIGS. 1*a* to 1*c*, in which the pliable top wall has been assembled with the seal and the carcass having integral bottom wall and lid;

FIG. 4 shows a bottom perspective view of the embodiment of FIG. 3;

FIG. 5 shows a bottom perspective view of the embodiment of FIG. 3 in which the lid has been opened;

FIGS. 6*a* to 6*c* show an exploded top perspective view of a dispensing container according to another embodiment of the present invention, in which FIG. 6*a* shows a pliable top wall, FIG. 6*b* shows a seal formed with integral bottom wall and FIG. 6*c* shows a carcass having integral lid;

FIG. 7 shows a top perspective view of the embodiment of FIGS. 6*a* to 6*c*, in which the seal formed with integral bottom wall has been assembled with the carcass having integral lid;

FIG. 8 shows a top perspective view of the embodiment of FIGS. 6*a* to 6*c*, in which the pliable top wall has been assembled with the seal formed with integral bottom wall and the carcass having integral lid;

FIG. 9 shows a bottom perspective view of the embodiment of FIG. 8;

FIG. 10 shows a bottom perspective view of the embodiment of FIG. 8 in which the lid has been opened;

FIGS. 11*a* to 11*c* show an exploded top perspective view of a dispensing container according to another embodiment of the present invention, in which FIG. 11*a* shows a pliable top wall, FIG. 11*b* shows a seal formed with integral bottom wall and FIG. 11*c* shows a carcass having integral lid;

FIGS. 16*a* to 16*c* show an exploded bottom perspective view of a dispensing container according to another embodiment of the present invention, in which FIG. 16*a* shows a pliable top wall, FIG. 16*b* shows a seal formed with integral bottom wall and FIG. 16*c* shows a carcass having integral lid;

FIG. 17 shows a bottom perspective view of the embodiment of FIGS. 16*a* to 16*c*, in which the seal formed with integral bottom wall has been assembled with the carcass having integral lid;

FIG. 18 shows a top perspective view of the embodiment of FIGS. 16*a* to 16*c*, in which the pliable top wall has been assembled with the seal formed with integral bottom wall and the carcass having integral lid;

FIG. 19 shows a bottom perspective view of the embodiment of FIG. 17 in which the lid has been opened;

FIGS. 24*a* to 24*c* show an exploded top perspective view of a dispensing container according to an embodiment of the present invention, in which FIG. 24*a* shows a pliable top wall, FIG. 24*b* shows a seal and FIG. 24*c* shows a lid positioned adjacent a carcass having integral bottom wall;

FIGS. 25*a* to 25*c* show an exploded top perspective view of a dispensing container according to another embodiment of the present invention, in which FIG. 25*a* shows a pliable top wall, FIG. 25*b* shows a seal formed with integral bottom wall and FIG. 25*c* shows a lid positioned adjacent a carcass, the carcass having a reinforcing rib;

FIGS. 26*a* to 26*c* show an exploded top perspective view of a dispensing container according to another embodiment of the present invention, in which FIG. 26*a* shows a pliable top wall, FIG. 26*b* shows a seal formed with integral bottom wall and FIG. 26*c* shows a lid positioned adjacent a carcass;

FIGS. 27*a* to 27*c* show an exploded top perspective view of a dispensing container according to an embodiment of the present invention, in which FIG. 27*a* shows a pliable top wall, FIG. 27*b* shows a seal and FIG. 27*c* shows a carcass having integral bottom wall and lid;

FIG. 28 shows a bottom perspective view of the embodiment of FIGS. 27*a* to 27*c;*

FIGS. 29*a* to 29*c* show an exploded top perspective view of a dispensing container according to another embodiment of the present invention, in which FIG. 29*a* shows a pliable top wall, FIG. 29*b* shows a seal formed with integral bottom wall and FIG. 29*c* shows a carcass having integral lid;

FIGS. 31*a* to 31*c* show an exploded top perspective view of a dispensing container according to another embodiment of the present invention, in which FIG. 31*a* shows a pliable top wall, FIG. 31*b* shows a seal formed with integral bottom wall and FIG. 31*c* shows a carcass having integral lid;

FIG. 32 shows a bottom perspective view of the embodiment of FIGS. 31*a* to 31*c;*

FIGS. 33*a* to 33*c* show an exploded bottom perspective view of a dispensing container according to another embodiment of the present invention, in which FIG. 33*a* shows a pliable top wall, FIG. 33*b* shows a seal formed with integral bottom wall and FIG. 33*c* shows a carcass having integral lid;

FIG. 34 shows a bottom perspective view of the embodiment of FIGS. 33*a* to 33*c* in which the lid has been opened;

FIGS. 35*a* to 35*c* show an exploded top perspective view of a dispensing container according to an embodiment of the present invention, in which FIG. 35*a* shows a pliable top wall, FIG. 35*b* shows a seal and FIG. 35*c* shows a lid positioned adjacent a carcass having integral bottom wall;

FIGS. 36*a* to 36*c* show an exploded top perspective view of a dispensing container according to another embodiment of the present invention, in which FIG. 36*a* shows a pliable top wall, FIG. 36*b* shows a seal formed with integral bottom wall and FIG. 36*c* shows a lid positioned adjacent a carcass, the carcass having a reinforcing rib;

FIGS. 37*a* to 37*c* show an exploded top perspective view of a dispensing container according to another embodiment of the present invention, in which FIG. 37*a* shows a pliable top wall, FIG. 37*b* shows a seal formed with integral bottom wall and FIG. 37*c* shows a lid positioned adjacent a carcass;

FIGS. 40*a* to 40*c* show an exploded top perspective view of a dispensing utensil according to an embodiment of the present invention, in which FIG. 40*a* shows a pliable top wall, FIG. 40*b* shows a seal and FIG. 40*c* shows a carcass having integral bottom wall and lid;

FIG. 41 shows a top perspective view of the embodiment of FIGS. 40*a* to 40*c*, in which the seal has been assembled with the carcass having integral bottom wall and lid;

FIG. 42 shows a top perspective view of the embodiment of FIGS. 40*a* to 40*c*, in which the pliable top wall has been assembled with the seal and the carcass having integral bottom wall and lid;

FIG. 43 shows a bottom perspective view of the embodiment of FIG. 42;

FIG. 44 shows a bottom perspective view of the embodiment of FIG. 42 in which the lid has been opened;

FIGS. 45*a* to 45*c* show an exploded top perspective view of a dispensing utensil according to another embodiment of the present invention, in which FIG. 45*a* shows a pliable top wall, FIG. 45*b* shows a seal formed with integral bottom wall and FIG. 45*c* shows a carcass having integral lid;

FIG. 46 shows a top perspective view of the embodiment of FIGS. 45*a* to 45*c*, in which the seal formed with integral bottom wall has been assembled with the carcass having integral lid;

FIG. 47 shows a top perspective view of the embodiment of FIGS. 45*a* to 45*c*, in which the pliable top wall has been assembled with the seal formed with integral bottom wall and the carcass having integral lid;

FIG. 48 shows a bottom perspective view of the embodiment of FIG. 47;

FIG. 49 shows a bottom perspective view of the embodiment of FIG. 47 in which the lid has been opened;

FIGS. 50*a* to 50*c* show an exploded top perspective view of a dispensing utensil according to another embodiment of the present invention, in which FIG. 50*a* shows a pliable top wall, FIG. 50*b* shows a seal formed with integral bottom wall and FIG. 50*c* shows a carcass having integral lid;

FIG. 51 shows a top perspective view of the embodiment of FIGS. 50*a* to 50*c*, in which the seal formed with integral bottom wall has been assembled with the carcass having integral lid;

FIG. 52 shows a top perspective view of the embodiment of FIGS. 50*a* to 50*c*, in which the pliable top wall has been assembled with the seal formed with integral bottom wall and the carcass having integral lid;

FIG. 53 shows a bottom perspective view of the embodiment of FIG. 52;

FIG. 54 shows a bottom perspective view of the embodiment of FIG. 52 in which the lid has been opened;

FIGS. 55*a* to 55*c* show an exploded bottom perspective view of a dispensing utensil according to another embodiment of the present invention, in which FIG. 55*a* shows a pliable top wall, FIG. 55*b* shows a seal formed with integral bottom wall and FIG. 55*c* shows a carcass having integral lid;

FIG. 56 shows a bottom perspective view of the embodiment of FIGS. 55*a* to 55*c*, in which the seal formed with integral bottom wall has been assembled with the carcass having integral lid;

FIG. 57 shows a top perspective view of the embodiment of FIGS. 55*a* to 55*c*, in which the pliable top wall has been assembled with the seal formed with integral bottom wall and the carcass having integral lid;

FIG. 58 shows a bottom perspective view of the embodiment of FIG. 56 in which the lid has been opened;

FIGS. 63*a* to 63*c* show an exploded top perspective view of a dispensing utensil according to an embodiment of the present invention, in which FIG. 63*a* shows a pliable top wall, FIG. 63*b* shows a seal and FIG. 63*c* shows a lid positioned adjacent a carcass having integral bottom wall;

FIGS. 64*a* to 64*c* show an exploded top perspective view of a dispensing utensil according to another embodiment of the present invention, in which FIG. 64*a* shows a pliable top wall, FIG. 64*b* shows a seal formed with integral bottom wall and FIG. 64*c* shows a lid positioned adjacent a carcass, the carcass having a reinforcing rib;

FIGS. 65*a* to 65*c* show an exploded top perspective view of a dispensing utensil according to another embodiment of the present invention, in which FIG. 65*a* shows a pliable top wall, FIG. 65*b* shows a seal formed with integral bottom wall and FIG. 65*c* shows a lid positioned adjacent a carcass;

FIGS. 66*a* to 66*c* show an exploded top perspective view of a dispensing utensil according to an embodiment of the present invention, in which FIG. 66*a* shows a pliable top wall, FIG. 66*b* shows a seal and FIG. 66*c* shows a carcass having integral bottom wall and lid;

FIG. 67 shows a bottom perspective view of the embodiment of FIGS. 66*a* to 66*c;*

FIGS. 68*a* to 68*c* show an exploded top perspective view of a dispensing utensil according to another embodiment of the present invention, in which FIG. 68*a* shows a pliable top wall, FIG. 68*b* shows a seal formed with integral bottom wall and FIG. 68*c* shows a carcass having integral lid;

FIG. 69 shows a bottom perspective view of the embodiment of FIGS. 68*a* to 68*c;*

FIGS. 70*a* to 70*c* show an exploded top perspective view of a dispensing utensil according to another embodiment of the present invention, in which FIG. 70*a* shows a pliable top wall, FIG. 70*b* shows a seal formed with integral bottom wall and FIG. 70*c* shows a carcass having integral lid;

FIG. 71 shows a bottom perspective view of the embodiment of FIGS. 70*a* to 70*c;*

FIGS. 72*a* to 72*c* show an exploded bottom perspective view of a dispensing utensil according to another embodiment of the present invention, in which FIG. 72*a* shows a pliable top wall, FIG. 72*b* shows a seal formed with integral bottom wall and FIG. 72*c* shows a carcass having integral lid;

FIGS. 74*a* to 74*c* show an exploded top perspective view of a dispensing utensil according to an embodiment of the present invention, in which FIG. 74*a* shows a pliable top wall, FIG. 74*b* shows a seal and FIG. 74*c* shows a lid positioned adjacent a carcass having integral bottom wall;

FIGS. 75*a* to 75*c* show an exploded top perspective view of a dispensing utensil according to another embodiment of the present invention, in which FIG. 75*a* shows a pliable top wall, FIG. 75*b* shows a seal formed with integral bottom wall and FIG. 75*c* shows a lid positioned adjacent a carcass, the carcass having a reinforcing rib;

FIGS. 76*a* to 76*c* show an exploded top perspective view of a dispensing utensil according to another embodiment of the present invention, in which FIG. 76*a* shows a pliable top wall, FIG. 76*b* shows a seal formed with integral bottom wall and FIG. 76*c* shows a lid positioned adjacent a carcass;

FIGS. 82*a* to 82*c* show an exploded top perspective view of a dispensing container according to an embodiment of the present invention, in which FIG. 82*a* shows a pliable top wall, FIG. 82*b* shows a seal and FIG. 82*c* shows a carcass having integral bottom wall and lid;

FIGS. 87*a* to 87*c* show an exploded top perspective view of a dispensing utensil according to an embodiment of the present invention, in which FIG. 87*a* shows a pliable top wall, FIG. 87*b* shows a seal and FIG. 87*c* shows a carcass having integral bottom wall and lid;

FIG. 88 shows a top perspective view of the embodiment of FIGS. 87*a* to 87*c*, in which the seal has been assembled with the carcass having integral bottom wall and lid;

FIG. 89 shows a top perspective view of the embodiment of FIGS. 87*a* to 87*c*, in which the pliable top wall has been assembled with the seal and the carcass having integral bottom wall and lid;

FIG. 90 shows a bottom perspective view of the embodiment of FIG. 89;

FIG. 91 shows a bottom perspective view of the embodiment of FIG. 89 in which the lid has been opened;

FIGS. 98*a* to 98*b* show an exploded bottom perspective view of a dispensing container with associated tool, according to an embodiment of the present invention, in which FIG. 98*a* shows a brush and FIG. 98*b* shows a dispensing container cartridge;

FIGS. 99*a* to 99*b* show an exploded top perspective view of a dispensing container with associated tool, of the embodiment of FIGS. 98*a* to 98*b;*

FIG. 100 shows a top perspective view of a dispensing container assembled with associated tool, of the embodiment of FIGS. 98*a* to 98*b;*

FIG. 101 shoes a top perspective view of a dispensing utensil according to a preferred embodiment of the invention;

FIG. 102 shows a top perspective view of the embodiment of FIG. 101, in which the lid is in an open position;

FIG. 103 shows an exploded top perspective view of the embodiment of FIGS. 101 and 102.

DESCRIPTION OF PREFERRED EMBODIMENT

Figure 11A:
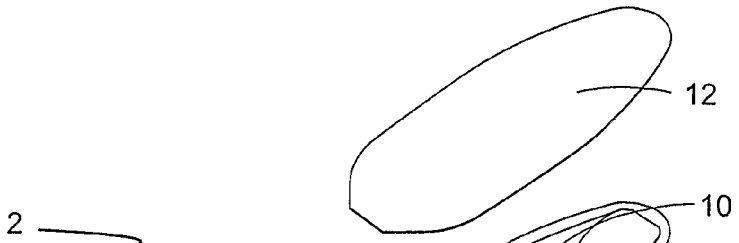
Figure 11B:
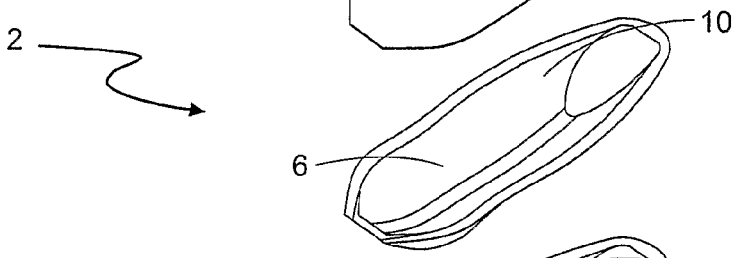
Figure 11C:
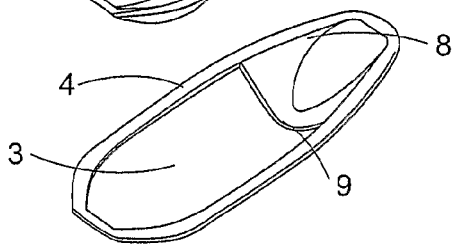

For the sake of clarity, reference numerals are used herein, with like numerals used on various embodiments of the invention to refer to like or comparable features having like or comparable functionality.

A dispensing utensil or container according to a preferred embodiment of the present invention, in its assembled form, includes a body portion, a lid portion and a seal. The body portion has a shell defined by a carcass, and a bottom wall. The body further includes a pliable top wall and the walls are supported by the carcass, and the pliable top wall, carcass and the bottom wall define a cavity for storing dispensable cavity contents. The lid portion is connected to the pliable top wall and openable about a hinge formed by the pliable top wall. The seal seals the lid portion to the body portion or shell and seals the cavity. Opening the lid about the hinge formed by the pliable top wall breaks the seal, thereby allowing the cavity contents to be dispensed.

However, a dispensing utensil or container according to a preferred embodiment of the present invention is more conveniently manufactured as a hollow (preferably elongate and concave) carcass assembly, including the carcass, bottom wall, seal and the lid, which is conveniently filled with contents to be dispensed prior to application of the top wall. Therefore, in use for dispensing contents the dispensing utensil or container has two 'ends', one end being a body and the other a lid. However, in manufacture the dispensing utensil or container has a hollow lower shell or carcass assembly which is filled, then sealed with a top wall. It will be convenient hereinafter to refer to the dispensing container in terms of the various steps and sub-assemblies created during its manufacture.

A preferred embodiment of the present invention is shown in FIGS. 1*a* to 5. A dispensing container 2 is shown in exploded perspective view in FIGS. 1*a* to 1*c*. FIG. 1*a* shows a pliable top wall 12, FIG. 1*b* shows a seal 10 and FIG. 1*c* shows a carcass 4 having integral bottom wall 6 and integral lid 8. Bottom wall 6 is adjacent lid 8 to form a slot 20 therebetween. FIG. 2 shows the seal 10 assembled in position, sealing the lid 8 to the bottom wall 6, the seal 10 extending over the slot 20.

The hollow or concave carcass assembly 5 including carcass 4, bottom wall 6, lid 8 and seal 10 forms cavity 24. Cavity 24 is filled with contents (to be dispensed in use) and the flat pliable top wall 12 is then sealed to carcass 4 and lid 8, as shown in FIG. 3. FIG. 4 shows a bottom view of the container 2, in which the underside of slot 20 may be seen, as well as thumb-rest 22 on lid 8.

The contents may be dispensed by application of force to the thumb-rest 22 on lid 8, opening the lid 8 about a hinge 14 formed by the pliable top wall 12, thereby breaking the seal 10 at the comparatively weaker and stress concentrating point, slot 20. The slot 20 and seal 10 are located remote from the axis of the hinge 14, with the seal/slot 10, 20 being on one side of the cavity 24 and the top wall 12 forming hinge 14 being on the other side. Contents may be dispensed or poured from cavity 24 via throat 25, which functions as a pouring mouth or nozzle.

A bottom perspective view of a dispensing container in the opened position is shown in FIG. 5 (seal 10 not shown, for clarity). In the embodiment shown in FIGS. 1*a* to 5, the carcass assembly 5 has been broken into two pieces, with the integral lid 8 being snapped off from the carcass 4, but retained on the carcass 4 by the hinged connection of pliable top wall 12.

The two pieces of carcass assembly 5 as shown in FIG. 5 are a body 4' consisting of carcass 4, bottom wall 6 and top wall 12, and a lid 8 retained on the body 4' by top wall 12. The carcass 4 and bottom wall 6 define a shell having an inner surface which is also the inner surface of cavity 24. The seal 10 is affixed to the inner surface of the shell, which in this embodiment is the inner surface of the carcass 4. The axis of the hinge 14 is transverse the dispensing container 2. The container 2 is elongate, having a longitudinal axis perpendicular to the axis of the hinge 14.

The hinge 14 is formed by and in the plane of the flat, pliable top wall 12 and the seal 10 sealing the lid 8 to the carcass 4 (being part of the shell) is out of the plane of the top wall 12.

The shell is elongate and substantially concave in cross section, having a substantially concave inner surface and a substantially convex outer surface. In the embodiment shown, the bottom wall 6 is flat but the container forms a hollow into which contents may be placed, prior to affixing the top wall 12 to create cavity 24.

A substantial portion of the lid 8 is rigid and a substantial portion of the body 4' is rigid, allowing the lid 8 and body 4' to be used as lever arms to open the dispensing container 2 about hinge 14. This rigidity is achieved in part by the rigidity of the carcass 4 and in part by the structure of the body 4', in which the carcass 4 has been braced by the bottom wall 6 and top wall 12. The rigidity of the body 4' also assists with ease of dispensing contents from cavity 24 via throat 25, as throat 25 maintains an open cross-sectional area for pouring.

Preferably, the pliable top wall 12 and seal 10 are multilayer foils and the carcass 4 with integral bottom wall 6 and integral lid 8 is plastic. The foil is adhered to the plastic using a heat welding process. Top wall 12 and bottom wall 6 define a cavity 24 in which contents are stored. The seal 10 seals lid 8 to the bottom wall 6, thereby sealing the cavity 24.

In manufacture, the carcass 4 and lid 8 are integrally formed by a suitable moulding technique. The seal 10 is then positioned over slot 20 and affixed to the carcass 4 in a single pass operation. Cavity 24 is then top-filled with contents. The ability to top-fill the cavity is particularly advantageous, as it is both faster and easier, and therefore cheaper, than end-filling techniques. The pliable top wall 12 may then be applied in a single pass operation and heat welded to the carcass assembly 5, forming a sealed container. The seal 10 and pliable top wall 12 may be selected to suit the contents, for example, to have suitable barrier properties such as being water vapour impermeable for coffee granules.

The seal may be used simply to prevent egress of contents, where it is used over a slot. However, it may also be used to improve barrier characteristics, even where product egress would not have occurred, for example where it is used over a failure zone such as a score line or area of thinner material.

In this and other embodiments of the invention, the seal is 'broken' when it loses its function of sealing the cavity, whether that sealing relates to prevention of egress of contents, or to barrier sealing—for example, preventing transmission of water vapour. In other words, use of the words 'sealing the cavity' herein is not limited to mere prevention of egress of contents.

The seal 10 may be pierced, torn or otherwise damaged, or alternatively, the seal 10 may cease to be attached to the lid 8, peeling off or sliding relative to the lid 8 (or in other embodiments may cease to be attached to the carcass 4, bottom wall 6 or reinforcing rib 7, peeling off or sliding relative thereto). A membrane or coating may assist in the sliding action, being placed between the seal 10 and lid 8, or between the seal 10 and rib 7, bottom wall 6 or carcass 4.

The seal 10 and pliable top wall 12 may be a polymer, foil, film, paper or membrane, or a composite of these or other suitable materials. In one preferred embodiment, the slot 20 (or failure zone) is coated with a liquid (preferably a liquid phase polymer) which dries into a sealing film. In another embodiment, adhesive is used to secure the seal 10 to the lid 8 and/or the bottom wall 6. In a preferred embodiment, the adhesive (and hence seal 10) fails when the lid 8 is opened, allowing the seal 10 to slide over the lid 8 or bottom wall 6. Alternatively, a composite seal having a foil or film layer and a membrane serving a similar function to the adhesive may be provided.

The hinged connection of pliable top wall 12 is advantageous in that the lid 8 may be re-closable, depending on the configuration of lid 8 and carcass 4. Further, the potential for littering is reduced, as the lid 8 will not go astray.

In another embodiment (not shown), the carcass assembly 5 is not broken into two pieces when the lid 8 is opened, but rather the carcass assembly 5 yields such that the lid 8 is openable about hinge 14 formed by the pliable top wall 12, thereby breaking or snapping open the seal 10. In yet further embodiments as shown in FIGS. 24*a* to 26*c*, the carcass assembly 5 is originally composed of separate parts—carcass 4 and lid 8, which are assembled and joined together by seal 10 and by pliable top wall 12 such that the lid 8 is openable about hinge 14 formed by the pliable top wall 12, thereby breaking the seal 10. These constructions allow for alternative carcass materials to be used, as the "snapability" of a material does not affect the operation of the container.

Another preferred embodiment of the present invention is shown in FIGS. 6*a* to 10. A dispensing container 2 is shown in exploded perspective view in FIGS. 6*a* to 6*c*. FIG. 6*a* shows a pliable top wall 12, FIG. 6*b* shows a seal 10 having integral bottom wall 6 and FIG. 6*c* shows a carcass 4 having integral lid 8 and integral reinforcing rib 7.

Reinforcing rib 7 is adjacent lid 8 to form a slot 20 therebetween. FIG. 7 shows the seal 10 having integral bottom wall 6 assembled in position, sealing the lid 8 to the integral reinforcing rib 7, the seal 10 extending over the slot 20. The bottom wall 6 extends over carcass void 3 and is sealed to carcass 4 as a part of carcass assembly 5.

The carcass assembly 5, including carcass 4, bottom wall 6, lid 8 and seal 10, forms cavity 24. Cavity 24 is filled with contents (to be dispensed in use) and the pliable top wall 12 is then sealed to carcass 4 and lid 8, as shown in FIG. 8. FIG. 9 shows a bottom view of the container 2, in which the underside of slot 20 may be seen, as well as thumb-rest 22 on lid 8.

The contents may be dispensed by application of force to the thumb-rest 22 on lid 8, opening the lid 8 about a hinge 14 formed by the pliable top wall 12, thereby breaking the seal 10 at the comparatively weaker and stress concentrating point, slot 20. Contents are dispensed from cavity 24 via throat 25. A bottom perspective view of a dispensing container in the opened position is shown in FIG. 10 (seal 10 not shown, for clarity).

In manufacture, the carcass 4 and lid 8 are integrally formed by a suitable moulding technique. The seal 10 having integral bottom wall 6 is then positioned over slot 20 and the void 3 in carcass 4 and affixed to the carcass 4 in a single pass operation. Cavity 24 is then top-filled with contents. The pliable top wall 12 may then be applied in a single pass operation and heat welded to the carcass assembly 5, forming a sealed container.

In another embodiment (not shown), the carcass assembly 5 is not broken into two pieces when the lid 8 is opened, but rather the carcass assembly 5 yields such that the lid 8 is openable about hinge 14 formed by the pliable top wall 12, thereby breaking or snapping open the seal 10.

In another embodiment (not shown), the seal 10 and bottom wall 6 are separate items, the seal 10 being affixed to the lid 8 and reinforcing rib 7, and the bottom wall 6 being affixed to the carcass 4 and reinforcing rib 7. This may be useful, for example, where it is desirable to have a seal 10 with good yield properties, but a tougher bottom wall 6, such that it does not yield in handling and transport, prior to use. Bottom wall 6 has a greater surface area than seal 10 and is more likely to suffer damage. Preferably, in manufacture, seal 10 and bottom wall 6 are applied in a single pass operation.

Another preferred embodiment of the present invention is shown in FIGS. 11*a* to 15. A dispensing container 2 is shown in exploded perspective view in FIGS. 11*a* to 11*c*. FIG. 11*a* shows a pliable top wall 12, FIG. 11*b* shows a seal 10 (having integral bottom wall 6) and FIG. 11*c* shows a carcass 4 having integral lid 8 but not having an integral reinforcing rib (unlike FIG. 6*c*). Hence, no slot is formed. Rather, lid edge 9 is immediately adjacent bottom wall 6.

Figure 12:
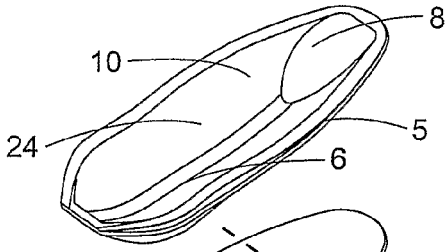
FIG. 12 shows a top perspective view of the embodiment of FIGS. 11*a* to 11*c*, in which the seal formed with integral bottom wall has been assembled with the carcass having integral lid.

FIG. 12 shows the seal 10 having integral bottom wall 6 assembled in position, sealing the lid 8 to the carcass 4. Seal 10 extends beyond lid edge 9, covering the inner surface of lid 8. The bottom wall 6 extends over carcass void 3 and is sealed to carcass 4 as a part of carcass assembly 5.

Figure 13:
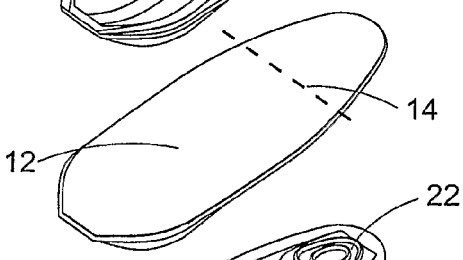
FIG. 13 shows a top perspective view of the embodiment of FIGS. 11*a* to 11*c*, in which the pliable top wall has been assembled with the seal formed with integral bottom wall and the carcass having integral lid.
Figure 14:
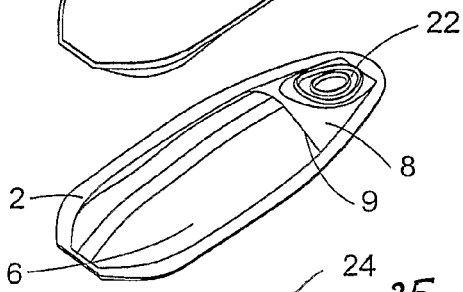
FIG. 14 shows a bottom perspective view of the embodiment of FIG. 13.

The carcass assembly 5, including carcass 4, bottom wall 6, lid 8 and seal 10, forms cavity 24. Cavity 24 is filled with contents (to be dispensed in use via throat 25) and the pliable top wall 12 is then sealed to carcass 4 and lid 8, as shown in FIG. 13. FIG. 14 shows a bottom view of the container 2, in which the underside of lid edge 9 may be seen, as well as thumb-rest 22 on lid 8.

Figure 15:
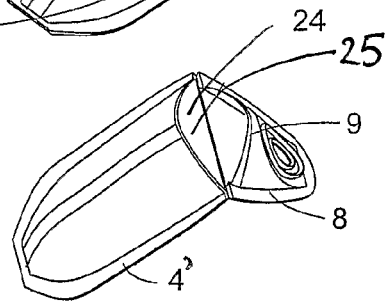
FIG. 15 shows a bottom perspective view of the embodiment of FIG. 13 in which the lid has been opened.

The contents may be dispensed by application of force to the thumb-rest 22 on lid 8, opening the lid 8 about a hinge 14 formed by the pliable top wall 12, thereby breaking the seal 10 at the comparatively weaker and stress concentrating point lid edge 9. Seal 10 having integral bottom wall 6 fails by yielding or tearing in the embodiment shown. A bottom perspective view of the dispensing container 2 in the opened position is shown in FIG. 15 (seal 10 not shown, for clarity).

In an alternative embodiment, not shown, the seal extends just beyond the lid edge, such that upon application of force to the lid, the seal ceases to be attached to the lid, rather than the seal material itself yielding or tearing. Hence, the seal remains attached to the carcass, but there is little excess material to interfere with dispensing of contents.

Another preferred embodiment of the present invention is shown in FIGS. 16*a* to 19. A dispensing container 2 is shown in exploded perspective view in FIGS. 16*a* to 16*c*. FIG. 16*a* shows a pliable top wall 12, FIG. 16*b* shows a seal 10 having integral bottom wall 6 and FIG. 16*c* shows a carcass 4 having integral lid 8. Lid 8 includes reinforcing rib 7.

Reinforcing rib 7 provides structural rigidity in the dispensing container 2, as well as resulting in a comparatively weaker and stress concentrating point at failure zone 21.

FIG. 17 shows the seal 10 (having integral bottom wall 6) assembled in position. The seal 10 extends just beyond failure zone 21, improving barrier characteristics at this point. The seal 10 seals failure zone 21, extending and sealing to lid edge 9. To obtain improved barrier characteristics, seal 10 need extend only fractionally beyond failure zone 21 onto lid edge 9.

The bottom wall 6 extends over carcass void 3 and is sealed to carcass 4 as a part of carcass assembly 5. The carcass assembly 5, including carcass 4, bottom wall 6, lid 8 and seal 10, forms cavity 24. Cavity 24 is filled with contents (to be dispensed in use via throat 25) and the pliable top wall 12 is then sealed to carcass 4 and lid 8, as shown in FIG. 18. The failure zone 21 and seal 10 are located remote from the axis of the hinge 14, with the seal/failure zone 10, 21 being on one side of the cavity 24 and the top wall 12 forming hinge 14 being on the other side.

The contents may be dispensed by application of force to the thumb-rest 22 on lid 8, opening the lid 8 about a hinge 14 formed by the pliable top wall 12, thereby breaking the seal 10 at the failure zone 21. A bottom perspective view of a dispensing container in the opened position is shown in FIG. 19 (seal 10 not shown, for clarity). In alternative embodiments (not shown) the throat 25 may be narrowed by positioning the failure zone 21 on the lid side of rib 7, such that the rib 7 reduces the cross-sectional area of the throat 25. The rib 7 is retained on the body portion of the container (rather than on the lid portion), when the lid is opened. The throat 25 is thereby also further stiffened for pouring.

Figure 20:
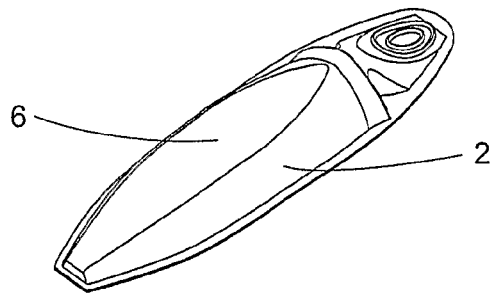
FIG. 20 shows a bottom perspective view of a dispensing container according to another embodiment of the present invention, in which the bottom wall is pliable.
Figure 21:
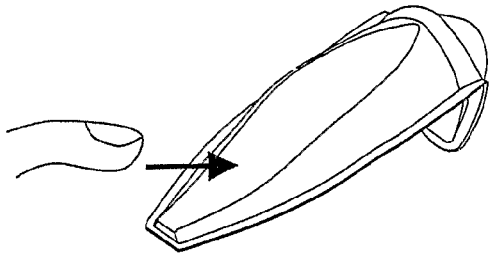
FIG. 21 shows a bottom perspective view of one version of the embodiment of FIG. 20, in which the lid has been opened.

Alternative preferred embodiments of the present invention are shown in FIGS. 20 to 23. FIG. 20 shows a bottom perspective view of a dispensing container 2 in which the bottom wall 6 is pliable or flexible, such that once the container 2 is opened (as shown in FIG. 21), the bottom wall 6 may be pushed or squeezed in order to dispense contents. This is particularly useful where the contents are a viscous liquid, such as sauces, paint, cremes, pastes and the like. The action of pushing on the pliable bottom wall 6 (and pliable top wall if desired) also provides control in the amount of contents dispensed. Where the contents are of a more free-flowing nature, the pliable or flexible bottom wall may also be used to prevent further dispensing, for example, dispensing only half the contents.

The bottom wall 6 may be integral with the carcass 4, or may, for example, be integral with the seal (not shown). Furthermore, the bottom wall 6 may be provided separately from the seal (not shown), in this and other embodiments of the invention.

Figure 22:
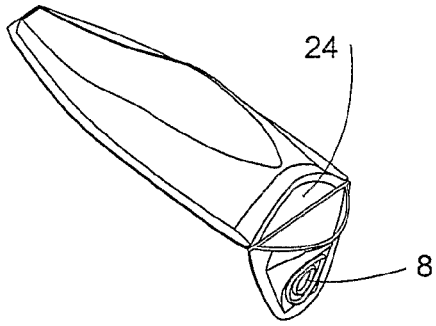
FIG. 22 shows another bottom perspective view of a different version the embodiment of FIG. 20, in which the lid has been opened and is hollow.
Figure 23:
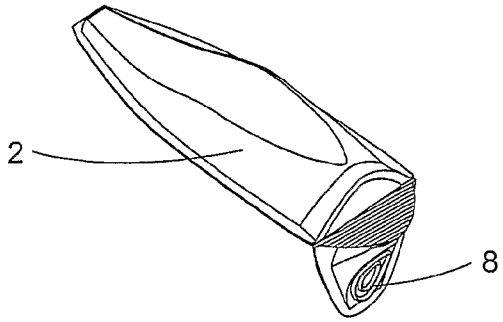
FIG. 23 shows another bottom perspective view of a different version the embodiment of FIG. 20, in which the lid has been opened but is not hollow.
Figure 24A:
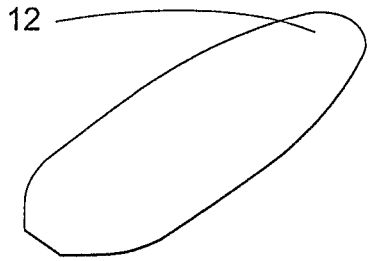
Figure 24B:
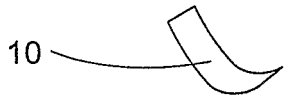
Figure 24C:
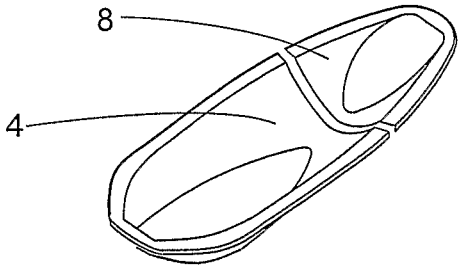
Figure 25A:
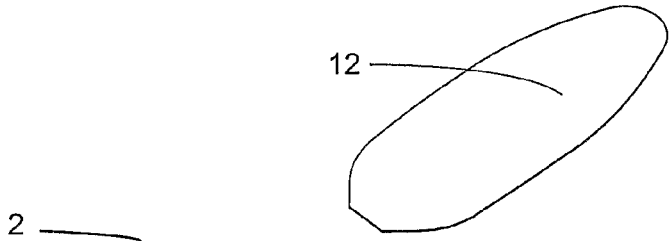
Figure 25B:
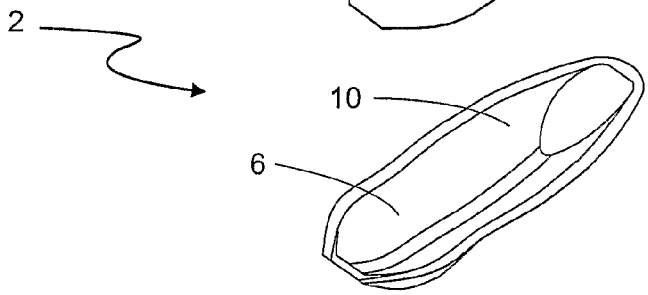
Figure 25C:
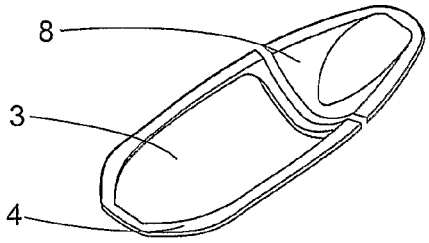
Figure 26A:
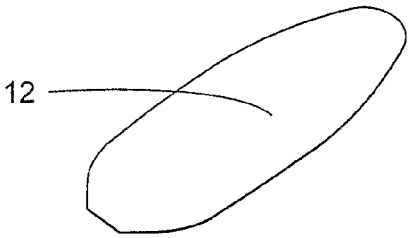
Figure 26B:
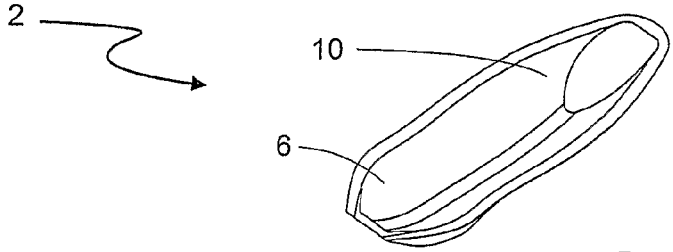
Figure 26C:
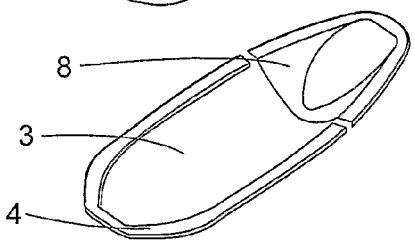

As shown in FIG. 22, the lid 8 may be hollow, or may solid as shown in FIG. 23. A hollow lid may allow for additional contents to be packaged in the cavity 24 during manufacture, as some contents are packed 'in' the lid. The contents may then settle during transport and storage, such that the lid 8 is empty of contents. This may be inappropriate, for example for use with medicaments where strict dosage control is required, and thus a solid or blocked off lid 8 may be provided. Provision of a solid or blocked off lid 8 also provides additional structural rigidity to the container 2, and improved 'snapability', similarly to the provision of a reinforcing rib as discussed in relation to FIG. 17.

In this and other embodiments of the invention, the pliable top wall 12 and the bottom wall 6 may be transparent, or semi-transparent as well as opaque. This allows for precise determination of the amount of contents remaining in the container. Measuring or dosage marks may also be provided.

A preferred embodiment of the present invention is shown in FIGS. 27*a* to 28. A dispensing container 2 is shown in exploded perspective view in FIGS. 27*a* to 27*c*. FIG. 27*a* shows a pliable top wall 12, FIG. 27*b* shows a seal 10 and FIG. 27*c* shows a carcass 4 having integral bottom wall 6 and integral lid 8. Bottom wall 6 is adjacent lid 8 to form a slot 20 therebetween. In this embodiment, seal 10 is applied from below or outside of container 2. FIG. 28 shows the seal 10 assembled in position, sealing the lid 8 to the bottom wall 6, the seal 10 extending over the slot 20.

This allows for flexibility in manufacture. In embodiments where a failure zone is provided rather than a slot 20, the seal may be applied before or after the container is filled and pliable top wall 12 applied.

Applying the seal from below may also assist in causing the seal to break when the lid is opened, as the lid edge will 'push' against the seal and, for example, is less likely to peel away from the lid as may occur where the seal is applied from above (or 'inside' the cavity). If failure due to loss of adhesion is required, applying the seal from above may be appropriate, whereas if failure by tearing or piercing is required, applying the seal from below may be appropriate. However, this will depend on the precise characteristics of the materials involved, and, for example, the rheology of the adhesive, membrane or other 'slipping' substance provided.

Figure 29A:
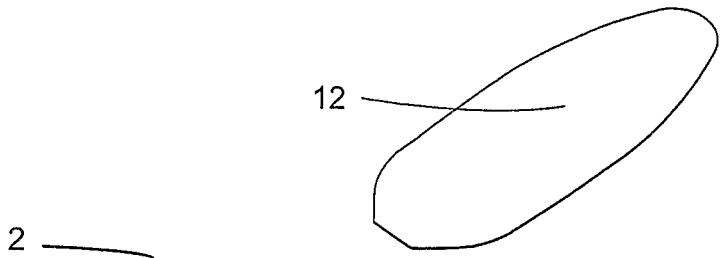
Figure 29C:
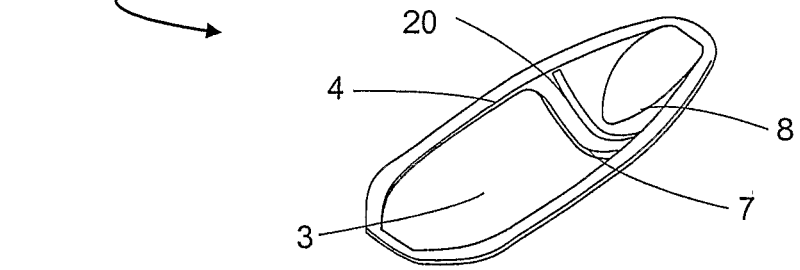
Figure 29B:
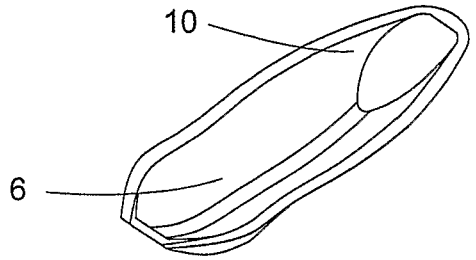
Figure 30:
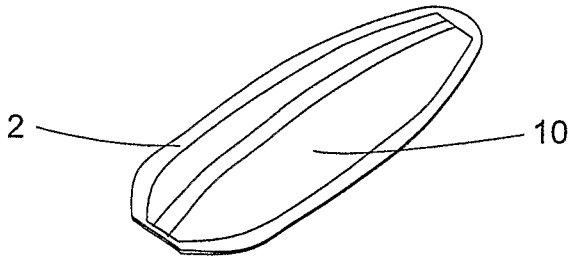
FIG. 30 shows a bottom perspective view of the embodiment of FIGS. 29*a* to 29*c;*
Figure 35A:
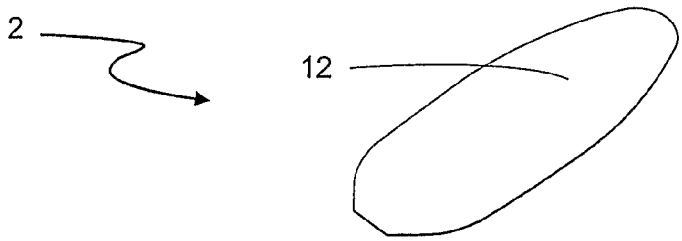
Figure 35C:
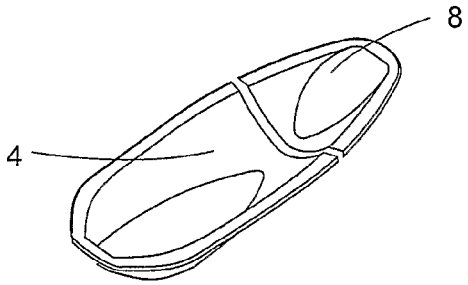
Figure 35B:
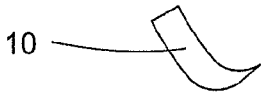
Figure 36A:
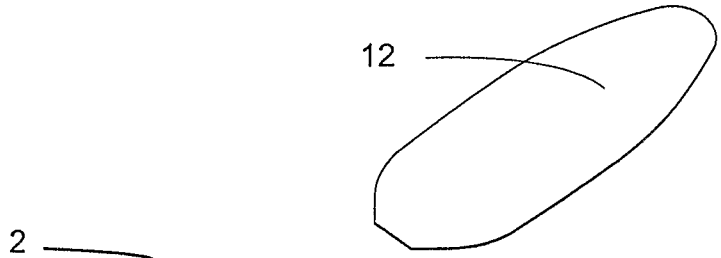
Figure 36C:
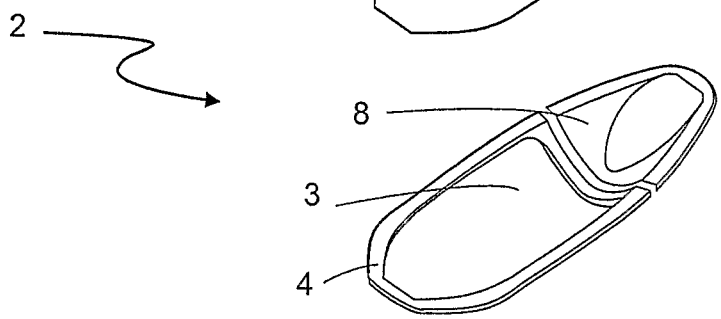
Figure 36B:
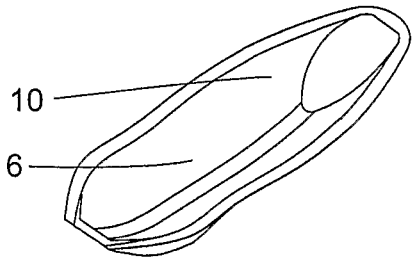
Figure 37A:
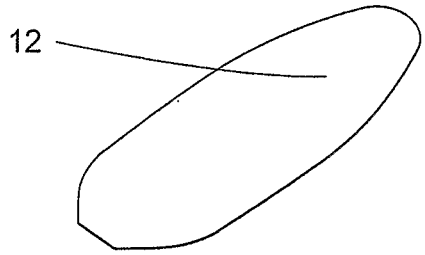
Figure 37C:
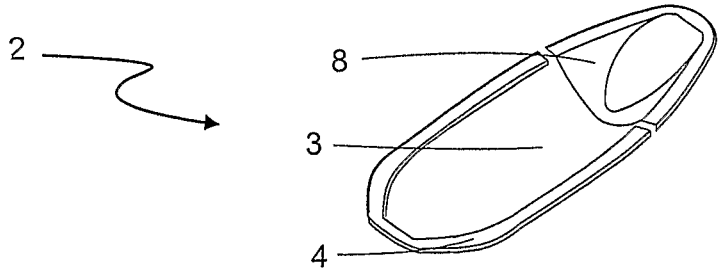
Figure 37B:
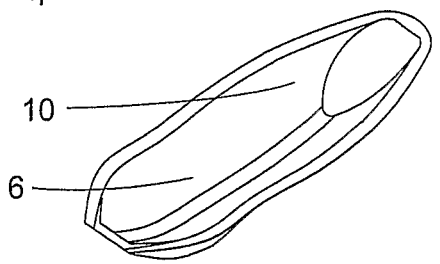

A preferred embodiment of the present invention similar to that of FIG. 28 is shown in FIGS. 29*a* to 30. A dispensing container 2 is shown in exploded perspective view in FIGS. 29*a* to 29*c*. FIG. 29*a* shows a pliable top wall 12, FIG. 29*b* shows a seal 10 having integral bottom wall 6 and FIG. 29*c* shows a carcass 4 having integral lid 8. In this embodiment, seal 10 is applied from below or outside of container 2. FIG. 30 shows the seal 10 assembled in position, sealing the lid 8 to the reinforcing rib 7, the seal 10 extending over the slot 20 and also over void 3 to form bottom wall 6. As with the previous embodiment of the invention, application of the seal from below may have advantages.

Yet another embodiment of the invention in which the seal 10 is applied from below is shown in FIGS. 31*a* to 32. FIG. 31*a* shows a pliable top wall 12, FIG. 31*b* shows a seal 10 (having integral bottom wall 6) and FIG. 31*c* shows a carcass 4 having integral lid 8 but not having an integral reinforcing rib (unlike FIG. 29*c*). Hence, no slot is formed. Rather, lid edge 9 is immediately adjacent bottom wall 6. In this embodiment, seal 10 is applied from below or outside of container 2. FIG. 32 shows the seal 10 assembled in position, sealing the lid 8 to the carcass 4, the seal 10 extending over the void 3 to form bottom wall 6. As with the previous embodiment of the invention, application of the seal from below may have advantages.

FIGS. 33*a* to 37*c* show further embodiments of the invention otherwise corresponding to FIGS. 16*a* to 19 and FIGS. 24*a* to 26*c*, but in which the seal 10 is applied from below. Like numerals reference like features.

Figure 38:
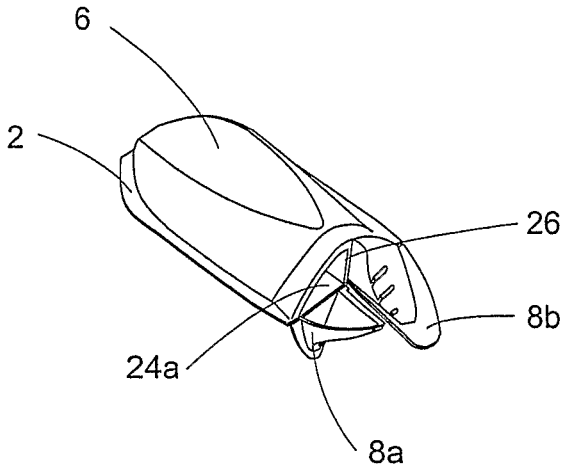
FIG. 38 shows a bottom perspective view of a preferred embodiment of the invention, in which there are two cavities.
Figure 39:
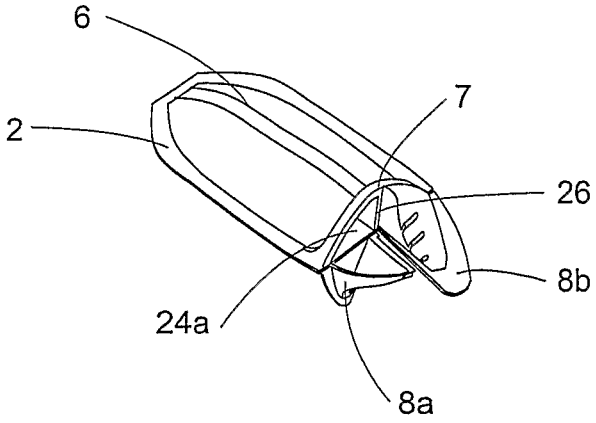
FIG. 39 shows a bottom perspective view of another preferred embodiment of the invention, in which there are two cavities.

In further embodiments of the invention, as shown in FIGS. 38 and 39, cavity 24 may be divided into two sections by dividing wall—24*a* (open to view because lid 8*a* is in the open position) and 24*b* (not open to view, because lid 8*b* is in the closed position). In other embodiments, cavity 24 may be divided into three or more sections. The embodiments of FIGS. 38 and 39 have separate lids for each cavity section, however, a single lid for all sections could also be provided. The provision of multiple cavity sections is useful for example for provision of coffee and sugar, or salt and pepper, or 'two-part' adhesive glues, as it is desirable to provide the contents separately, but the contents may be required to be provided for use at the same time.

Figures 40A, 40B, 40C, 41, 42, 43, 44:
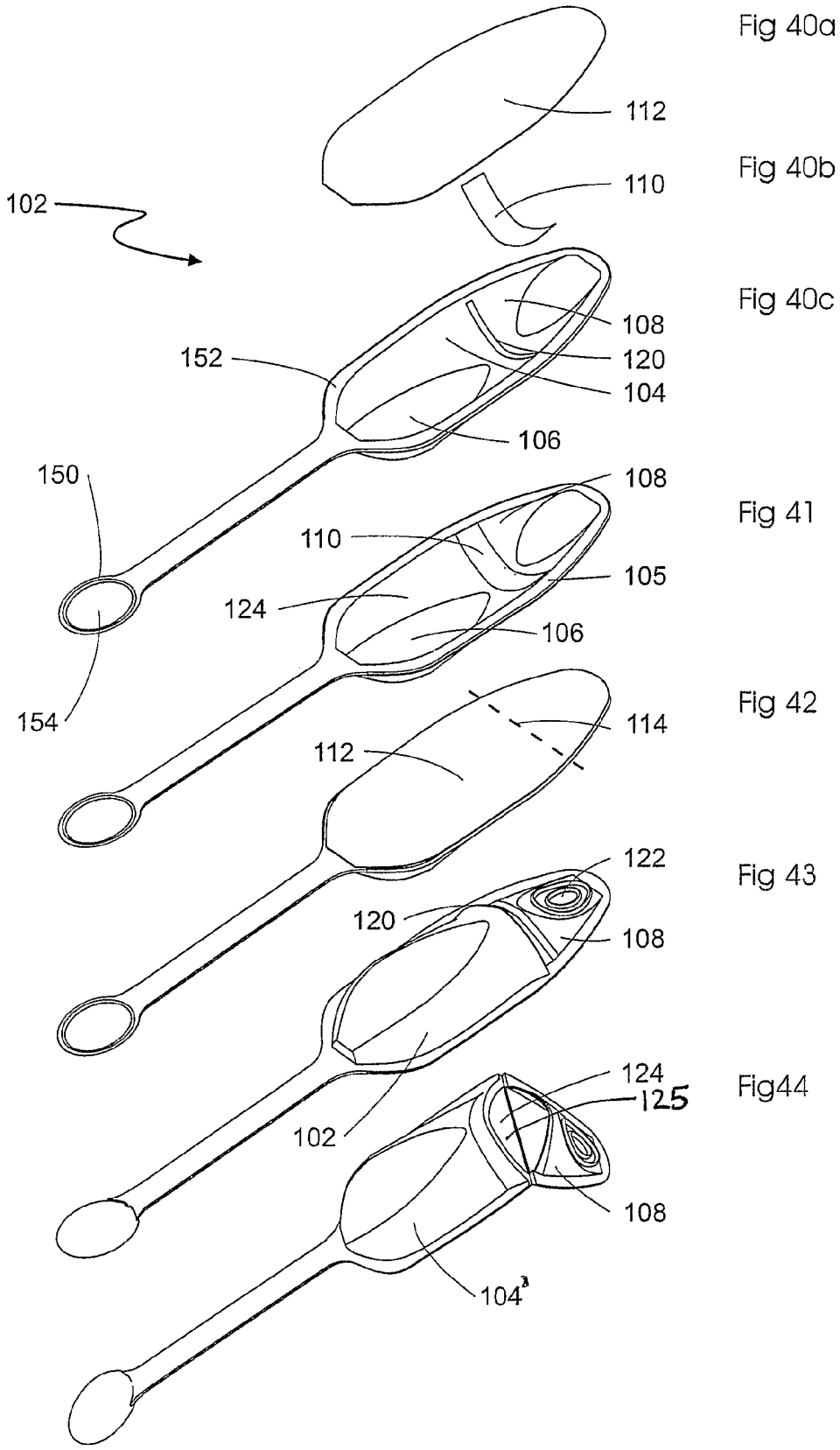

Another preferred embodiment of the present invention is shown in FIGS. 40*a* to 44. A dispensing utensil 102 is shown in exploded perspective view in FIGS. 40*a* to 40*c*. FIG. 40*a* shows a pliable top wall 112, FIG. 40*b* shows a seal 110 and FIG. 40*c* shows a carcass 104 having integral bottom wall 106, integral lid 108 and integral tool portion 150 having spoon bowl 154. The dispensing utensil therefore has a handle portion 152, in which the contents are stored, and the tool portion 150.

The tool portion 150 may be selected to synergistically pair with the contents. For example, where the contents are sugar, a tool portion having a stirrer or spoon bowl is advantageous. After the contents have been dispensed into a drink, the spoon may be used to stir the drink, dissolving the sugar. Salt may be dispensed from a utensil having a fork tool, and pepper from a knife tool, the knife and fork then used to eat a meal. Paint could be dispensed from a brush, the brush then used to paint. Many suitable (but non-limiting) combinations are hereinafter disclosed.

Bottom wall 106 is adjacent lid 108 to form a slot 120 therebetween. FIG. 41 shows the seal 110 assembled in position, sealing the lid 108 to the bottom wall 106, the seal 110 extending over the slot 120.

The hollow or concave carcass assembly 105 including carcass 104, bottom wall 106, lid 108 and seal 110 forms cavity 124. Cavity 124 is filled with contents (to be dispensed in use) and the flat pliable top wall 112 is then sealed to carcass 104 and lid 108, as shown in FIG. 42. FIG. 43 shows a bottom view of the utensil 102, in which the underside of slot 120 may be seen, as well as thumb-rest 122 on lid 108.

The contents may be dispensed by application of force to the thumb-rest 122 on lid 108, opening the lid 108 about a hinge 114 formed by the pliable top wall 112, thereby breaking the seal 110 at the comparatively weaker and stress concentrating point, slot 120. The slot 120 and seal 110 are located remote from the axis of the hinge 114, with the seal/slot 110, 120 being on one side of the cavity 124 and the top wall 112 forming hinge 114 being on the other side. Contents may be dispensed or poured from cavity 124 via throat 125, which functions as a pouring mouth or nozzle. A bottom perspective view of a dispensing utensil in the opened position is shown in FIG. 44 (seal 110 not shown, for clarity). In the embodiment shown in FIGS. 40*a* to 44, the carcass assembly 105 has been broken into two pieces, with the integral lid 108 being snapped off from the carcass 104, but retained on the carcass 104 by the hinged connection of pliable top wall 112. The two pieces of carcass assembly 105 as shown in FIG. 44 are a body 104' consisting of carcass 104, bottom wall 106 and top wall 112, and a lid 108 retained on the body 104' by the top wall 112. The carcass 104 and bottom wall 106 define a shell having an inner surface which is also the inner surface of cavity 124. The seal 110 is affixed to the inner surface of the shell, which in this embodiment is the inner surface of the carcass 104. The axis of the hinge 114 is transverse the dispensing utensil 102. The utensil 102 is elongate, having a longitudinal axis perpendicular to the axis of the hinge 114.

The hinge 114 is formed by and in the plane of the flat, pliable top wall 112 and the seal 110 sealing the lid 108 to the carcass 104 (being part of the shell) is out of the plane of the top wall 112.

The shell is elongate and substantially concave in cross section, having a substantially concave inner surface and a substantially convex outer surface. In the embodiment shown, the bottom wall 106 is flat but the container forms a hollow into which contents may be placed, prior to affixing the top wall 112 to create cavity 24.

A substantial portion of the lid 108 is rigid and a substantial portion of the body 104' is rigid, allowing the lid 108 and body 104' to be used as lever arms to open the dispensing utensil 102 about hinge 114. This rigidity is achieved in part by the rigidity of the carcass 104 and in part by the structure of the body 104', in which the carcass 104 has been braced by the bottom wall 106 and the top wall 112.

Preferably, the pliable top wall 112 and seal 110 are multilayer foils and the carcass 104 with integral bottom wall 106 and integral lid 108 is plastic. The foil is adhered to the plastic using a heat welding process. Top wall 112 and bottom wall 106 define a cavity 124 in which contents are stored. The seal 110 seals lid 108 to the bottom wall 106, thereby sealing the cavity 124.

In manufacture, the carcass 104 and lid 108 are integrally formed by a suitable moulding technique. The seal 110 is then positioned over slot 120 and affixed to the carcass 104 in a single pass operation. Cavity 124 is then top-filled with contents. The ability to top-fill the cavity 124 is particularly advantageous, as it is both faster and easier, and therefore cheaper, than end-filling techniques. The pliable top wall 112 may then be applied in a single pass operation and heat welded to the carcass assembly 105, forming a sealed utensil. The seal 110 and pliable top wall 112 may be selected to suit the contents, for example, to have suitable barrier properties such as being water vapour impermeable for coffee granules.

The seal may be used simply to prevent egress of contents, where it is used over a slot. However, it may also be used to improve barrier characteristics, even where product egress would not have occurred, for example where it is used over a failure zone such as a score line or area of thinner material.

In this and other embodiments of the invention, the seal is 'broken' when it loses its function of sealing the cavity, whether that sealing relates to prevention of egress of contents, or to barrier sealing—for example, preventing transmission of water vapour. In other words, use of the words 'sealing the cavity' herein is not limited to mere prevention of egress of contents.

The seal 110 may be pierced, torn or otherwise damaged, or alternatively, the seal 110 may cease to be attached to the lid 108, peeling off or sliding relative to the lid 108 (or in other embodiments may cease to be attached to the carcass 104, bottom wall 106 or reinforcing rib 107, peeling off or sliding relative thereto). A membrane or coating may assist in the sliding action, being placed between the seal 110 and lid 108, or between the seal 110 and rib 107, bottom wall 106 or carcass 104.

The seal 110 and pliable top wall 112 may be a foil, film, paper or membrane, or a composite of these or other suitable materials. In one preferred embodiment, the slot 120 (or failure zone) is coated with a liquid which dries into a sealing film. In another embodiment, adhesive is used to secure the seal 110 to the lid 108 and/or the bottom wall 106. In a preferred embodiment, the adhesive (and hence seal 110) fails when the lid 108 is opened, allowing the seal 110 to slide over the lid 108 or bottom wall 106. Alternatively, a composite seal having a foil or film layer and a membrane serving a similar function to the adhesive may be provided.

The hinged connection of pliable top wall 112 is advantageous in that the lid 108 may be re-closable, depending on the configuration of lid 108 and carcass 104. Further, the potential for littering is reduced, as the lid 108 will not go astray.

In another embodiment (not shown), the carcass assembly 105 is not broken into two pieces when the lid 108 is opened, but rather the carcass assembly 105 yields such that the lid 108 is openable about hinge 114 formed by the pliable top wall 112, thereby breaking or snapping open the seal 110. In yet further embodiments as shown in FIGS. 63*a* to 65*c*, the carcass assembly 105 is originally composed of separate parts—carcass 104 and lid 108, which are assembled and joined together by seal 110 and by pliable top wall 112 such that the lid 108 is openable about hinge 114 formed by the pliable top wall 112, thereby breaking the seal 110. These constructions allow for alternative carcass materials to be used, as the "snapability" of a material does not affect the operation of the utensil.

Figures 45A, 45B, 45C, 46, 47, 48, 49:
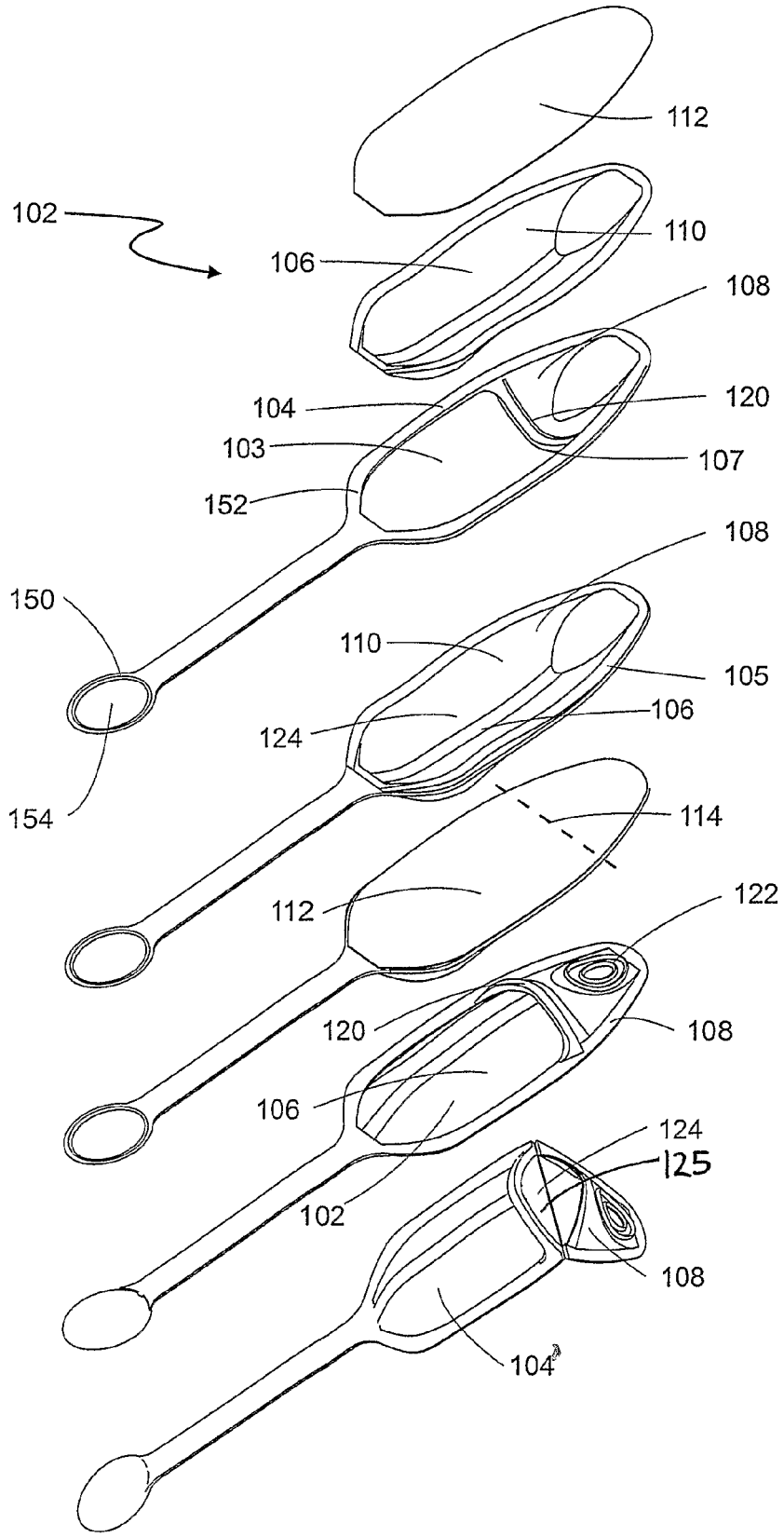

Another preferred embodiment of the present invention is shown in FIGS. 45*a* to 49. A dispensing utensil 102 is shown in exploded perspective view in FIGS. 45*a* to 45*c*. FIG. 45*a* shows a pliable top wall 112, FIG. 45*b* shows a seal 110 having integral bottom wall 106 and FIG. 45*c* shows a carcass 104 having integral lid 108, integral reinforcing rib 107 and integral tool portion 150 having spoon bowl 154. The dispensing utensil therefore has a handle portion 152, in which the contents are stored, and the tool portion 150.

Reinforcing rib 107 is adjacent lid 108 to form a slot 120 therebetween. FIG. 46 shows the seal 110 having integral bottom wall 106 assembled in position, sealing the lid 108 to the integral reinforcing rib 107, the seal 110 extending over the slot 120. The bottom wall 106 extends over carcass void 103 and is sealed to carcass 104 as a part of carcass assembly 105.

The carcass assembly 105, including carcass 104, bottom wall 106, lid 108 and seal 110, forms cavity 124. Cavity 124 is filled with contents (to be dispensed in use) and the pliable top wall 112 is then sealed to carcass 104 and lid 108, as shown in FIG. 47. FIG. 48 shows a bottom view of the utensil 102, in which the underside of slot 120 may be seen, as well as thumb-rest 122 on lid 108.

The contents may be dispensed by application of force to the thumb-rest 122 on lid 108, opening the lid 108 about a hinge 114 formed by the pliable top wall 112, thereby breaking the seal 110 at the comparatively weaker and stress concentrating point, slot 120. Contents are dispensed from cavity 124 via throat 125. A bottom perspective view of a dispensing utensil in the opened position is shown in FIG. 49 (seal 110 not shown, for clarity).

In manufacture, the carcass 104 and lid 108 are integrally formed by a suitable moulding technique. The seal 110 having integral bottom wall 106 is then positioned over slot 120 and the void 103 in carcass 104 and affixed to the carcass 104 in a single pass operation. Cavity 124 is then top-filled with contents. The pliable top wall 112 may then be applied in a single pass operation and heat welded to the carcass assembly 105, forming a sealed utensil.

In another embodiment (not shown), the carcass assembly 105 is not broken into two pieces when the lid 108 is opened, but rather the carcass assembly 105 yields such that the lid 108 is openable about hinge 114 formed by the pliable top wall 112, thereby breaking or snapping open the seal 110.

In another embodiment (not shown), the seal 110 and bottom wall 106 are separate items, the seal 110 being affixed to the lid 108 and reinforcing rib 107, and the bottom wall 106 being affixed to the carcass 104 and reinforcing rib 107. This may be useful, for example, where it is desirable to have a seal 110 with good yield properties, but a tougher bottom wall 106, such that it does not yield in handling and transport, prior to use. Bottom wall 106 has a greater surface area than seal 110 and is more likely to suffer damage. Preferably, in manufacture, seal 110 and bottom wall 106 are applied in a single pass operation.

Figures 50A, 50B, 50C, 51, 52, 53, 54:
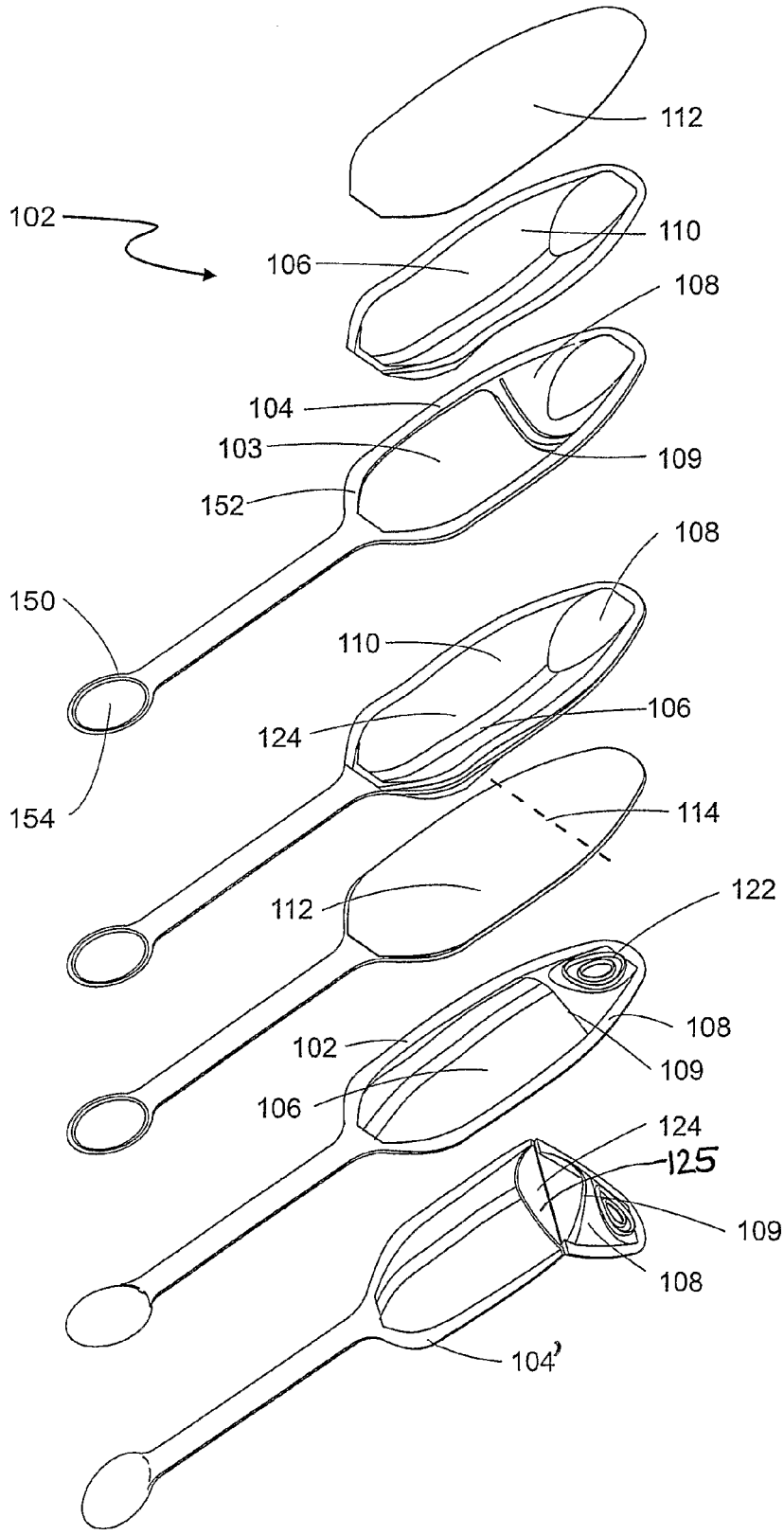

Another preferred embodiment of the present invention is shown in FIGS. 50*a* to 54. A dispensing utensil 102 is shown in exploded perspective view in FIGS. 50*a* to 50*c*. FIG. 50*a* shows a pliable top wall 112, FIG. 50*b* shows a seal 110 (having integral bottom wall 106) and FIG. 50*c* shows a carcass 104 having integral lid 108 but not having an integral reinforcing rib (unlike FIG. 50*c*). Hence, no slot is formed. Rather, lid edge 109 is immediately adjacent bottom wall 106. Carcass 104 also has integral tool portion 150 having spoon bowl 154. The dispensing utensil therefore has a handle portion 152, in which the contents are stored, and the tool portion 150.

FIG. 51 shows the seal 110 having integral bottom wall 106 assembled in position, sealing the lid 108 to the carcass 104. Seal 110 extends beyond lid edge 109, covering the inner surface of lid 108. The bottom wall 106 extends over carcass void 103 and is sealed to carcass 104 as a part of carcass assembly 105.

The carcass assembly 105, including carcass 104, bottom wall 106, lid 108 and seal 110, forms cavity 124. Cavity 124 is filled with contents (to be dispensed in use via throat 125) and the pliable top wall 112 is then sealed to carcass 104 and lid 108, as shown in FIG. 52. FIG. 53 shows a bottom view of the utensil 102, in which the underside of lid edge 109 may be seen, as well as thumb-rest 122 on lid 108.

The contents may be dispensed by application of force to the thumb-rest 122 on lid 108, opening the lid 108 about a hinge 114 formed by the pliable top wall 112, thereby breaking the seal 110 at the comparatively weaker and stress concentrating point lid edge 109. Seal 110 having integral bottom wall 106 fails by yielding or tearing in the embodiment shown. A bottom perspective view of the dispensing utensil 102 in the opened position is shown in FIG. 54 (seal 110 not shown, for clarity).

In an alternative embodiment, not shown, the seal extends just beyond the lid edge, such that upon application of force to the lid, the seal ceases to be attached to the lid, rather than the seal material itself yielding or tearing. Hence, the seal remains attached to the carcass, but there is little excess material to interfere with dispensing of contents.

Figures 55A, 55B, 55C, 56, 57, 58:
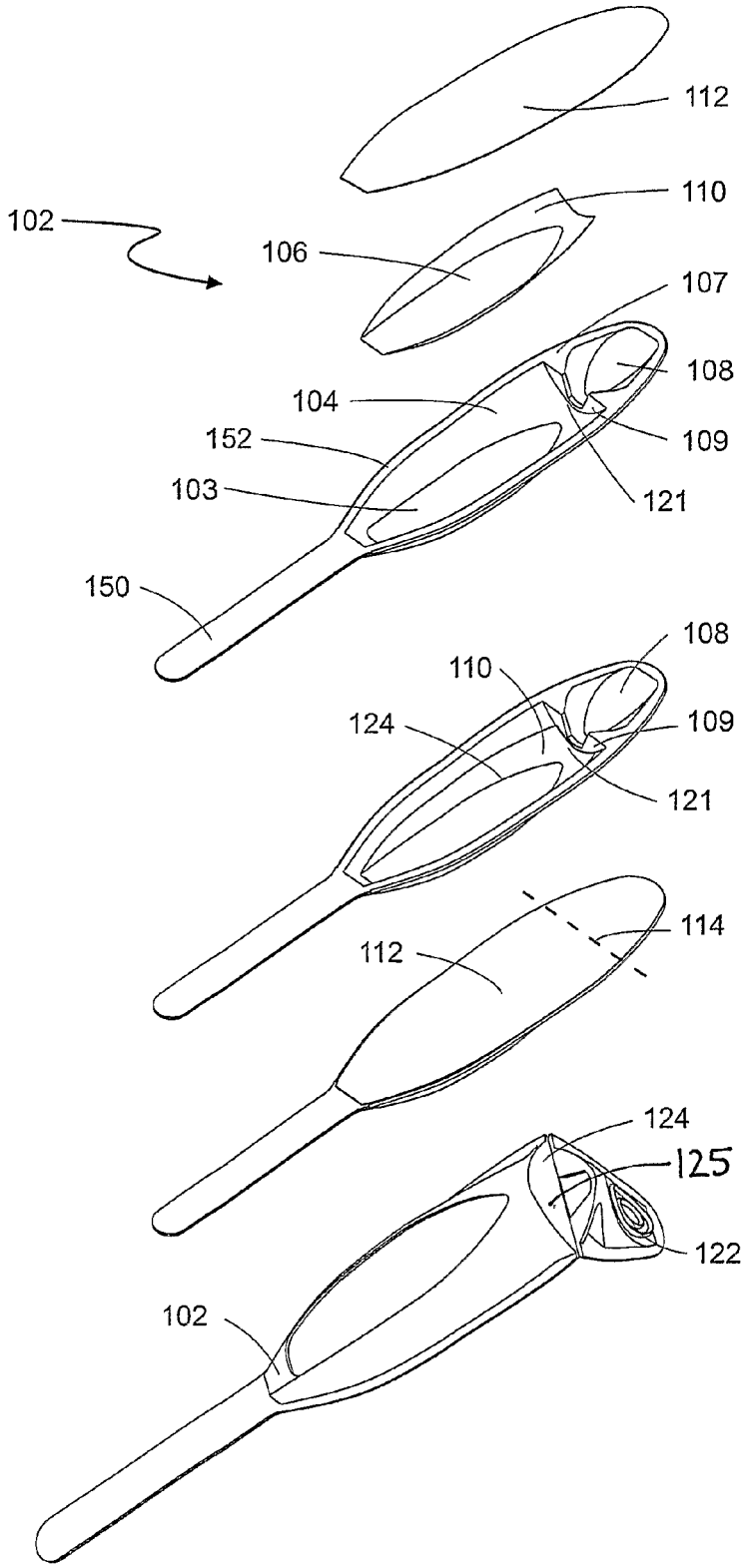

Another preferred embodiment of the present invention is shown in FIGS. 55*a* to 58. A dispensing utensil 102 is shown in exploded perspective view in FIGS. 55*a* to 55*c*. FIG. 55*a* shows a pliable top wall 112, FIG. 55*b* shows a seal 110 having integral bottom wall 106 and FIG. 55*c* shows a carcass 104 having integral lid 108. Lid 108 includes reinforcing rib 107. Carcass 104 also has integral tool portion 150 which is a stirrer or mixer. The dispensing utensil therefore has a handle portion 152, in which the contents are stored, and the tool portion 150.

Reinforcing rib 107 provides structural rigidity in the dispensing utensil 102, as well as resulting in a comparatively weaker and stress concentrating point at failure zone 121.

FIG. 56 shows the seal 110 (having integral bottom wall 106) assembled in position. The seal 110 extends just beyond failure zone 121, improving barrier characteristics at this point. The seal 110 seals failure zone 121, extending and sealing to lid edge 109. To obtain improved barrier characteristics, seal 110 need extend only fractionally beyond failure zone 121 onto lid edge 109.

The bottom wall 106 extends over carcass void 103 and is sealed to carcass 104 as a part of carcass assembly 105. The carcass assembly 105, including carcass 104, bottom wall 106, lid 108 and seal 110, forms cavity 124. Cavity 124 is filled with contents (to be dispensed in use) and the pliable top wall 112 is then sealed to carcass 104 and lid 108, as shown in FIG. 57. The failure zone 121 and seal 110 are located remote from the axis of the hinge 114, with the seal/failure zone 110, 121 being on one side of the cavity 124 and the top wall 112 forming hinge 114 being on the other side.

The contents may be dispensed by application of force to the thumb-rest 122 on lid 108, opening the lid 108 about a hinge 114 formed by the pliable top wall 112, thereby breaking the seal 110 at the failure zone 121. A bottom perspective view of a dispensing utensil in the opened position is shown in FIG. 58 (seal 110 not shown, for clarity). In alternative embodiments (not shown) the throat 125 may be narrowed by positioning the failure zone 121 on the lid side of rib 107, such that the rib 107 reduces the cross-sectional area of the throat 125. The rib 107 is retained on the body portion of the utensil (rather than on the lid portion), when the lid is opened. The throat 125 is thereby also further stiffened for pouring.

Figure 59:
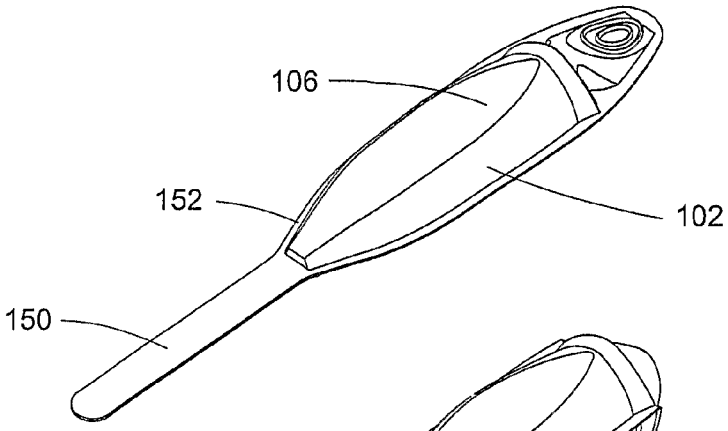
FIG. 59 shows a bottom perspective view of a dispensing utensil according to another embodiment of the present invention, in which the bottom wall is pliable.
Figure 60:
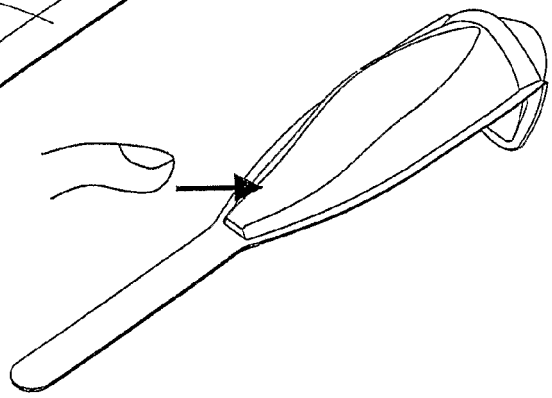
FIG. 60 shows a bottom perspective view of one version of the embodiment of FIG. 59, in which the lid has been opened.

Alternative preferred embodiments of the present invention are shown in FIGS. 59 to 62. FIG. 59 shows a bottom perspective view of a dispensing utensil 102 in which the bottom wall 106 is pliable or flexible, such that once the utensil 102 is opened (as shown in FIG. 60), the bottom wall 106 may be pushed or squeezed in order to dispense contents. This is particularly useful where the contents are a viscous liquid, such as sauces, paint, cremes, pastes and the like. The action of pushing on the pliable bottom wall 106 (and pliable top wall if desired) also provides control in the amount of contents dispensed. Where the contents are of a more free-flowing nature, the pliable or flexible bottom wall may also be used to prevent further dispensing, for example, dispensing only half the contents.

The bottom wall 106 may be integral with the carcass 104, or may, for example, be integral with the seal (not shown). Furthermore, the bottom wall 106 may be provided separately from the seal (not shown), in this and other embodiments of the invention.

Figure 61:
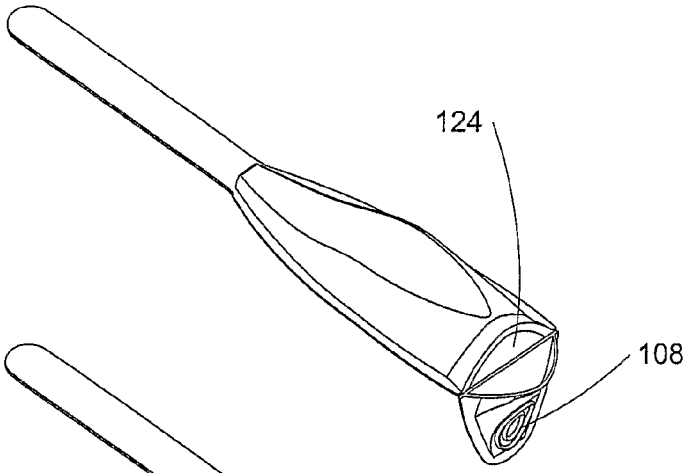
FIG. 61 shows another bottom perspective view of a different version the embodiment of FIG. 59, in which the lid has been opened and is hollow.
Figure 62:
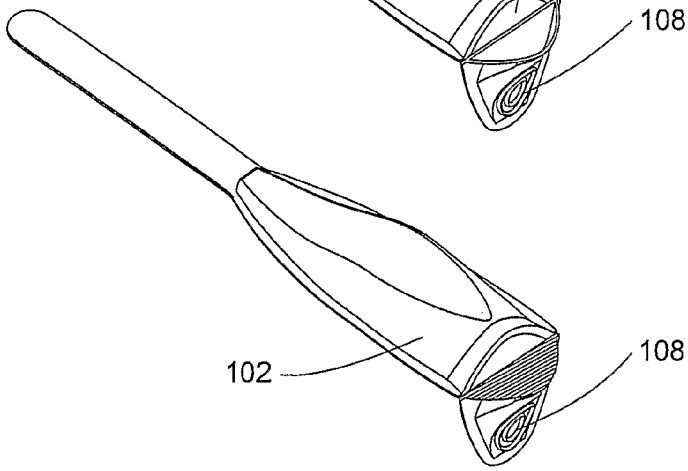
FIG. 62 shows another bottom perspective view of a different version the embodiment of FIG. 59, in which the lid has been opened but is not hollow.
Figures 63A, 63B, 63C:
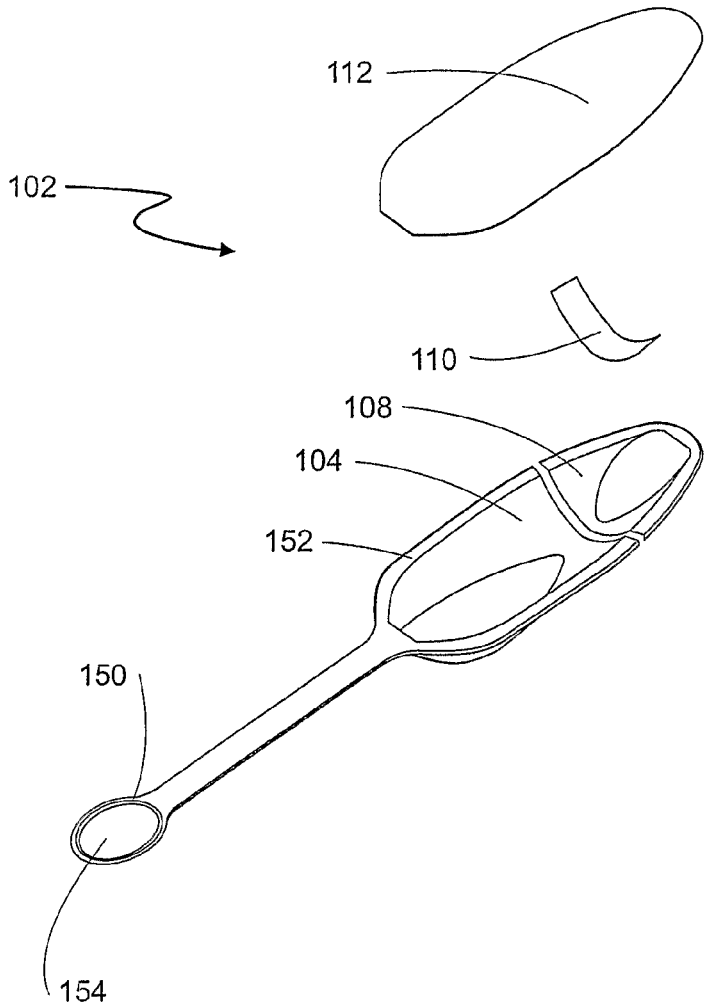
Figure 64A:
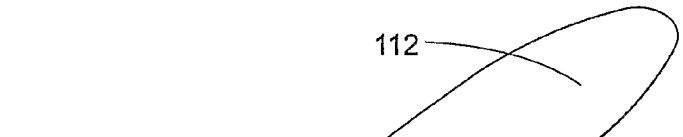
Figure 64B:
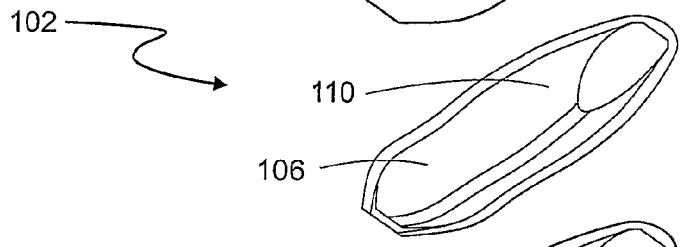
Figure 64C:
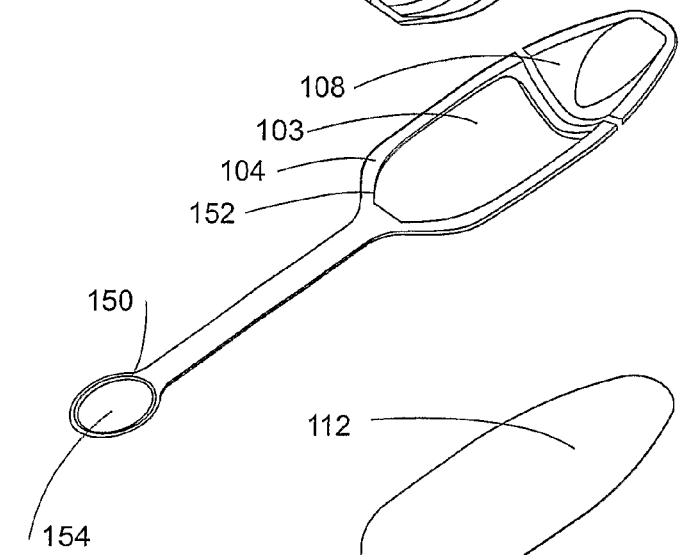
Figure 65A:
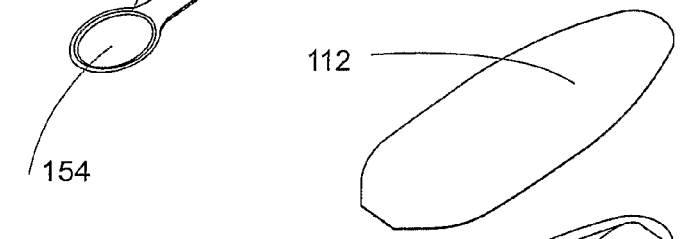
Figure 65B:
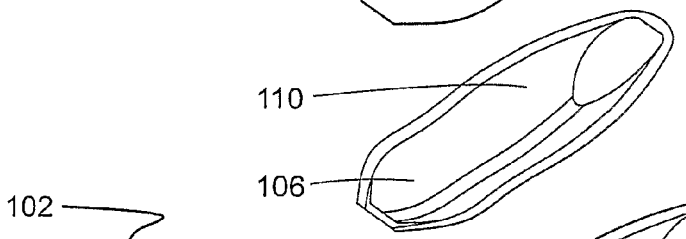
Figure 65C:
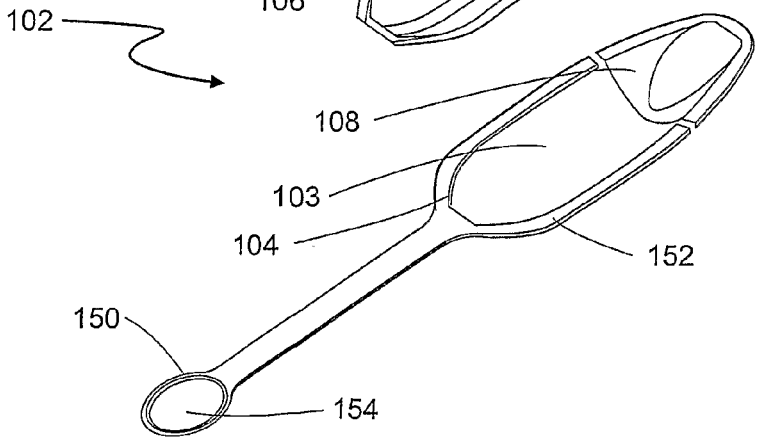
Figure 72A:
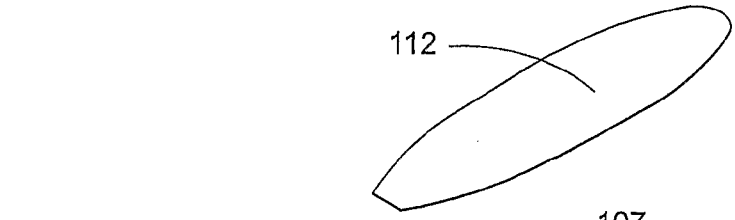
Figure 72C:
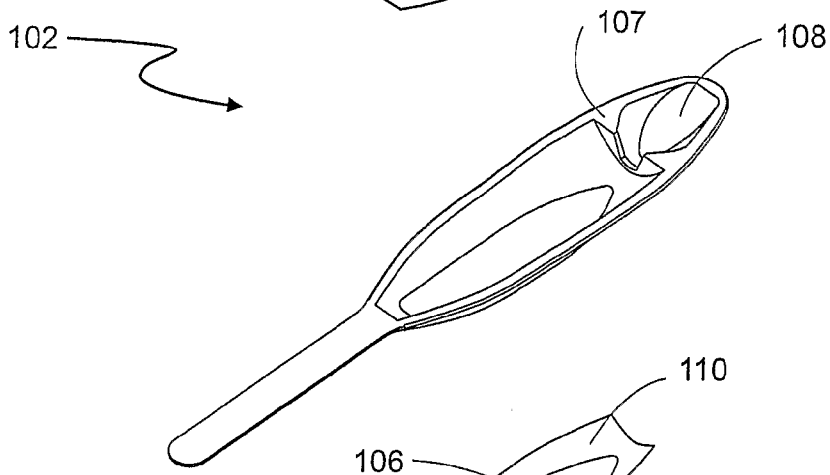
Figure 72B:
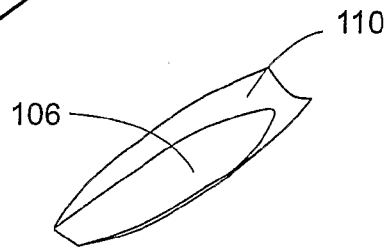
Figure 73:
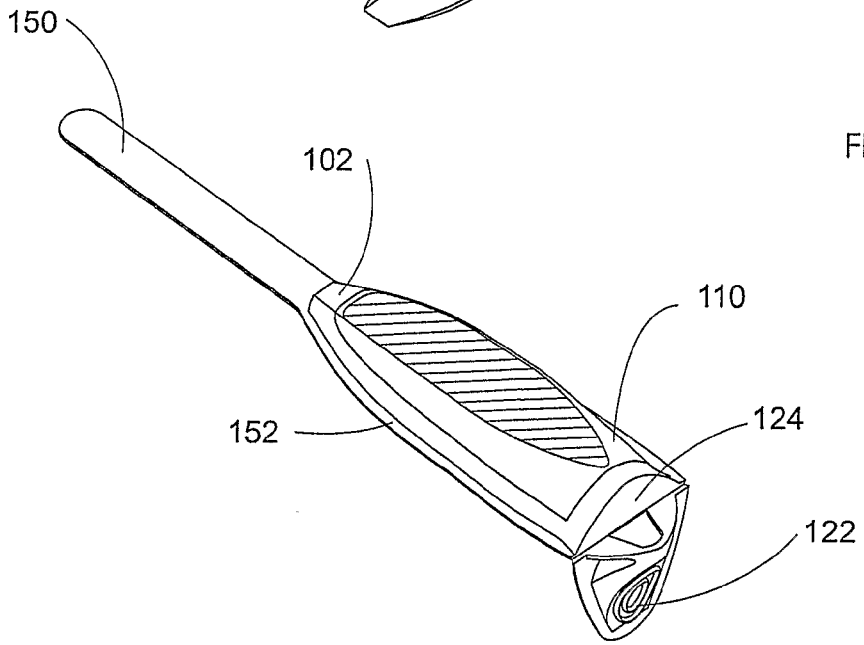
FIG. 73 shows a bottom perspective view of the embodiment of FIGS. 72*a* to 72*c* in which the lid has been opened.
Figures 74A, 74B, 74C:
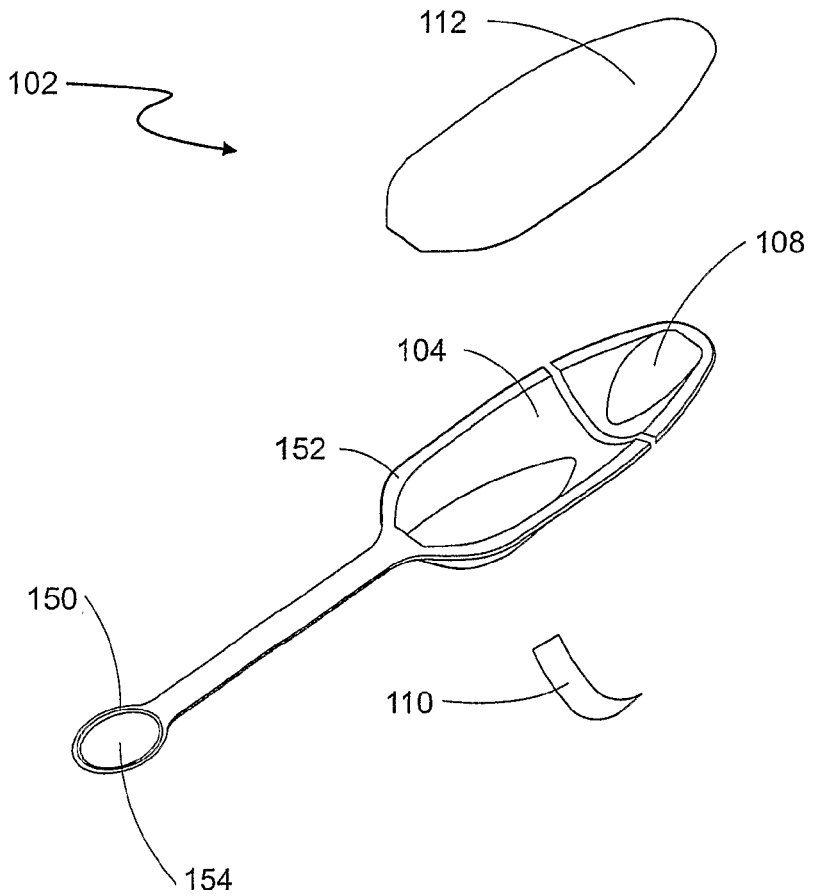

As shown in FIG. 61, the lid 108 may be hollow, or may solid as shown in FIG. 62. A hollow lid may allow for additional contents to be packaged in the cavity 124 during manufacture, as some contents are packed 'in' the lid. The contents may then settle during transport and storage, such that the lid 108 is empty of contents. This may be inappropriate, for example for use with medicaments where strict dosage control is required, and thus a solid or blocked off lid 108 may be provided. Provision of a solid or blocked off lid 108 also provides additional structural rigidity to the utensil 102, and improved 'snapability', similarly to the provision of a reinforcing rib as discussed in relation to FIG. 56.

In this and other embodiments of the invention, the pliable top wall 112 and the bottom wall 106 may be transparent, or semi-transparent as well as opaque. This allows for precise determination of the amount of contents remaining in the utensil. Measuring or dosage marks may also be provided.

A preferred embodiment of the present invention is shown in FIGS. 66*a* to 67. A dispensing utensil 102 is shown in exploded perspective view in FIGS. 66*a* to 66*c*. FIG. 66*a* shows a pliable top wall 112, FIG. 66*b* shows a seal 110 and FIG. 66*c* shows a carcass 104 having integral bottom wall 106 and integral lid 108. Carcass 104 also has integral tool portion 150. The dispensing utensil therefore has a handle portion 152, in which the contents are stored, and the tool portion 150.

Bottom wall 106 is adjacent lid 108 to form a slot 120 therebetween. In this embodiment, seal 110 is applied from below or outside of utensil 102. FIG. 67 shows the seal 110 assembled in position, sealing the lid 108 to the bottom wall 106, the seal 110 extending over the slot 120.

This allows for flexibility in manufacture. In embodiments where a failure zone is provided rather than a slot 120, the seal may be applied before or after the utensil is filled and pliable top wall 112 applied.

Applying the seal from below may also assist in causing the seal to break when the lid is opened, as the lid edge will 'push' against the seal and, for example, is less likely to peel away from the lid as may occur where the seal is applied from above (or 'inside' the cavity). If failure due to loss of adhesion is required, applying the seal from above may be appropriate, whereas if failure by tearing or piercing is required, applying the seal from below may be appropriate. However, this will depend on the precise characteristics of the materials involved, and, for example, the rheology of the adhesive, membrane or other 'slipping' substance provided.

A preferred embodiment of the present invention similar to that of FIG. 69 is shown in FIGS. 68*a* to 69. A dispensing utensil 102 is shown in exploded perspective view in FIGS. 68*a* to 68*c*. FIG. 68*a* shows a pliable top wall 112, FIG. 68*b* shows a seal 110 having integral bottom wall 106 and FIG. 68*c* shows a carcass 104 having integral lid 108. Carcass 104 also has integral tool portion 150. The dispensing utensil therefore has a handle portion 152, in which the contents are stored, and the tool portion 150. In this embodiment, seal 110 is applied from below or outside of utensil 102. FIG. 69 shows the seal 110 assembled in position, sealing the lid 108 to the reinforcing rib 107, the seal 110 extending over the slot 120 and also over void 103 to form bottom wall 106. As with the previous embodiment of the invention, application of the seal from below may have advantages.

Yet another embodiment of the invention in which the seal 110 is applied from below is shown in FIGS. 70*a* to 71. FIG. 70*a* shows a pliable top wall 112, FIG. 70*b* shows a seal 110 (having integral bottom wall 106) and FIG. 70*c* shows a carcass 104 having integral lid 108 but not having an integral reinforcing rib (unlike FIG. 68*c*). Hence, no slot is formed. Rather, lid edge 109 is immediately adjacent bottom wall 106. Carcass 104 also has integral tool portion 150. The dispensing utensil therefore has a handle portion 152, in which the contents are stored, and the tool portion 150. In this embodiment, seal 110 is applied from below or outside of utensil 102. FIG. 71 shows the seal 110 assembled in position, sealing the lid 108 to the carcass 104, the seal 110 extending over the void 103 to form bottom wall 106. As with the previous embodiment of the invention, application of the seal from below may have advantages.

FIGS. 72*a* to 76*c* show further embodiments of the invention otherwise corresponding to FIGS. 55*a* to 58 and FIGS. 63*a* to 65*c*, but in which the seal 110 is applied from below. Like numerals reference like features.

Figure 77:
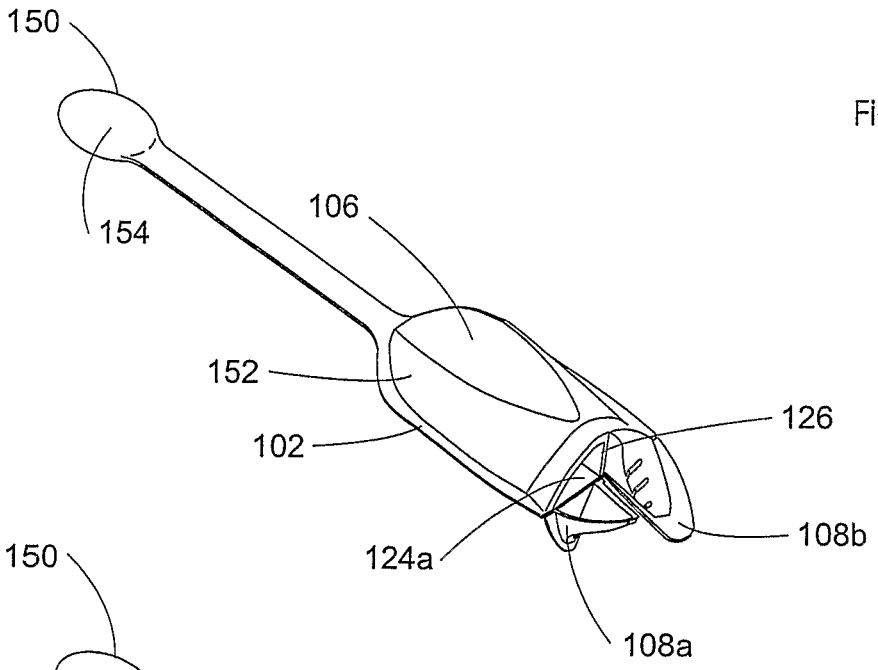
FIG. 77 shows a bottom perspective view of a preferred embodiment of the invention, in which there are two cavities.
Figure 78:
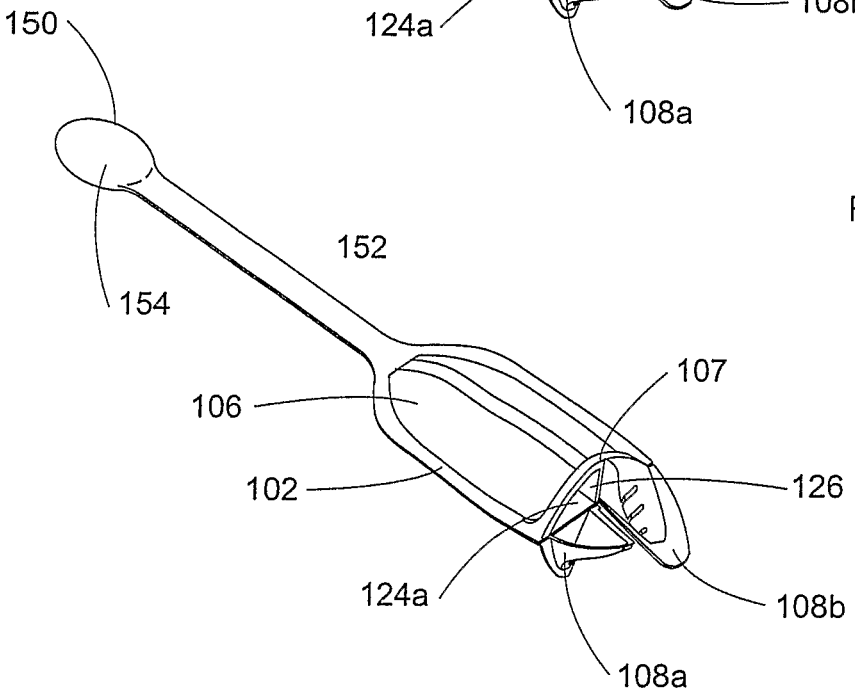
FIG. 78 shows a bottom perspective view of another preferred embodiment of the invention, in which there are two cavities.

In further embodiments of the invention, as shown in FIGS. 77 and 78, cavity 124 may be divided into two sections by dividing wall—124*a* (open to view because lid 108*a* is in the open position) and 124*b* (not open to view, because lid 108*b* is in the closed position). In other embodiments, cavity 124 may be divided into three or more sections. The embodiments of FIGS. 77 and 78 have separate lids for each cavity section, however, a single lid for all sections could also be provided. The provision of multiple cavity sections is useful for example for provision of coffee and sugar, or salt and pepper, or 'two-part' adhesive glues, as it is desirable to provide the contents separately, but the contents may be required to be provided for use at the same time.

Figure 79:
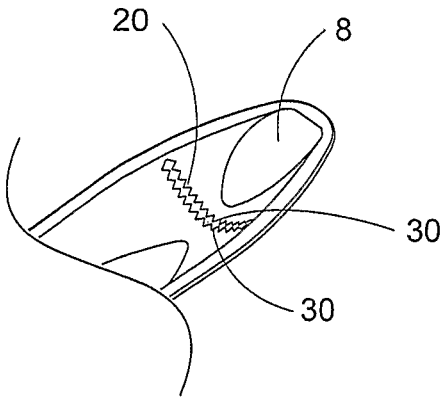
FIG. 79 shows a carcass having integral bottom wall and lid.
Figure 80:
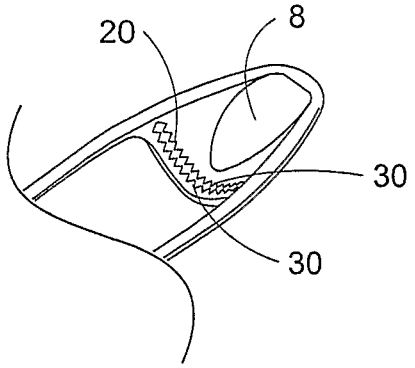
FIG. 80 shows a carcass having integral lid.
Figure 81:
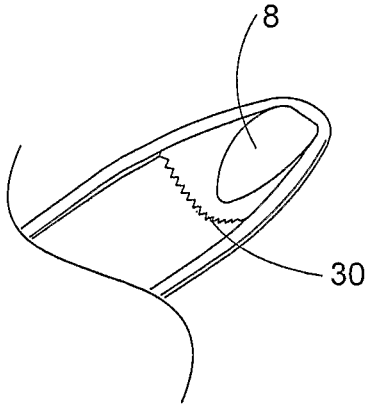
FIG. 81 shows a carcass having integral lid.
Figure 82A:
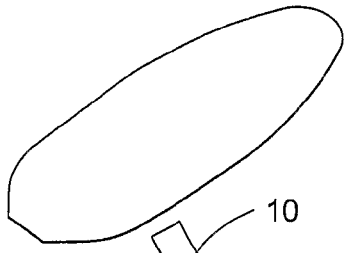
Figure 82B:
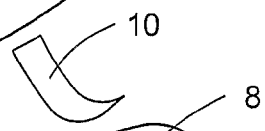
Figure 82C:
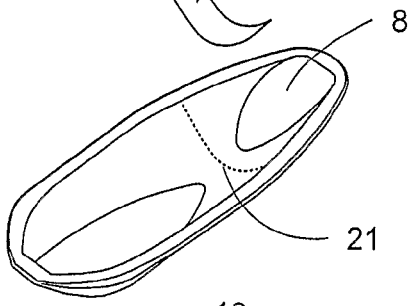
Figure 83:
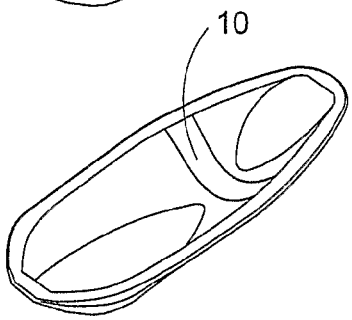
FIG. 83 shows a top perspective view of the embodiment of FIGS. 82*a* to 82*c*, in which the seal has been assembled with the carcass having integral bottom wall and lid.
Figure 84:
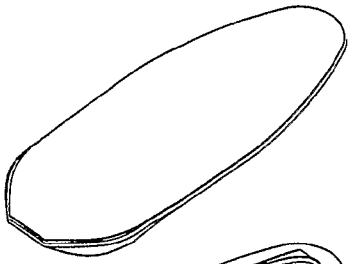
FIG. 84 shows a top perspective view of the embodiment of FIGS. 82*a* to 82*c*, in which the pliable top wall has been assembled with the seal and the carcass having integral bottom wall and lid.
Figure 85:
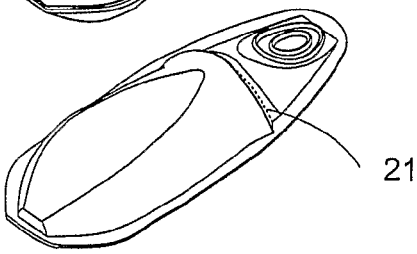
FIG. 85 shows a bottom perspective view of the embodiment of FIG. 84.
Figure 86:
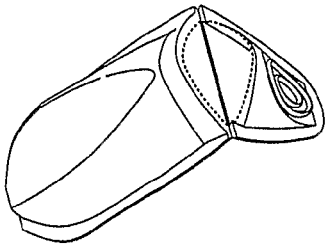
FIG. 86 shows a bottom perspective view of the embodiment of FIG. 84 in which the lid has been opened.
Figures 87A, 87B, 87C, 88, 89, 90, 91:
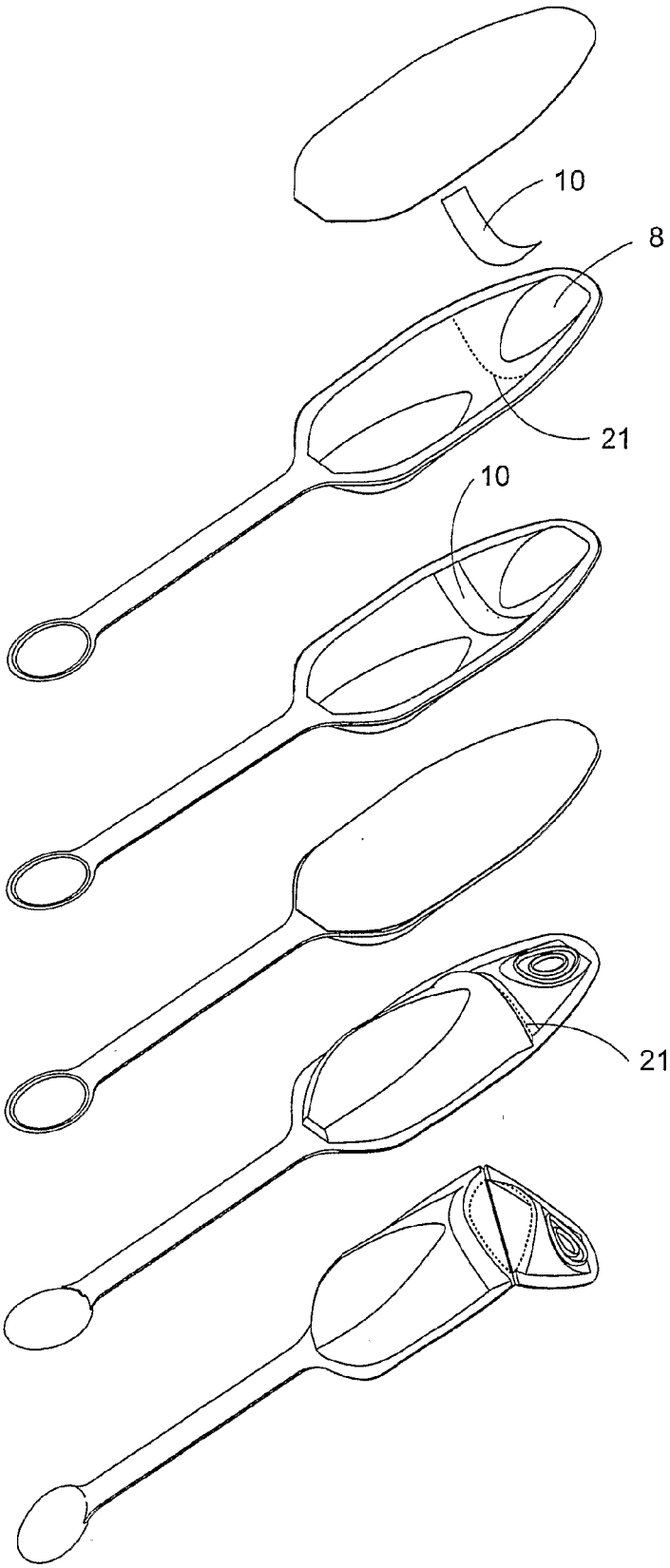

FIGS. 79 to 80 show yet a further embodiment of the invention, in which the edges of slot 20, or lid edge 9, are provided with teeth 30, protrusions or other stress concentrating means, such that when lid 8 is opened, the teeth 30, protrusions or other stress concentrating means will assist in causing failure of the seal (not shown).

FIGS. 82*a* to 91 show yet further embodiments of the invention, in which a failure zone 21 is created using a plurality of small flaws or 'pin pricks' or 'pin holes' as stress concentrators, creating a zone 21 in which failure will occur as lid 8 is opened. In other embodiments, not shown, a single 'pin prick' 'or pin hole' may be provided, rather than a plurality. These 'pin pricks' or 'pin holes' may be perforations that extend completely through the thickness of the carcass assembly, or could instead extend only partially through the thickness. In a preferred embodiment, the seal 10 is applied as a liquid phase polymer (for example, painted over the pin holes) which, when dried, seals the cavity. It is noted that (in some applications) it is not necessary to coat the surrounding area with the liquid phase polymer, but rather only to cover the actual pin hole(s).

Provision of an encapsulated 'air bubble' or other inclusion would also raise the stress concentration at that point and reduce the force required to cause yielding when the lid 8 is opened. A small slot or hole could also be provided, rather than a slot extending the width of the lid. The failure zone 21 may be deliberately weakened by 'pin pricks' or other treatments, or may be an area of relative weakness resulting from the geometric configuration of the invention. Hence, strategic placement of a reinforcing rib, the size or stiffness of the lid or other factors may be used to create an area of relative weakness and hence a failure zone. The seal 110 then extends over the failure zone 21.

Figure 92:
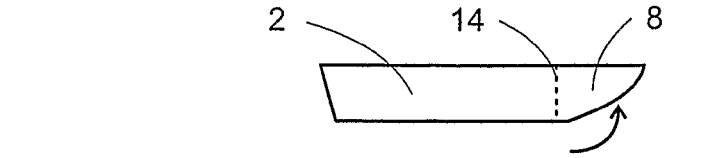
FIG. 92 shows a side view of a dispensing container according to a preferred embodiment of the invention.

FIG. 92 shows a side view of a dispensing container 2 according to a preferred embodiment of the invention, in which the lid 8 is located at the right-hand end of the container 2.

Figure 93:
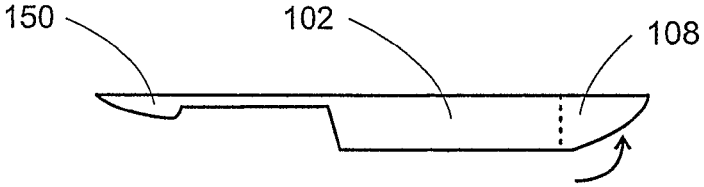
FIG. 93 shows a side view of a dispensing utensil according to a preferred embodiment of the invention.
Figure 94:
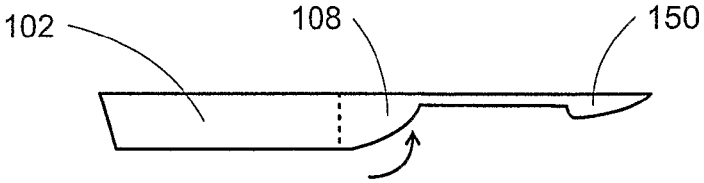
FIG. 94 shows a side view of a dispensing utensil according to another preferred embodiment of the invention.

FIG. 93 shows a side view of a dispensing utensil 102 according to a preferred embodiment of the invention, in which the lid 108 is located at the right-hand end of the utensil 102, being the opposite end from the tool portion 150 of the utensil 102. FIG. 94 shows a side view of a dispensing utensil 102 in which the tool portion 150 is instead mounted on the lid 108. Hence, the utensil 102 may be formed to dispense from the opposite end from the tool portion 150, or from the same end as tool portion 150. This will be useful for different applications. For example, where the contents of the dispensing utensil 102 is sugar for use with a cup of coffee, it is desirable to dispense, from the 'opposite end', a quantity required by the user, and then prevent further dispensing by holding the utensil 102 vertically as the utensil 102 is used to stir, preventing further egress of sugar (as shown in FIG. 93). Where the contents are a metered dose or set quantity, for example a medicament to be mixed in water, it is desirable that the entire dose is dispensed, and it is therefore useful to ensure all contents are dispensed by providing a utensil 102 arranged as shown in FIG. 94, in which dispensing occurs from the 'same end' as the tool portion 150.

It may also be desirable to dispense particular contents directly to the tool portion 150, for example, toothpaste onto a toothbrush. Therefore, dispensing from the 'same end' as the tool portion 150 is desired.

In order to ensure that the contents are delivered onto the tool portion, it may be necessary to provide conduits or delivery channels such that the dispensed contents are then delivered to the tool portion. The applicator brush/swab of FIGS. 95*a* to 97 demonstrates such an arrangement. A dispensing container may be positioned as a cartridge within a framework or tool, such that the combination is a dispensing utensil. Alternatively, as shown in FIGS. 95*a* to 97, a dispensing utensil is integrally formed with delivery channel 170.

Figure 95:
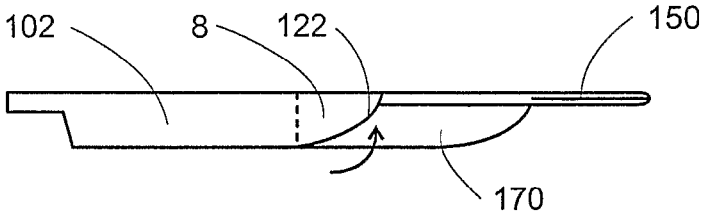
FIG. 95 shows a side cross-sectional view of a dispensing container positioned as a cartridge in a dispensing utensil according to a preferred embodiment of the invention.
Figure 95B:
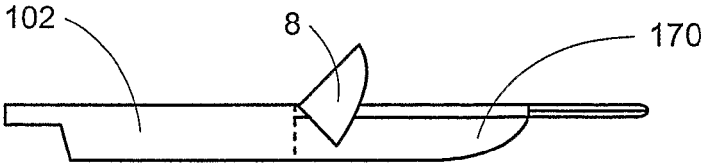

FIG. 95*a* shows a side cross-sectional view of a dispensing utensil 102 according to a preferred embodiment of the invention, in which tool portion 150 (being an applicator brush/swab) is at the 'same' end as lid 108. However, tool portion 150 is not mounted in fixed relation on lid 108. A delivery channel 170 is provided and, as shown in FIG. 95*b*, as lid 108 is opened, the contents of dispensing utensil 102 are dispensed into delivery channel 170. The contents are then guided to tool portion 150 and delivered at a position remote from the lid—onto the top surface of the tool portion 150, ready for use.

Figure 96:
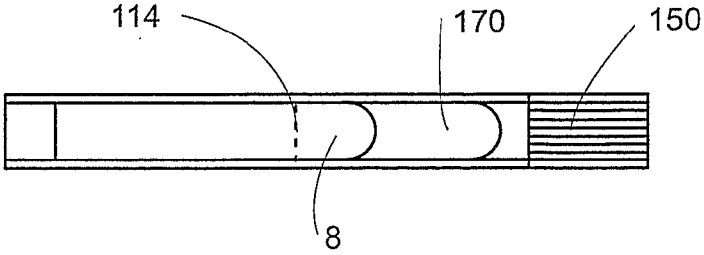
FIG. 96 shows a top view of the embodiment of FIG. 95.

Delivery channel 170 is shown as an open space, which, as shown in the top view of FIG. 96, enables a user to insert a thumb beneath lid 108 onto thumb-rest 122 in order to open the lid 108. However, other embodiments of the invention, in which the delivery channel 107 is not visible and does not form an access-way to allow a user to open the lid are also envisaged. In such embodiments, the lid 108 itself may not be visible from the exterior of the utensil 102, the force exerted by a user on external portions of the utensil 102 being sufficient to open the internal lid and break the seal (not shown) to dispense contents to a delivery channel, for delivery at a position remote from the lid.

Figure 97:
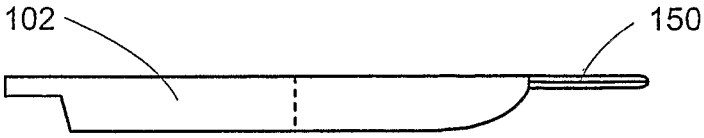
FIG. 97 shows a side view of the embodiment of FIG. 95.

FIG. 97 shows a side view of the embodiment of FIGS. 95*a* and 95*b*.

FIGS. 98*a* to 98*b* show an exploded bottom perspective view of a dispensing container with associated tool, according to an embodiment of the present invention, in which FIG. 98*a* shows a tool 390 (having a brush 350) and FIG. 98*b* shows a dispensing container cartridge 302. The cartridge 302 is adapted to engage with the tool 390. The tool 390 may be provided with an appropriate delivery channel (not shown) or, in use, the cartridge 302 may be removed, its contents dispensed onto the tool 390, and the cartridge 302 re-sealed for later use (and stored on tool 390), or simply discarded. Such an arrangement is highly convenient. Tool 390 may be provided initially assembled with cartridge 302, and replacement cartridges 302 provided as re-fills.

FIGS. 99*a* to 99*b* show an exploded top perspective view of the embodiment of FIGS. 98*a* to 98*b* and FIG. 100 shows a top perspective view of the embodiment of FIGS. 98*a* to 98*b* in assembled position. In another embodiment, not shown, the cartridge may be rotatable within the tool, having a stored position and a dispensing position. Rotation of the cartridge may allow for ease of dispensing of contents from one end of the cartridge, rather than, for example, removing the cartridge from the tool in order to dispense.

FIGS. 101 to 103 show perspective views and an exploded view of a dispensing utensil for dispensing a liquid such as fruit juice. The utensil has a tool portion 250, being a drinking straw which is partially formed integrally with carcass 204.

Pliable "top" wall 212 forms a hinge about which lid 208 rotates to open the dispensing utensil and expose an end of the tool portion 250, (drinking straw) for use. In the embodiment shown, one wall of the drinking straw 250 is created by pliable "top" wall 212. It is noted that wall 212, in normal use, is a 'side' wall, however, during manufacture the dispensing utensil may be oriented to have a 'top' opening, be 'top filled' and then sealed with the top wall 212 before being re-oriented for display or use.

Advantageously, the drinking straw inlet is positioned to ensure that the last portion of contents is easily sucked through the straw by simply tilting the utensil in a natural drinking position, as the straw inlet is then located at or near the lowest point.

Tools which may be incorporated in the dispensing utensil include (but are not limited to) stirrers, mixing paddles, spoons, forks, knifes, chopsticks, drinking straws, brushes (of many types), tooth picks, floss picks, mops, tongs, tweezers, razors, trowels and spades, spatulas and combs.

The dispensing utensil's contents are preferably synergistically paired with the tool for maximum effectiveness. Some non-limiting examples may include sugar or energy drink concentrate in a spoon or stirrer, wasabi and soy sauce in chopsticks, cocktail stirrer and alcohol shot, two-part glue with a stirrer/mixing spatula, touch-up or children's paint with a brush, toothpaste with toothbrush, dental floss pick and mouthwash, medicament or ointment such as cold-sore cream with applicator pad/brush, cooking oil in a spatula or barbeque tongs, salad dressing in salad-serving spoon, tweezers with antiseptic ointment, brush with marinade sauce, razor with shaving créme, garden trowel or spade with seeds, paint stirrer with colour tint, washing brush with detergent, spatula with putty or gap filler, mop with disinfectant or floor cleanser, comb or brush with hair treatment or styling product.

Contents which may conveniently be dispensed from a dispensing container or utensil according to the present invention include, but are not limited to, the following whether in powdered, granulated, liquid or other forms.

Food and beverage products including tea, coffee, sugar, sugar-substitutes and artificial sweeteners, paste, marinade, dried fruit and nuts, milk, drinking additives syrups and powders including hot chocolate, toppings, cordials, alcoholic beverages, confectionary such as sprinkles, chocolates, lollies, salt and pepper, spices, herbs, sauces, dressings, spreads, condiments including soy sauce, mustard, mayonnaise.

Nutriceuticals (for people and animals) including energy & vitamin supplements and concentrates, food supplements, dieting and slimming mixes and powders.

Medicaments, medicines and pharmaceuticals (for people and animals) including drugs, creams, pills, cough syrups, non-prescription medicines such as headache and anti-inflammatory tablets.

Personal care products including toothpaste, mouthwash, floss, hair products and treatments such as shampoos, dyes, hair ties and pins, shaving creams, antiseptics and disinfectants, toothpicks, massage oil, moisturisers, sunscreens, soap and liquid soaps.

Household products including cleaning fluids and detergents, cleansers, furniture oils, bleaches.

Office products including inks, rubber bands, paper clips, staples, drawing pins, nails and tacks, adhesives.

Hardware items including screws, washers, nails, tacks.

Garden and plant products including seeds, fertilizer, poisons, flower booster.

Chemical products for domestic and industrial use, including adhesives and paint products including artists and children's paints, household paint, paint tints, putty fillers.

The container or utensil may be manufactured in a wide range of shapes or sizes, according to its required purpose. For example, to dispense orange juice, a rectangular box including a straw could be provided, or alternatively a pyramidal or other three dimensional shape. A carcass framework of suitable shape could support a 'top pliable wall' about which the lid rotates, and the other walls may also be pliable. The advantage of regular, 'stiff' shapes is ease of manufacture, distribution and handling through the distribution chain, while the ability to use pliable side walls allows for reduced amounts of "non-natural" materials (such as plastics) to be used, reducing environmental impacts.

As the present invention may be embodied in several forms without departing from the spirit of the essential characteristics of the invention, it should be understood that the above described embodiments are not to limit the present invention unless otherwise specified, but rather should be construed broadly within the spirit and scope of the present invention as defined in the appended claims. Various modifications and equivalent arrangements are intended to be included within the spirit and scope of the present invention and appended claims.

The invention claimed is:

1. A dispensing container comprising:

a body having:

a carcass having a through opening; and a pliable top wall and a bottom wall, the walls supported by the carcass, wherein the pliable top wall and bottom wall define at least a portion of a body cavity for storing dispensable cavity contents, the bottom wall extending over the through opening of the carcass;

the container further including:

a lid connected to the pliable top wall and openable about a hinge formed by the pliable top wall, the lid having a lid cavity in communication with the body cavity; and a seal sealing at least a portion of the lid at the body;

wherein the seal may be broken and the lid opened about the hinge formed by the pliable top wall, thereby allowing the dispensable cavity contents to be dispensed; and wherein the bottom wall is formed integrally with the seal.

2. The dispensing container of claim 1, wherein:

a substantial portion of the body is rigid;

the pliable top wall is flat;

the carcass and bottom wall define a shell and the flat pliable top wall, carcass and bottom wall define the at least a portion of the body cavity;

a substantial portion of the lid is rigid; and the seal seals at least a portion of the lid at the shell.

3. A dispensing container including a body, a substantial portion of the body being rigid, the body having:

a carcass having a through opening;

a flat pliable top wall; and a bottom wall that is discrete from the carcass and covers the through opening of the carcass;

the walls supported by the carcass, wherein the carcass and bottom wall define a shell and wherein the flat pliable top wall, carcass, and bottom wall define at least a portion of a cavity for storing dispensable cavity contents;

the container further including:

a lid, a substantial portion of the lid being rigid, the lid connected to the pliable top wall and openable about a hinge formed by the flat pliable top wall; and a seal that is integral with the bottom wall for sealing at least a portion of the lid at the shell;

wherein the seal may be broken and the lid opened about the hinge formed by the flat pliable top wall, thereby allowing the cavity contents to be dispensed.

4. A dispensing container of claim 2 wherein the hinge is formed by and in the plane of the flat, pliable top wall and the seal sealing at least a portion of the lid at the shell is out of the plane of the top wall.

5. A dispensing container of claim 1 wherein the dispensing container is elongate, having a longitudinal axis perpendicular to the axis of the hinge.

6. A dispensing container of claim 1 wherein the seal is broken by the action of opening the lid about the hinge.

7. A dispensing container of claim 1 wherein the seal is one of a polymer, foil, film, paper or membrane.

8. A dispensing container according of claim 1 wherein the carcass further includes a reinforcing rib adjacent the lid.

9. A dispensing container of claim 8 wherein the rib and lid are integrally formed with a failure zone therebetween, the seal extending over said failure zone.

10. A dispensing container of claim 1 wherein the lid and bottom wall are integrally formed with a failure zone therebetween, the seal extending over said failure zone.

11. A dispensing container of claim 1 wherein the carcass and the bottom wall define a shell having an inner surface and the seal is affixed to the inner surface of the shell.

12. A dispensing container of claim 1 wherein the carcass is moulded plastic and the pliable top wall is paper, film or foil.

13. A dispensing container of claim 1 wherein the lid includes a rigid thumb-rest.

14. A dispensing container of claim 1 further including the contents of said cavity.

15. A dispensing container comprising:

a body having a through opening;

a pliable top wall of the body and a bottom wall of the body, the top and bottom walls defining at least a portion of a body cavity for storing dispensable contents, the bottom wall extending over the through opening of the body;

a lid connected to the body and openable about a hinge formed by the pliable top wall, the lid having a lid cavity in communication with the body cavity;

a seal of the body that extends onto at least a portion of the lid with the seal configured to be broken and the lid opened about the hinge formed by the pliable top wall to allow contents of the container to be dispensed; and wherein the bottom wall is formed integrally with the seal.

16. A dispensing container of claim 15 including a failure zone between the lid and the body and the seal extends over the failure zone.

17. A dispensing container of claim 16 wherein the body includes molded plastic and the pliable top wall is paper, film, or foil.

18. The dispensing container of claim 3 wherein the lid includes a lid cavity in communication with the body cavity.

19. A dispensing container of claim 15 wherein the top wall is flat and the hinge formed by the top wall is in the plane of the flat top wall; and the seal is disposed out of the plane of the top wall.

* * * * *